US005905520A

United States Patent [19]

Fujii et al.

[11] Patent Number: 5,905,520

[45] Date of Patent: May 18, 1999

[54] PAPER HANDLING APPARATUS AND PRINTING APPARATUS HAVING A PAPER HANDLING FUNCTION

[75] Inventors: Daisuke Fujii; Eiichi Sugisaki; Amiko Chihara; Akihiro Yoshimura; Shigeru Yamakawa; Yasunori Toda, all of Kawasaki; Kumiko Nagai; Mitsuhiro Ino, both of Yokohama, all of Japan

[73] Assignee: Fujitsu Limited, Kanagawa, Japan

[21] Appl. No.: 08/574,902

[22] Filed: Dec. 19, 1995

[30] Foreign Application Priority Data

Jan. 13, 1995 [JP] Japan ..... 7-003846
Sep. 5, 1995 [JP] Japan ..... 7-228374

[51] Int. Cl.[6] ..... B41J 2/385; G03G 9/08

[52] U.S. Cl. ..... 347/153

[58] Field of Search ..... 347/153, 154, 347/157; 400/619, 621, 621.1, 621.2, 624

[56] References Cited

U.S. PATENT DOCUMENTS

| | | | |
|---|---|---|---|
| 4,957,381 | 9/1990 | Sakai et al. | 400/621 |
| 5,279,536 | 1/1994 | Abreu | 414/790 X |
| 5,331,387 | 7/1994 | Okada et al. | 355/324 |
| 5,531,530 | 7/1996 | Kuramoto et al. | 400/593 |

FOREIGN PATENT DOCUMENTS

| | | |
|---|---|---|
| 26 53 261 A1 | 8/1977 | Germany . |
| 28 28 144 A1 | 2/1979 | Germany . |
| 33 31 982 A1 | 3/1985 | Germany . |
| 60-171969 | 9/1985 | Japan . |
| 2-243464 | 9/1990 | Japan . |
| 3-264470 | 11/1991 | Japan . |

OTHER PUBLICATIONS

Official action issued Jul. 3, 1997 in German patent application No. 196 54 869.1–27, filed on Jan. 27, 1997 (English language translation included).

*Primary Examiner*—Edward H. Tso
*Attorney, Agent, or Firm*—Armstrong, Westerman, Hattori, McLeland, & Naughton

[57] ABSTRACT

A paper handling apparatus has a simplified structure and allows printed paper to be stacked efficiently. The paper handling apparatus receives printed paper which has undergone printing for each print job and handles the printed paper in an orderly manner. The paper handling apparatus has a stacking section in which printed paper is stacked sequentially for a plurality of jobs and an unloading mechanism for unloading stacked printed paper from the stacking section to the outside. The paper handling apparatus can be used with a printing apparatus which is connected to a large-scale information processing system or similar for printing a large volume of data.

65 Claims, 32 Drawing Sheets

PAPER HANDLING APPARATUS AND PRINTING APPARATUS HAVING A PAPER HANDLING FUNCTION

BACKGROUND OF THE INVENTION

1) Field of the Invention

The present invention relates to a paper handling apparatus and a printing apparatus, both having a function of stacking sheets of paper which have continuously undergone printing or a function of cutting continuous paper which has undergone printing and which has been fed continuously and more particularly, to a paper handling apparatus and a printing apparatus which are suited for printing a large volume of data transmitted from a large-scale information processing system or similar.

2) Description of the Related Art

In recent years, information processing systems assume, for example, the form of a network system in which a host computer, such as a super-computer, is connected with terminals, such as personal computers, office computers, and similar, through a network similar to LAN so as to establish mutual communication.

A printing apparatus (electrophotographic printer or similar, for example) is connected to such an information processing system through a network. The printing apparatus is adapted to continuously print, at a high speed on a large quantity of printing paper (continuous paper or continuous form), a large volume of print data, which are transmitted from the host computer, and the individual terminals through the network.

Since printed paper is ejected from the printing apparatus in a large quantity, the printed paper needs to be handled properly on the paper ejection side of the printing apparatus. For example, the printed paper needs to be stacked for temporary storage.

In this connection, an apparatus for handling printed paper is disclosed, for example, in Japanese Patent Application Laid-open Nos. 3-264470 and 2-243464.

The apparatus described in Japanese Patent Application Laid-open No. 3-264470 is provided with a plurality of shelves for stocking printed paper in a sorted manner and transfer means for transferring printed paper to the shelves. In the apparatus, printed paper is transferred and stored in a sorted manner, whereby a print requester, who is familiar with sorting rules, can readily get the results of printing from a relevant shelf.

According to the apparatus described in Japanese Patent Application Laid-open No. 2-243464, printed paper is stacked on a stacker table, which is moved so as to slightly shift the stacking position of printed paper for each job (print process unit). With this structure, printed paper for each job can be readily identified.

According to a conventional practice, when a printing apparatus is adapted to perform printing on continuous paper, a paper handling apparatus (paper cutting apparatus) having a function of cutting printed continuous paper at suitable positions is provided on the paper ejection side of the printing apparatus. FIGS. 31 and 32 show examples of a printing apparatus provided with such a paper handling apparatus.

As shown in FIGS. 31 and 32, a printing apparatus (printer) 101 is provided with a paper hopper 102 which contains blank continuous paper 100 folded at perforations. The continuous paper 100 fed from the paper hopper 102 has continuously undergone printing at an image transfer section 103. The printed continuous paper 100 is ejected from the printing apparatus 101 and enters a paper handling apparatus 110 (paper cutting apparatus) which is connected to the printing apparatus 101 at its paper ejection side (latter part).

The paper handling apparatus 110 is provided with a cutter 111 for cutting the printed continuous paper 100 at suitable positions. The cutter 111, as described later, cuts the continuous paper 100 along perforations at a suitable number of pages (a portion of paper between two lines of perforations is handled as one page) or in response to an instruction from a host computer (host apparatus) 105.

The paper handling apparatus 110 is provided with a paper stacker 112 in which the printed continuous paper 100 is stacked while being folded at perforations. When a suitable quantity of the printed continuous paper 100 accumulates in the paper stacker 112 and when the stacked paper is separated by cutting with the cutter 111 from the continuous paper 100 on the side of the printing apparatus 101, a block of thus separated stacked continuous paper 100 is ejected from the paper stacker 112.

In FIGS. 31 and 32, reference numeral 104 denotes an operator panel which is located on the printing apparatus 101 and allows an operator to make various kinds of settings for the printing apparatus 101 and the paper handling apparatus 110. Reference numeral 105 denotes a host computer (host apparatus), which outputs various instructions (a request for print, etc.) to the printing apparatus 101 so as to control the printing apparatus 101.

The host computer 105, shown in FIG. 31, however, has only software 105A for the printing apparatus 101 and is adapted to control the printing apparatus 101 according to the software 105A without considering the cutting function of the paper handling apparatus 110. On the other hand, the host computer 105, shown in FIG. 32, has software 105B for the paper handling apparatus 110, in addition to the software 105A for the printing apparatus and is adapted to control a cutting operation performed by the cutter 111 in the paper handling apparatus 110 and printing of an intermediate separator, as described later, according to the software 105B for the paper handling apparatus 110, while controlling the printing apparatus 101 according to the software 105A for the printing apparatus.

The respective operations of the apparatuses shown in FIGS. 31 and 32 will now be described.

In the printing apparatus 101, shown in FIG. 31, print data received from the host computer 105 are analyzed and expanded, and then the print data are printed at the image transfer section 103 on the continuous paper 100 which is fed from the paper hopper 102. The printed continuous paper 100 is transferred from the printing apparatus 101 to the paper handling apparatus 110 and stacked in the stacker 112.

In the printing apparatus 101, shown in FIG. 31, an operator can specify, from the operator panel 104, the number of pages to be printed before the continuous paper 100 is cut by the cutter 111 in the paper handling apparatus 110. When the number of printing pages is specified, after printing on the continuous paper 100 as many pages as specified, the printing apparatus 101 outputs an instruction to the paper handling apparatus 110 to being cutting, and thus the cutter 111 performs a cutting operation.

When the printed continuous paper 100 is cut by the cutter 111, the result of printing for one job may be divided into a plurality of blocks (three blocks in FIG. 31) in some cases. If the blocks of printed paper (continuous paper 100) are randomly ejected from the paper handling apparatus 110, their mutual relation (order) and even whether or not blocks are of the same job may become uncertain.

To prevent the above-described problem, information indicative of the same job, i.e., an "intermediate separator," may be printed on the top page of a block of the continuous paper 100 and the bottom page of a subsequent block of the continuous paper 100. In this case, the host computer 105 needs to send print data about an intermediate separator, both before and after the instruction to begin cutting, to the printing apparatus 101.

In the example shown in FIG. 31, the host computer 105 controls the printing apparatus 101 according to the software 105A for the printing apparatus, but the software 105A is not adapted to recognize how many pages of the continuous paper 100 are to be printed before the continuous paper 100 is cut and the positions at which the continuous paper 100 cutting is performed. Accordingly, an intermediate separator cannot be printed, and hence a released block of the printed continuous paper 100 fails to bear an intermediate separator on the top/bottom page.

In this connection, in the example shown in FIG. 32, the host computer 105 has the dedicated software 105B for the paper handling apparatus (paper cutting apparatus) 110 for controlling a cutting operation of the cutter 111 in addition to the software 105A for the printing apparatus.

The dedicated software 105B for the paper handling apparatus manages the cutting position of the continuous paper 100. When an instruction to begin cutting is sent to the printing apparatus 101, the software 105B sends print data about an intermediate separator and an instruction for printing an intermediate separator, both before and after sending an instruction to begin cutting, to the printing apparatus 101, whereby the intermediate separator is printed on a page before and after each cut position. The instruction to begin cutting is sent to the paper handling apparatus 110 via the printing apparatus 101. In response to the instruction to begin cutting, the cutter 111 cuts the continuous paper 100 along perforations which separate two pages each printed with the intermediate separator.

As a result, as shown in FIG. 32, an intermediate separator indicative of the same job is printed on the top and/or bottom page (boundary page) of separate blocks of the continuous paper 100. Thus, an operator, for example, can recognize which block belongs to which job by viewing only the intermediate separator.

In FIG. 32, the top face of each block bears the above-described "intermediate separator," but in actuality, specific print data indicative of a job which are received from the host computer 105 are printed thereon.

However, the apparatus described in Japanese Patent Application Laid-open No. 3-264470 requires shelves for individual destinations. As destinations increase, the space required for shelves increases, leading to an increase in the costs of the apparatus.

As for the apparatus described in Japanese Patent Application Laid-open No. 2-243464, when a large volume of printing is executed in response to a request from a large-scale information processing system, a quantity of printed paper, which is stacked on the stacker table, will soon reach a stack limit quantity, wherein printed paper is disabled from being stacked further on the stacker table. When the stack limit quantity is reached, the printing apparatus stops accepting a request to print. Thus, a host computer and terminals, which output a request to print to the printing apparatus, need to wait for printing to resume until a stack of printed paper is removed from the stacker table. Printing, therefore, needs to halt each time a stacked quantity of printed paper on the stacker table reaches a limit thereof, leading to a deterioration in printing efficiency.

In this connection, the stacker table can have a structure in which the stack table is lowered whenever printed paper is ejected thereon. With this structure, a stackable quantity of printed paper on the stacker table can be increased. Even if this structure is employed, a stacked quantity of printed paper on the stacker table will soon reach a limit thereof when a large volume of printing is executed. Hence, as in the case of the apparatus described above, the information processing system needs to wait for printing to resume until a stack of printed paper is removed from the stacker table in a suspended printing apparatus, leading to a drop in printing efficiency after all. In addition, when a large quantity of printed paper is stacked, a lower portion of the stack is difficult to take out due to the weight of printed paper stacked thereabove. This increases a burden on a person who comes to receive the result of printing.

Furthermore, the printing apparatus 101, provided with the paper handling apparatus 110 shown in FIG. 32, requires the host computer 105 to have the software 105B for controlling the paper handling apparatus 110. That is, attaching the paper handling apparatus 110 to the printing apparatus 101 requires software contained in the host computer 105 to be modified, leading to many additional man-hours and costs.

To solve this problem, a technique is proposed in which the printing apparatus 101 is provided with a circuit for generating print data about an intermediate separator on the basis of job information (see Japanese Patent Application No. 4-308358). This, however, involves adding a new circuit for printing an intermediate separator to the printing apparatus 101, leading to many additional man-hours and costs after all.

In the printing apparatus 101, provided with the paper handling apparatus 110 shown in FIG. 32, an operator (user) usually visually determines whether or not a current job is continued when a stacker full state (i.e., a state where a stacked quantity of the continuous paper 100 has reached a stacking limit of the stacker 112) occurs with the paper stacker 112. This causes an increase in the burden on the operator.

According to a proposed technique for solving this problem, when the number of printed pages, which is counted by the host computer (host apparatus) 105, reaches a predetermined value, the host computer 105 sends an instruction to the printing apparatus 101 so as to print a pattern indicative of a job being continued onto the continuous paper 100. This technique allows easy determination of whether or not a job is continued when the stacker becomes full. This technique is applicable to the printing apparatus 101 which handles paper of a fixed thickness, but is not applicable to a printing apparatus which handles paper of various thicknesses because the number of pages which makes the stacker full varies.

Also, in the printing apparatus 101 provided with the paper handling apparatus 110 shown in FIG. 32, when a minor paper jam occurs in the section between the transfer section 103 and the cutter 111, after the paper jam is solved by an operator, the printing apparatus 101 is usually controlled so as to perform a recovery printing for the portion of the continuous paper 100 which was located between the transfer section 103 and the cutter 111.

In this case, print data, which were printed on the portion of the continuous paper 100 between the transfer section 103 and the cutter 111 when a paper jam occurred, is printed again. Thus, an operator needs to check the printed continuous paper 100 page by page for redundant pages due to recovery printing and to remove the redundant pages. This imposes a heavy burden on the operator.

SUMMARY OF THE INVENTION

The present invention has been accomplished in view of the above-mentioned problems. A first object of the present invention is to provide a paper handling apparatus and a printing apparatus having a paper handling function which allow printed paper to be efficiently stacked without increasing the cost and size of the apparatus or decreasing printing efficiency and without imposing a heavy burden on a user.

A second object of the present invention is to provide a printing apparatus having a paper handling function which can print an intermediate separator without modifying the hardware configuration of an existing apparatus or adding hardware components and without modifying software on the host apparatus side.

A third object of the present invention is to provide a printing apparatus having a paper handling function which can print a pattern indicating continuation of a job (a state in which print process is continued), regardless of a paper thickness, when the job has not been completed when a stacking section becomes full of paper and which allows a user to recognize, at a glance, the state of a job being continued, thereby reducing a burden on the user.

A fourth object of the present invention is to provide a printing apparatus having a paper handling function which allows the user to easily identify redundant pages due to recovery printing which has been performed after the occurrence of a paper jam, thereby reducing a burden on the user.

To accomplish the above-mentioned objectives, the paper handling apparatus of the present invention is adapted to receive and handle paper which has undergone printing for each print process unit, and has a stacking section for sequentially stacking printed paper for a plurality of print process units and an unloading mechanism for unloading a stack of printed paper from the stacking section to the outside.

The paper handling apparatus of the present invention is adapted to receive and handle paper which has undergone printing for each print process unit, and has a stacking section for sequentially stacking printed paper for a plurality of print process units, stacked quantity detecting means for detecting a stacked quantity of printed paper in the stacking section, and halting means for halting an operation of stacking printed paper in the stacking section when the stacked quantity, which is detected by the stacked quantity detecting means, reaches a predetermined quantity. In this case, an unloading mechanism may be provided for unloading a stack of printed paper from the stacking section to the outside after the operation of stacking printed paper in the stacking section has been halted by the halting means.

Furthermore, the paper handling apparatus of the present invention is adapted to receive and handle paper which has undergone printing for each print process unit. The printing paper is continuous paper, a predetermined quantity of which is handled as a loading unit. Plural loading units of continuous paper are mutually connected to become continuous paper for printing use. The paper handling apparatus has a stacking section for sequentially stacking printed paper for a plurality of print process units, connection detecting means for detecting the connection between loading units of continuous paper, a cutting mechanism for cutting printed paper at the connection when the connection is detected by the connection detecting means, and an unloading mechanism, for unloading from the stacking section to the outside, the printed paper of one loading unit which has been released, by being cut with the cutting mechanism, and stacked in the stacking section.

The paper handling apparatus of the present invention is adapted to stack printed paper in the stacking section such that stacks for respective print process units can be distinguished from each other.

In this connection, the paper handing apparatus is provided with an offset mechanism for shifting the position of stacking printed paper for a new print process unit from the stacking position for the last print process unit.

The offset mechanism is composed of an unloading belt, which is located in the stacking section and on which printed paper is stacked, and a drive motor for moving the unloading belt.

When an unloading mechanism and an offset mechanism are to be provided, the unloading mechanism may also be adapted to serve as the offset mechanism.

In the above-mentioned paper handling apparatus, the printing paper may be continuous paper, and a cutting mechanism may be provided for cutting the continuous paper in each print process unit.

Also, the paper handling apparatus of the present invention is adapted to receive and handle paper which has undergone printing for each print process unit, and has a stacking section for sequentially stacking printed paper for a plurality of print process units, stacked quantity detecting means for detecting a stacked quantity of printed paper in the stacking section, an end notice receiving section for receiving a notice indicating the end of each print process unit, a cutting mechanism for cutting printed paper, and selecting means for selecting either of the following two operations. In the first operation, a cutting operation is performed by the cutting mechanism when the stacked quantity detected by the stacked quantity detecting means reaches a first predetermined quantity. In the second operation, a cutting operation is performed by the cutting mechanism when the stacked quantity detected by the stacked quantity detecting means reaches a second predetermined quantity and the end notice receiving section receives a notice indicating the end of a print process unit. In this case, an unloading mechanism may be provided for unloading, from the stacking section to the outside, the printed paper which has been separated by cutting with the cutting mechanism and stacked in the stacking section.

The present invention's printing apparatus, which has a paper handling function, is composed of a printing section for performing a print operation on printing paper and a paper handling section for handling paper which has undergone printing for each print process unit in the printing section. The paper handling section has a stacking section for sequentially stacking printed paper for a plurality of print process units and an unloading mechanism for unloading a stack of printed paper therefrom.

In this case, the paper handling section may be provided with near full detecting means for detecting a nearly full state, wherein the free space within the stacking section has decreased to a predetermined quantity. Also, control means may be provided and the control means may cause the printing section to continue printing if the print operation, for a print process unit, has not been completed at the time of the near full detecting means detecting a nearly full state of the stacking section so that the unloading mechanism of the paper handling section is instructed to perform an unloading operation if the print operation for the print process unit has been completed at the time of the near full detecting means detecting a nearly full state of the stacking section.

Also, the present invention's printing apparatus, which has a paper handling function, is composed of a printing section for performing a print operation on printing paper and a paper handling section for handling paper which has undergone printing for each print process unit in the printing section. The paper handling section has a stacking section for sequentially stacking printed paper for a plurality of print process units, stacked quantity detecting means for detecting a stacked quantity of printed paper in the stacking section, and halting means for halting an operation of stacking printed paper in the stacking section when the stacked quantity, which is detected by the stacked quantity detecting means, reaches a predetermined quantity.

In this case, the paper handling section may have an unloading mechanism for unloading a stack of printed paper from the stacking section to the outside after an operation of stacking printed paper in the stacking section has been halted by the halting means.

Furthermore, the present invention's printing apparatus, which has a paper handling function, is composed of a printing section for performing a print operation on printing paper and a paper handling section for handling paper which has undergone printing for each print process unit in the printing section. The printing paper is continuous paper and a predetermined quantity of the printing paper is handled as a loading unit. Plural loading units of continuous paper are mutually connected to become continuous paper for printing use. The paper handling apparatus has a stacking section for sequentially stacking printed paper for a plurality of print process units, connection detecting means for detecting the connection between loading units of continuous paper, a cutting mechanism for cutting printed paper at the connection when the connection is detected by the connection detecting means, and an unloading mechanism for unloading printed paper therefrom, the printed paper being of a quantity equivalent to one loading unit which has been released by being cut with the cutting mechanism and stacked in the stacking section.

The printing apparatus of the present invention is adapted to stack printed paper in the stacking section of the paper handling section such that stacks for respective print process units can be distinguished from each other.

In this connection, the paper handling section is provided with an offset mechanism for shifting the position of stacking printed paper of a new print process unit from the stacking position for the last print process unit.

The offset mechanism is composed of an unloading belt, which is located in the stacking section and on which printed paper is stacked, and a drive motor for moving the unloading belt.

When an unloading mechanism and an offset mechanism are to be provided, the unloading mechanism may also be adapted to serve as the offset mechanism.

In the above-mentioned printing apparatus, the printing paper may be continuous paper, and a cutting mechanism may be provided for cutting the continuous paper in print process units.

Also, the present invention's printing apparatus, which has a paper handling function, is composed of a printing section for performing a print operation on printing paper and a paper handling section for handling continuous paper which has undergone printing for each print process unit in the printing section. The paper handling section is provided with a stacking section for sequentially stacking printed paper for a plurality of print process units, stacked quantity detecting means for detecting a stacked quantity of printed paper in the stacking section, and a cutting mechanism for cutting printed paper. Also, an end notice receiving section is provided for receiving a notice indicating the end of each print process unit and a selecting means is provided for selecting either of the following two operations. In the first operation, a cutting operation is performed by the cutting mechanism when the stacked quantity detected by the stacked quantity detecting means reaches a first predetermined quantity. In the second operation, a cutting operation is performed by the cutting mechanism when the stacked quantity detected by the stacked quantity detecting means reaches a second predetermined quantity and when the end notice receiving section receives a notice indicating the end of a print process unit. In this case, the paper handling section may be provided with an unloading mechanism for unloading printed paper therefrom, the printed paper having been separated by being cut with the cutting mechanism and having been stacked in the stacking section.

In the above-mentioned paper handling apparatus and printing apparatus of the present invention, paper, which has undergone printing for a plurality of print process units in the printing section, is stacked in the stacking section, and a stack of printed paper is unloaded by the unloading mechanism from the stacking section to the outside when the stacked quantity of printed paper reaches a predetermined quantity in the stacking section. Thus, a space for stocking printed paper for a plurality of print process units in the apparatus can be minimized. Since the unloading mechanism unloads a stack of printed paper from the stacking section to the outside when the stacked quantity of printed paper reaches a predetermined quantity in the stacking section, it is possible to solve the problem that printed paper, which was stacked when an initial print process unit was performed, cannot be taken out due to too much stacking of printed paper in the stacking section.

In the printing apparatus, if the printing for a print process unit is not completed when the near full detecting means detects a nearly full state of the stacking section, the control means causes the printing section to continue printing until the printing for the print process unit is completed. This prevents the problem that the printing for one print process unit is halted midway and that printed paper is unloaded by the unloading mechanism. Thus, printed paper of the same print process unit can be prevented from being stacked and unloaded in different blocks.

In the above-mentioned paper handling apparatus and printing apparatus of the present invention, the stacked quantity detecting means detects a stacked quantity of printed paper in the stacking section, and if the stacked quantity reaches a predetermined quantity (a loading unit, for example, a quantity of paper before use (specifically, a quantity equivalent to a box of paper on the market)), the halting means halts stacking of the printed paper in the stacking section. Thus, printed paper can be stacked in a suitable quantity for transport in the stacking section. After a stacking operation is halted by the halting means, the unloading mechanism unloads the predetermined quantity (a predetermined loading unit) of printed paper from the stacking section to the outside, whereby a space for stocking printed paper can be reduced.

In the above-mentioned paper handling apparatus and printing apparatus of the present invention, when the connection detecting means detects a connection with the subsequent loading unit, the cutting mechanism cuts continuous paper at the connection. Thus, the cutting of printed paper is performed each time a stacked quantity of printed paper reaches a predetermined quantity in the stacking section, whereby printed paper can be stacked in a suitable quantity for transport in the stacking section. After a cutting operation of the cutting mechanism is completed, the unloading mechanism unloads the predetermined quantity of printed paper from the stacking section to the outside, whereby a space for stocking printed paper can be reduced.

In the paper handling apparatus and printing apparatus of the present invention, printed paper for a plurality of print process units is stacked in the stacking section such that stacks for respective print process units can be distinguished from each other. That is, printed paper for a specific print process unit can be easily distinguished from printed paper for other print process units stacked in the stacking section.

In this connection, the offset mechanism causes printed paper to be stacked in the stacking section such that a stack for one print process unit is shifted from a stack for another print process unit, whereby printed paper for each print process unit can be easily identified without using colored paper or making a special print.

The above-mentioned offset mechanism can be implemented in a simple structure using an unloading belt and a drive motor. The drive motor moves the unloading belt so as to stack printed paper on the unloading belt in such a state that a stack for one print process unit is shifted from a stack for another print process unit. Accordingly, printed paper for each print process unit can be easily identified without using colored paper or making a special print.

When an unloading mechanism and an offset mechanism are provided, the unloading mechanism and the offset mechanism can be combined. Thus, it is not necessary to provide the mechanisms independently of each other, whereby the structure of the apparatus can be made more compact. By moving the unloading belt with the drive motor, printed paper which is stacked on the unloading belt can be unloaded from the stacking section to the outside.

Furthermore, continuous paper is used as printing paper which is handled in the aforesaid paper handling apparatus and printing apparatus. The cutting mechanism cuts the continuous paper in print process units, whereby printed paper for a plurality of print process units is stacked in the stacking section such that a stack for one print process unit is shifted from a stack for another print process unit.

The paper handling apparatus and printing apparatus of the present invention are provided with the selecting means for selecting either of the following two operations. In the first operation, a cutting operation is performed by the cutting mechanism when the stacked quantity detecting means detects that the stacked quantity of printed paper (continuous paper) has reached a first predetermined quantity in the stacking section. In the second operation, a cutting operation is performed by the cutting mechanism when the stacked quantity detecting means detects that the stacked quantity of printed paper has reached a second predetermined quantity in the stacking section and the end notice receiving section receives a notice indicating the end of a print process unit. Thus, diversified needs of users can be coped with easily.

After a cutting operation of the cutting mechanism is completed, the unloading mechanism unloads a predetermined quantity of printed paper, including the result of printing for a plurality of print process units, from the stacking section to the outside, whereby a space for stocking printed paper can be reduced.

Furthermore, in the above-mentioned printing apparatus which has a paper handling function, because of the above-mentioned functions of the paper handling apparatus of the present invention, printed paper can be efficiently stacked, while space is saved because of a simple structure. In addition, printed paper for one print process unit can be easily distinguished from printed paper for another, whereby diversified needs of users of the printing apparatus can be coped with easily.

The present invention's printing apparatus, which has a paper handling function, is composed of a printing section for performing a print operation on continuous paper, a print control section for controlling a printing operation of the printing section, and a paper handling section having a cutting mechanism for cutting continuous paper which has undergone printing at the printing section. The printing apparatus has a storage section for storing job name information which is transmitted together with print data from a print requester so as to display a job name of current print data on the apparatus. In the printing apparatus, when continuous paper is cut by the cutting mechanism while printing for one print process unit is not completed, the print control section controls the printing section so as to print a job name of current print data on a page before and after the cutting position as an intermediate separator on the basis of the job name information stored in the storage section.

In this printing apparatus, when continuous paper is cut by the cutting mechanism while printing for one print process unit is not completed, the print control section and the printing section function so as to read a job name of current print data from the storage section and to print the job name on a page before and after the cutting position to act as an intermediate separator. That is, job name information is conventionally transmitted from a print requester for display. This job name information can be used for printing a job name as an intermediate separator. Thus, even when printed continuous paper for one print process unit is cut and divided into different blocks, a user can easily determine which block of printed continuous paper is for which print process unit, by referring to the job name, printed as an intermediate separator, on each block of printed continuous paper.

Also, the present invention's printing apparatus, which has a paper handling function, is composed of a printing section for performing a print operation on continuous paper, a print control section for controlling a printing operation of the printing section, and a paper handling section having a cutting mechanism for cutting continuous paper which has undergone printing at the printing section. The printing apparatus has a storage section for storing registered pattern data for use as an intermediate separator. In the printing apparatus, when continuous paper is cut by the cutting mechanism while printing for one print process unit is not completed, the print control section controls the printing section so as to print the pattern data stored in the storage section on a page before and after the cutting position to act as an intermediate separator. In this case, the storage section may be an existing overlay memory, and the pattern data may be stored in the overlay memory as an overlay pattern.

In this printing apparatus, when continuous paper is cut by the cutting mechanism while printing for one print process unit is not completed, the print control section and the printing section function so as to read pattern data for use as an intermediate separator from the storage section and to print the read pattern data on a page before and after the cutting position. That is, previously registered pattern data can be printed as an intermediate separator. Thus, even when printed continuous paper for one print process unit is cut and divided into different blocks, a user can easily determine which block of printed continuous paper is for which print process unit, by referring to pattern data printed as an intermediate separator on each block of printed continuous paper. In this case, by registering pattern data in an existing overlay memory as an overlay pattern, it is not necessary to newly prepare a storing section for storing pattern data.

Furthermore, the present invention's printing apparatus, which has a paper handling function, is composed of a printing section for performing a print operation on continuous paper, a print control section for controlling a printing operation of the printing section, and a paper handling section having a cutting mechanism for cutting continuous paper which has undergone printing at the printing section. The printing apparatus has a counting section which performs a counting operation at the time of the cutting operation of the cutting mechanism and which outputs the thus counted value. In the printing apparatus, when continuous paper is cut by the cutting mechanism while printing for one print process unit is not completed, the print control section controls the printing section so as to print a count value received from the counting section on a page before and after the cutting position to act as an intermediate separator.

In this printing apparatus, when continuous paper is cut by the cutting mechanism while printing for one print process unit is not completed, the print control section and the printing section function so as to print a count value, which is a value counted by the counting section at the time of the cutting operation, on a page before and after the cutting position to act as an intermediate separator. That is, a count value corresponding to the time of the cutting operation can be printed as an intermediate separator. Thus, even when printed continuous paper for one print process unit is cut and divided into different blocks, a user can easily determine the continuous relationship between blocks of printed continuous paper by referring to a count value printed as an intermediate separator on each block of printed continuous paper.

Also, the present invention's printing apparatus, which has a paper handling function, is composed of a printing section for performing a print operation on continuous paper, a print control section for controlling a printing operation of the printing section, and a paper handling section for handling continuous paper which has undergone printing for each print process unit (each job) at the printing section. The paper handling section has a cutting mechanism for cutting continuous paper which has undergone printing at the printing section, a stacking section for stacking continuous paper which has undergone printing at the printing section, a full-of-paper detector for detecting the state that the stacking section has become full of continuous paper, and a cutting control section for controlling a cutting operation of the cutting mechanism. When the full-of-paper detector detects the state that the stacking section is full of continuous paper while printing for one print process unit is not completed, the print control section outputs an instruction to the cutting control section for cutting continuous paper and controls the printing section so as to print a pattern indicating continuation of a print process (job continuation) on a cut-off portion of continuous paper.

In this case, when an instruction to begin cutting is entered for cutting continuous paper with the cutting mechanism and when the full-of-paper detector detects the state that the stacking section is full of paper, the print control section outputs an instruction to the cutting control section for cutting continuous paper and controls the printing section so as to print the above-described pattern on a cut-off portion of continuous paper.

A selecting section may be provided for selecting whether to print the above-described pattern or not. An alarm section may be provided for generating an alarm when the above-described pattern is printed.

The print control section controls the printing section so that the above-described pattern is printed on a portion which will become a top surface when the cut-off portion of the continuous paper is stacked in the stacking section.

When an instruction for paper ejection is entered for ejecting continuous paper into the stacking section and the full-of-paper detector detects the state that the stacking section is full of paper, the print control section outputs an instruction to the cutting control section for cutting continuous paper and controls the printing section so as to print the above-described pattern on a cut-off portion of continuous paper, and then causes an operation of ejecting paper to be performed.

When an automatic paper eject mode is selected in which remaining continuous paper is automatically ejected unprinted if continuous paper runs out during printing, the print control section outputs an instruction to the cutting control section for cutting continuous paper and controls the printing section so as to print the above-described pattern on a cut-off portion of continuous paper, and then lets an operation of automatically ejecting paper be performed.

Furthermore, the print control section may be adapted to control the printing section for printing the above-described pattern only when the paper handling section is in use, and may be provided with a storage section for storing the above-described pattern.

In the printing apparatus of the present invention described above, when the full-of-paper detector detects the state that the stacking section is full of paper while printing for one print process unit is not completed, the print control section and the printing section function so as to print the pattern indicating continuation of a print process unit on a cut-off portion of continuous paper. That is, since the full-of-paper detector detects the state that the stacking section is fill of paper, the pattern indicating continuation of a print process unit can be reliably printed regardless of paper thickness, whereby a user can recognize, at a glance, the state of a print process being continued (job continuation) when the stacking section becomes full of paper.

When the full-of-paper detector detects the state that the stacking section is full of paper when an instruction to begin cutting or an instruction for paper ejection is entered, or when continuous paper runs out in the automatic paper eject mode, the print control section and the printing section function so as to print the pattern indicating continuation of a print process unit on a cut-off portion of continuous paper. Thus, the pattern can be reliably printed according to various states of the printing apparatus, and a user can recognize, at a glance, the state of a print process being continued (job continuation) when the stacking section becomes full of paper.

Also, the selecting section allows a user to select whether to print the above-described pattern or not, whereby diversified needs of users of the printing apparatus can be coped with.

Furthermore, the above-described pattern is printed so that when continuous paper, which is separated by cutting, is stacked in the stacking section, a page printed with the pattern comes to the top of the stacked continuous paper. Thus, a user does not fail to view the printed pattern, whereby the user can recognize more surely the state of a print process being continued (job continuation) when the stacking section becomes full of paper.

Further, the alarm section gives off or sounds an alarm when the printing section prints the above-described pattern, thereby reliably notifying a user of the state that the stacking section has become full of paper while printing has not been completed.

Also, the printing section can be adapted to print the above-described pattern only when the paper handling section is in use. In addition, the pattern can be stored in the storage section of the print control section, whereby the print control section can read the pattern from the storage section for printing. That is, it is not necessary to select and register the pattern from outside.

The present invention's printing apparatus, which has a paper handling function, also has a printing section for performing a print operation on continuous paper, a paper handling section having a cutting mechanism for cutting continuous paper which has undergone printing at the printing section, trouble detecting means for detecting the occurrence of trouble which requires recovery printing by the printing section, and a cutting control section for controlling the cutting mechanism so as to cut continuous paper before and after a printed portion, which is to be subjected to recovery printing, for separation thereof, when the trouble detecting means detects the occurrence of the trouble.

In this connection, a display section may be provided for displaying the presence of a redundantly printed portion when recovery printing is performed at the printing section.

In this printing apparatus, when the trouble detecting means detects the occurrence of trouble which requires recovery printing, the cutting mechanism cuts continuous paper before and after a printed portion, which is to be subjected to recovery printing, for separation thereof. Accordingly, a user can easily identify redundant pages due to recovery printing which was performed after the occurrence of the trouble.

In this connection, the display section displays the presence of a redundantly printed portion due to recovery printing at the printing section, thereby prompting a user to remove the redundantly printed portion.

As has been described in detail above, according to the paper handling apparatus and the printing apparatus having a paper handling function of the present invention, a space for stocking printed paper, in the apparatus, for a plurality of print process units, can be minimized, and it is possible to solve the problem that printed paper, which was stacked when an initial print process unit was performed, cannot be taken out due to too much stacking of printed paper in the stacking section. Accordingly, printed paper can be efficiently stacked without increasing the cost and size of the apparatus or decreasing printing efficiency and without imposing a heavy burden on a user. Also, in the printing apparatus, if the printing for a print process unit is not completed when a nearly full state of the stacking section is detected, the printing section continues printing until the printing for the print process unit is completed. This prevents the printing for one print process unit from being halted midway, thereby reliably preventing printed paper of the same print process unit from being stacked and unloaded in different blocks.

Also, according to the paper handling apparatus and the printing apparatus having a paper handling function of the present invention, printed paper can be stacked in a suitable quantity for transport in the stacking section, and also using the unloading mechanism reduces a space for stocking of printed paper. Accordingly, printed paper can be efficiently stacked without increasing the cost and size of the apparatus or decreasing printing efficiency and without imposing a heavy burden on a user.

Furthermore, according to the paper handling apparatus and the printing apparatus having a paper handling function of the present invention, the cutting of printed paper is performed each time a stacked quantity of printed paper reaches a predetermined quantity in the stacking section to thereby stack printed paper in a suitable quantity for transport in the stacking section, and also using the unloading mechanism reduces a space for stocking of printed paper. Accordingly, printed paper can be efficiently stacked without increasing the cost and size of the apparatus or decreasing printing efficiency and without imposing a heavy burden on a user.

According to the present invention, printed paper for a specific print process unit can be easily distinguished from printed paper for other print process units stacked in the stacking section, whereby a burden on a user can be greatly reduced.

In this connection, the offset mechanism causes printed paper to be stacked in the stacking section in such a state that a stack for one print process unit is shifted from a stack for another print process unit, whereby printed paper for each print process unit can be easily identified without using colored paper or making a special print. Thus, a burden on a user can be greatly reduced.

The offset mechanism can be implemented in a simple structure using an unloading belt and a drive motor. A thus-constructed offset mechanism allows printed paper for each print process unit to be easily identified without preparing colored paper or making a special print. Thus, a burden on a user can be greatly reduced.

When an unloading mechanism and an offset mechanism are both provided, the unloading mechanism and the offset mechanism can be combined. Thus, it is not necessary to provide the mechanisms independently of each other, whereby the apparatus structure can be made more compact.

Furthermore, continuous paper is used as printing paper. The cutting mechanism cuts the continuous paper after each print process unit, whereby printed paper for a plurality of print process units is stacked in the stacking section such that stacks for respective print process units can be distinguished from each other. Thus, a burden on a user can be greatly reduced.

Also, according to the paper handling apparatus and the printing apparatus having a paper handling function of the present invention, a user can select either of the following two operations. In the first operation, a cutting operation is performed only according to a stacked quantity of printed paper in the stacking section. In the second operation, a cutting operation is performed according to both a stacked quantity of printed paper in the stacking section and a notice indicating the end of a print process unit. Thus, diversified needs of users can be coped with. Also, using the unloading mechanism reduces a space for stocking printed paper and thus, printed paper can be efficiently stacked without increasing the cost and size of the apparatus or decreasing printing efficiency and without imposing a heavy burden on a user.

According to the printing apparatus having a paper handling function of the present invention, job name information, which is transmitted from a print requester for display use as in a conventional apparatus, can be used for printing a job name as an intermediate separator. Thus, a user can easily determine which block of printed continuous paper is for which print process unit, by referring to a job name printed as an intermediate separator on each block of printed continuous paper. Also, an intermediate separator can be printed without modifying the hardware configuration of an existing apparatus or adding hardware components and without modifying software on the host apparatus side. Thus, when a paper handling function involving cutting paper is introduced, required man-hours can be greatly reduced.

Also, according to the printing apparatus having a paper handling function of the present invention, previously registered pattern data can be printed as an intermediate separator. Thus, a user can easily determine which block of printed continuous paper is for which print process unit, by referring to pattern data printed as an intermediate separator on each block of printed continuous paper, whereby confusion of printed results, due to divided print data, can be prevented. In this case, by using an existing overlay memory as a storage section, it is not necessary to newly prepare a storing section for storing pattern data. Accordingly, an intermediate separator can be printed without modifying the hardware configuration of an existing apparatus or adding new hardware components and without modifying software on the host apparatus side. Thus, when a paper handling function involving cutting paper is introduced, required man-hours can be greatly reduced.

Further, according to the printing apparatus having a paper handling function of the present invention, a count value, corresponding to the time of a cutting operation, can be printed as an intermediate separator. Thus, a user can easily determine the continuous relationship between blocks of printed continuous paper by referring to a count value printed as an intermediate separator on each block of printed continuous paper, whereby confusion of printed results, due to divided print data, can be prevented. Also, since a counting function can be easily implemented by software means or since the counting function may already exist as one of the functions of the print control section, an intermediate separator can be printed without modifying the hardware configuration of an existing apparatus or adding hardware components and without modifying software on the host apparatus side. Thus, when a paper handling function involving cutting paper is introduced, required man-hours can be greatly reduced.

According to the printing apparatus having a paper handling function of the present invention, the full-of-paper detector detects the state that the stacking section is full of paper, and thus a pattern indicating continuation of a print process (job continuation) can be reliably printed regardless of paper thickness, whereby a user can recognize, at a glance, the state of a print process being continued (job continuation) when the stacking section becomes full of paper. This reliably prevents a job from splitting and greatly reduces a burden on a user.

The pattern indicating continuation of a print process can be reliably printed according to various conditions of the printing apparatus. For example, the pattern can be printed when an instruction to begin cutting or an instruction for paper ejection is input, or when paper runs out when the automatic paper eject mode is selected. Thus, a user can recognize, at a glance, the state of a print process unit being continued when the stack section becomes full of paper. This reliably prevents a job from splitting and reduces a burden on a user.

Also, by allowing a user to select whether to print the above-described pattern or not, diversified needs of users can be coped with.

Furthermore, the above-described pattern is printed in such a position that a user does not fail to view, whereby the user can recognize more surely the state of a print process unit being continued when the stacking section becomes full of paper. Thus, a burden on a user can be further reduced.

Further, the alarm is given off or sounded when the printing section prints the above-described pattern, thereby reliably notifying a user of the state that the stacking section has become full of paper while printing for a print process unit has not been completed. Thus, a burden on a user can be further reduced.

Also, the printing section can be adapted to print the above-described pattern only when the paper handling section is in use. In addition, by reading and printing the pattern which is previously stored in the storage section, it is not necessary to select and register the pattern from outside a print control system.

According to the printing apparatus having a paper handling function of the present invention, continuous paper is cut before and after a printed portion is subjected to recovery printing, thereby cutting off the section from continuous paper. Accordingly, a user can easily identify and remove redundant pages due to recovery printing which was performed after the occurrence of trouble. Thus, a burden on a user can be further reduced.

In this connection, the presence of a redundantly printed portion due to recovery printing is displayed, thereby prompting a user to remove the redundantly printed portion. Thus, a burden on a user can be further reduced.

BRIEF DESCRIPTION OF TEE DRAWING FIGURES

DESCRIPTION OF THE PREFERRED EMBODIMENTS

Figure 1:
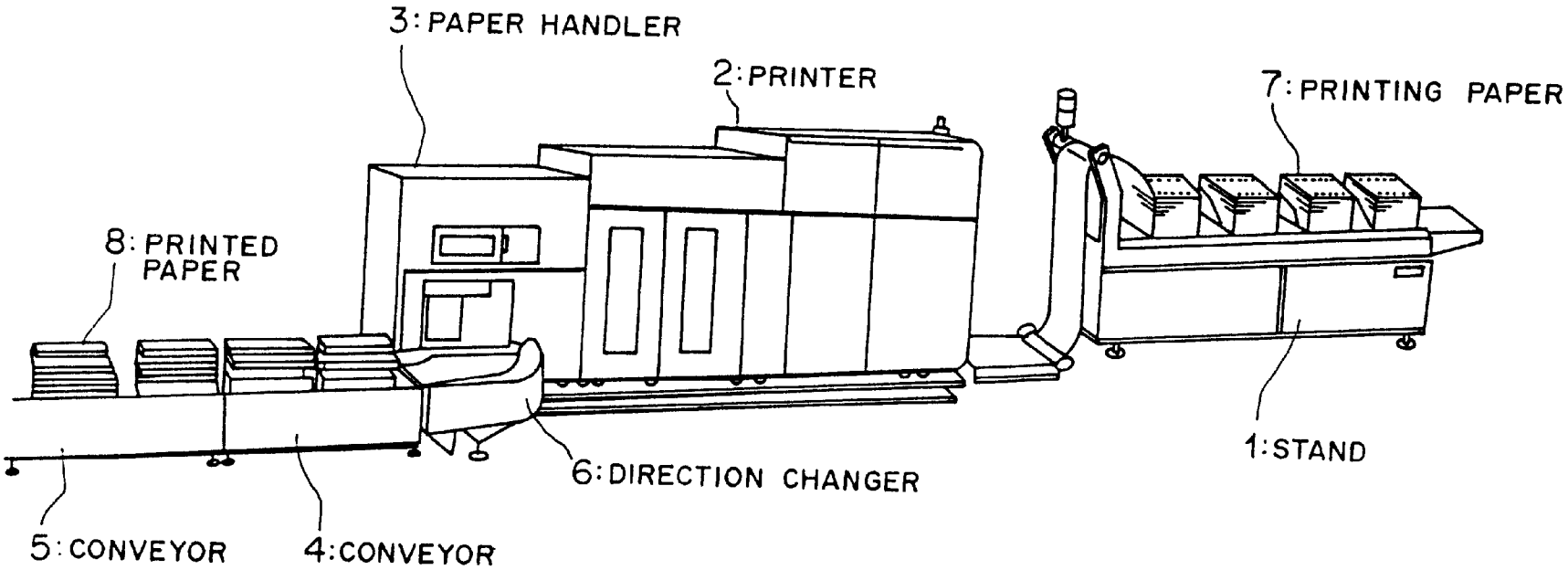
FIG. 1 is a perspective view showing a schematic structure of a printing apparatus having a paper handling function according to a first embodiment of the present invention.

Embodiments of the present invention will now be described with reference to the drawing figures.

(a) First Embodiment

A paper handling apparatus and a printing apparatus having a paper handling function according to a first embodiment of the present invention will now be described with reference to FIGS. 1 to 13. In FIGS. 1 to 13, the same structural features are denoted by common reference numerals.

(a1) Printing Apparatus

FIG. 1 is a perspective view schematically showing the structure of a printing apparatus having a paper handling function according to the first embodiment of the present invention. As shown in FIG. 1, the printing apparatus, according to the present embodiment, is composed of a stand 1 for carrying printing paper 7 to be printed, a printer (printing section) 2 for printing on the printing paper 7 which is fed from the stand 1, and a paper handler paper handling section) 3 for stacking printed paper 8 which has undergone printing for each job print process unit) in the printer 2.

The stand 1 carries the blank printing paper 7 in marketed boxes (about 1500 sheets per box; in the present embodiment, a box of the printing paper 7 is taken as one loading unit). The printing paper 7 is continuous paper which is folded along perforations. A portion of the paper 7 (8) held between two lines of perforations is hereinafter counted/handled as one sheet (one page). When plural boxes of the printing paper 7 are carried on the stand 1, the tail end of the printing paper 7 in a box is connected to the leading end of the printing paper 7 in the subsequent box using adhesive tape or similar, whereby a large quantity of the printing paper 7 can be printed continuously.

The printing paper 7 is fed from the stand 1 to the printer 2. A host computer (host apparatus denoted by reference numeral 100 in FIG. 10) is connected to the printer 2 through a network. The host computer sends both an instruction to being printing and print data to the printer 2. The printer 2 prints the print data received from the host computer on the printing paper 7 in response to an instruction to being printing from the host computer. After printing, the printing paper 7 is fed as the printed paper 8 from the printer 2 to the paper handler 3. Various types of printers, such as impact printers, electrophotographic printers, and similar, can be used as the printer 2.

The printed paper 8 which has undergone printing in the printer 2 is continuously stacked on a table 33 (not shown in FIG. 1; see FIGS. 3 to 9) in the paper handler 3. The printed paper 8 for a plurality of jobs is continuously stacked on the table 33.

When a stacked quantity of the printed paper 8 on the table 33 reaches a predetermined quantity (for example, a quantity of one loading unit described above), the printed paper 8 stacked on the table 33 is unloaded from the paper handler 3 by an unloading mechanism, which is composed of a direction changer 6 and conveyors 4, 5. The unloaded blocks of the printed paper 8 are arranged on the conveyors 4, 5, waiting for a print requester to come and take them out.

An offset mechanism 70 (not shown in FIG. 1, but to be described later with reference to FIGS. 7 to 9) is also used as an unloading mechanism. The offset mechanism 70 is adapted to unload the printed paper 8 stacked on the table 33 from the side of the paper handler 3.

The direction changer 6 changes the direction of transfer of a predetermined quantity of the printed paper 8 which has been unloaded from the side of the paper handler 3 to the direction (i.e., a conveying direction of the conveyors 4, 5) in which the stand 1, the printer 2, and the paper handler 3 are arranged.

The conveyor 4 conveys blocks of the printed paper 8 in the aforesaid direction, wherein the blocks of printed paper 8 have been changed in direction on the direction changer 6. The conveyor 5 is located downstream of the conveyor 4 and conveys blocks of the printed paper 8 in the aforesaid direction, wherein the blocks pf printed paper 8 have been transferred thereto when the conveyor 4 becomes full of the printed paper 8.

The conveyors 4, 5 and the direction changer 6 are adapted to be detached/attached according to conditions of installation of the apparatus (layout, available area for installation and similar), whereby diversified needs of users can be coped with.

(a2) Printing Process Section

Figure 2:
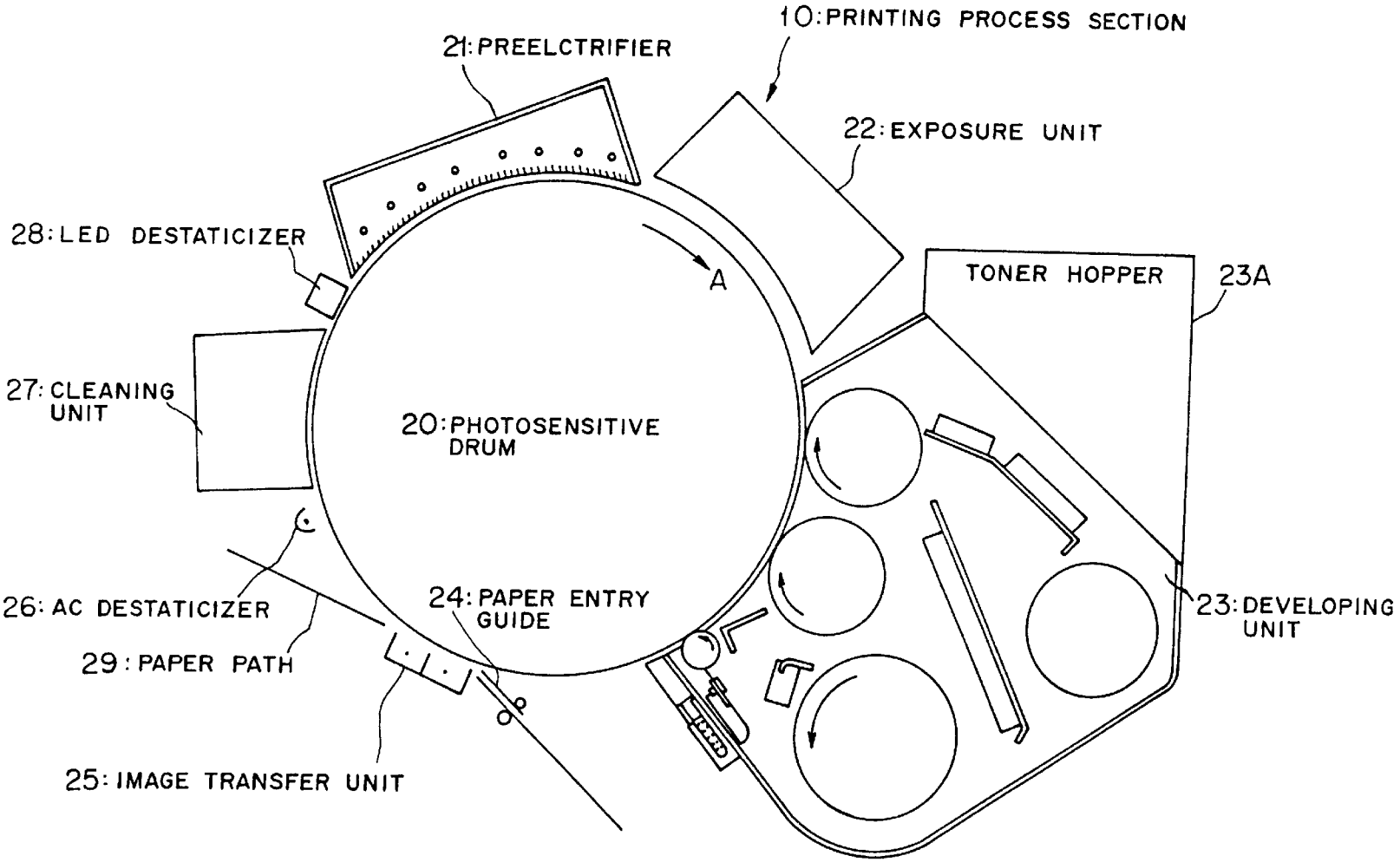
FIG. 2 is a schematic longitudinal cross-sectional view showing a printing processor of a printer according to the first embodiment.

FIG. 2 is a schematic longitudinal cross-sectional view showing a printing process section 10 of the printer 2 according to the present embodiment. As shown in FIG. 2, the printing process section 10 is composed of a photosensitive drum 20, a pre-electrifier 21 located along the periphery of the photosensitive drum 20, an exposure unit (an optical unit in the present embodiment) 22, a developing unit 23, a paper entry guide 24, an image transfer unit (an image transfer electrifier) 25, an alternating current or AC de-staticizer 26, a cleaning unit 27, and a light emitting diode or LED de-staticizer 28.

For printing, the photosensitive drum 20 is rotated in the direction of arrow A in FIG. 2 so as to uniformly electrify the surface thereof with the pre-electrifier 21. Next, an electrostatic latent image of patterns corresponding to print data are formed on the surface of the photosensitive drum 20 by exposure at the exposure unit 22. The developing unit 23 supplies toner onto the photosensitive drum 20, and consequently a visible toner image is developed from the electrostatic latent image.

On the other hand, the printing paper 7, which is fed from the stand 1, is fed along a paper path 29 and led to the position of the image transfer unit 25 (position of image transfer) as guided by the paper entry guide 24. In the position of image transfer, the photosensitive drum 20 and the image transfer unit 25 are opposed to each other with the printing paper 7 held therebetween, and toner, on the photosensitive drum 20, is transferred to the printing paper 7. Then, the printing paper 7 is further fed along the paper path 29, and toner, on the printing paper 7, is fixed at the fixing unit (not shown) by heat, pressure, light or similar.

After the image transfer process is completed, some toner, which is not transferred to the printing paper 7, remains on the surface of the photosensitive drum 20. The residual toner should be removed from the photosensitive drum 20. After the AC de-staticizer 26 removes static charges from the residual toner, the cleaning unit 27 mechanically removes the residual toner from the surface of the photosensitive drum 20. A cleaning blade, cleaning brush, or similar, is used as the mechanical removing means.

After the residual toner is removed from the photosensitive drum 20, the LED de-staticizer 28 removes static charges from the surface of the photosensitive drum 20 so as to bring an electric potential of the surface of the photosensitive drum 20 back to an initial state (0 V, for example).

Then, the surface of the photosensitive drum 20 is again electrified uniformly by the pre-electrifier 21 to proceed to the next printing process.

As has been described above, the printing paper 7 is printed at the printing process section 10, and the printed paper 8 is led along the paper path 29 from the printer 2 to the paper handler 3 at the next stage. In FIG. 2, reference numeral 23A denotes a toner hopper of the developing unit 23.

(a3) Paper Handler

Figure 3:
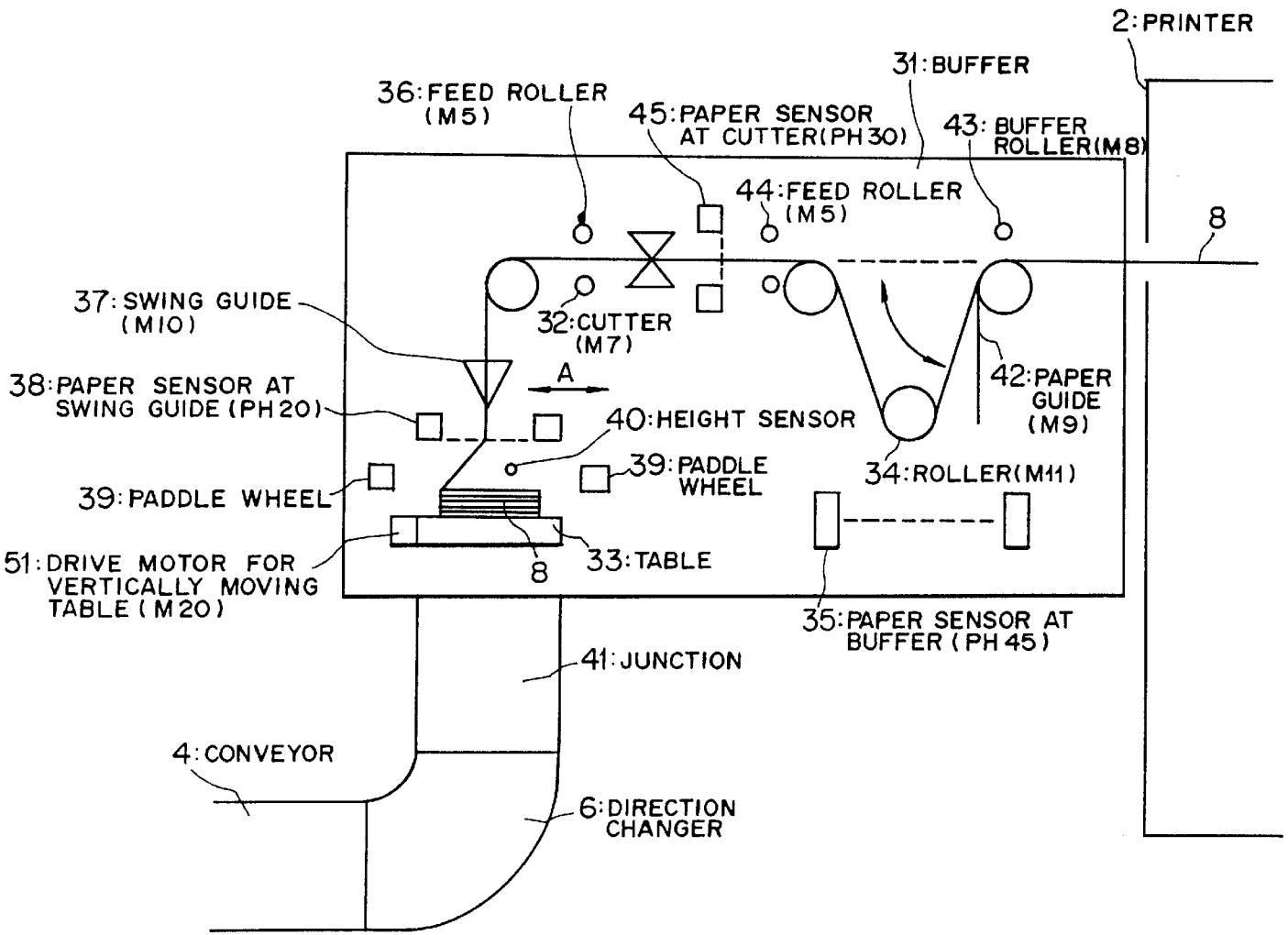
FIG. 3 is a schematic view showing a paper handler according to the first embodiment.

FIG. 3 is a schematic view showing the paper handler 3 according to the first embodiment. As shown in FIG. 3, the paper handler 3 in the present embodiment has a buffer 31, a cutter (cutting mechanism) 32, and a table 33 as a stacker.

The buffer 31 absorbs changes in a path length due to paper size. That is, in the printing apparatus according to the present embodiment, the length of the printed paper 8 is adjusted in the buffer 31 so that when perforations in the printed paper 8 come to the cutting position of the cutter 32, perforations in the printing paper 7 also come to the image transfer position of the image transfer unit 25 in the printer 2. Accordingly, during normal printing, pages continuously exist, with the number of the pages being an integer, for example, seven pages, of the printed paper 8 between the cutting position and the image transfer position.

For handling continuous paper in pages, the cutter 32 should cut the continuous printed paper 8 at or along perforations therein. Hence, perforations are brought to the cutting position of the cutter 32.

Furthermore, in a printing apparatus which handles continuous paper, in order to prevent print data for one page from being printed over a plurality of pages, the position of perforations is detected so as to start printing at a predetermined distance off the detected position of perforations. Thus, a system is adapted so that perforations in the printing paper 7 are halted at the image transfer position of the image transfer unit 25. The photosensitive drum 20 rotates and undergoes development as described earlier, and then the printing paper 7 is fed so that a starting portion of print data for one page aligns with a printing start position on the printing paper 7. Then, the transfer unit 25 transfers an image onto the printing paper 7. Accordingly, continuous paper (printing paper 7 and printed paper 8) halts when perforations in the printing paper 7 come to the image transfer position of the image transfer unit 25.

In the printing apparatus described above, because of a fixed distance between the image transfer unit 25 and the cutter 32, no problem arises if the distance is equivalent to a number n times the length of each page, wherein n is an integer. However, if the distance is not equivalent to a number n times the length of each page, wherein n is an integer, perforations do not concurrently come to the cutting position and the image transfer position.

In the printing apparatus, therefore, in order to handle paper of a plurality of sizes, wherein the length between a certain perforation and the next perforation is predetermined (i.e., in order that perforations concurrently come to the cutting position and the image transfer position), the paper handler 3, according to the present embodiment, is adapted to allow the continuous paper, in the buffer 31 extending between the cutter 32 and the image transfer unit 25, to slacken. However, slackening of the continuous paper is not enough because of a potential paper jam. Continuous paper should always be kept tense (i.e., a certain tension should be applied to continuous paper). To attain this, the buffer 31 is provided with a roller 34. In the buffer 31, a paper guide 42 leads continuous paper (printed paper 8) from a buffer roller 43 to the roller 34.

The roller 34 is rotatably supported at both ends with a link (not shown), and the link, together with a driving axle (not shown), is supported in a swingable manner. The driving axle is rotated by a pulse motor (not shown) to swing the link. Thus, the roller 34 is positioned so as to allow the continuous paper to slacken according to paper size in use.

Also, the buffer 31 is provided with a paper sensor 35 for detecting dangling paper due to an accidental cut along perforations, whereby any trouble with respect to paper feeding is coped with.

In FIG. 3, the buffer roller 43 is adapted to feed the printed paper 8, which is ejected from the printer 2, into the buffer 31 and a feed roller 44 is adapted to feed the printed paper 8 from the buffer 31 to the cutter 32.

The printed paper 8, which has passed the cutter 32, is fed by the feed roller 36 to the table 33, where the printed paper 8 is folded along perforations and stacked page by page.

For neatly folding the printed paper 8 along perforations and stacking, the present embodiment is provided with a swing guide 37, a paper sensor 38 at the swing guide, and paddle wheels 39.

The swing guide 37 is an ordinary one as described in Japanese Patent Application Laid-open No. 57-98462. That is, the swing guide 37 is swung page by page in the direction of arrow A in FIG. 3, whereby the printed paper 8 is folded along perforations which are detected by the paper sensor 38 at the swing guide.

Also, the paddle wheel 39 is an ordinary one as described in Japanese Patent Application Laid-open No. 52-20125. Particularly, as disclosed in FIG. 2(*c*) of the patent publication, to prevent the folded and stacked printed paper 8 from swelling at both ends, the paddle wheels 39 are provided on both sides of the table 33. The paddle wheels 39 are adapted to hit the folded printed paper 8 from above as they rotate. By preventing the folded printed paper 8 from swelling at both ends with the paddle wheels 39, as many pages of the printed paper 8 as possible are neatly stacked on the table 33.

Furthermore, the table 33, used as a stacker, is driven by a drive motor 51 so as to move vertically.

For detecting a quantity of the printed paper 8 stacked on the table 33, the paper handler 3 is provided with a height sensor 40 for detecting a top edge of the printed paper 8 stacked on the table 33, i.e., the height of the printed paper 8 stacked on the table 33 together with sensors (described later with reference to FIG. 4) for detecting a position of the table 33. When the top edge of the stacked printed paper 8 is detected by the height sensor 40, a stacked quantity of the printed paper 8 on the table 33 is detected on the basis of a position of the table 33 which is detected by a group of sensors (SWA4, SWA11, SWA13, and SWA14), described later with reference to FIG. 4. The group of sensors and the height sensor 40 compose stacked quantity detecting means of the present embodiment.

The height sensor 40 is composed of a light emitting element and a light receiving element, which are opposed with the printed paper 8 being stacked therebetween and apart by a distance somewhat longer than the width of the printed paper 8. When light which is emitted from the light emitting element and received by the light receiving element is interrupted, the height sensor 40 interprets the situation as the presence of the top edge of the stacked printed paper 8. To prevent an erroneous detection due to the printed paper 8, which is being folded, interrupting light which is emitted from the light emitting element to the light receiving element, the light emitting element and the light receiving element are opposed to each other in the direction of the width of the printed paper 8, i.e., perpendicular to the direction of feeding the printed paper 8. The light emitting and receiving elements are fixed on a frame such as the housing (reference numeral 50 in FIG. 5) of the paper handler 3.

Also, when the printed paper 8 instantaneously interrupts a path of light of the height sensor 40 due to a certain disturbance of stacking, the height sensor 40 will make an erroneous detection, causing the problem that an actually stacked quantity of the printed paper 8 on the table 33 is smaller than a stacked quantity (pages) which has been detected. To prevent the problem, the height sensor 40 is adapted to determine the detection of the top edge of the stacked printed paper 8 only when the path of light is interrupted for a predetermined time or longer and then make a detection signal effective.

The aforesaid detecting function may be implemented by using a timer which starts measuring time in response to a signal which the height sensor 40 outputs on detection of the printed paper 8, and means for making the detection signal, which has been outputted from the height sensor 40, effective, when time measured by the timer exceeds a predetermined time. In this case, when the height sensor 40 stops outputting the detection signal, the timer is reset or initialized.

In FIG. 3, reference numeral 41 denotes a junction which is part of the aforesaid unloading mechanism. The junction 41 relays the printed paper 8, which is ejected from the table 33, to the direction changer 6 and assumes the form of a belt conveyor, for example, as will be described later with reference to FIG. 13. Reference numeral 45 denotes a paper sensor for detecting the printed paper 8 which enters the cutter 32.

(a4) Table Position Sensors

Figure 4:
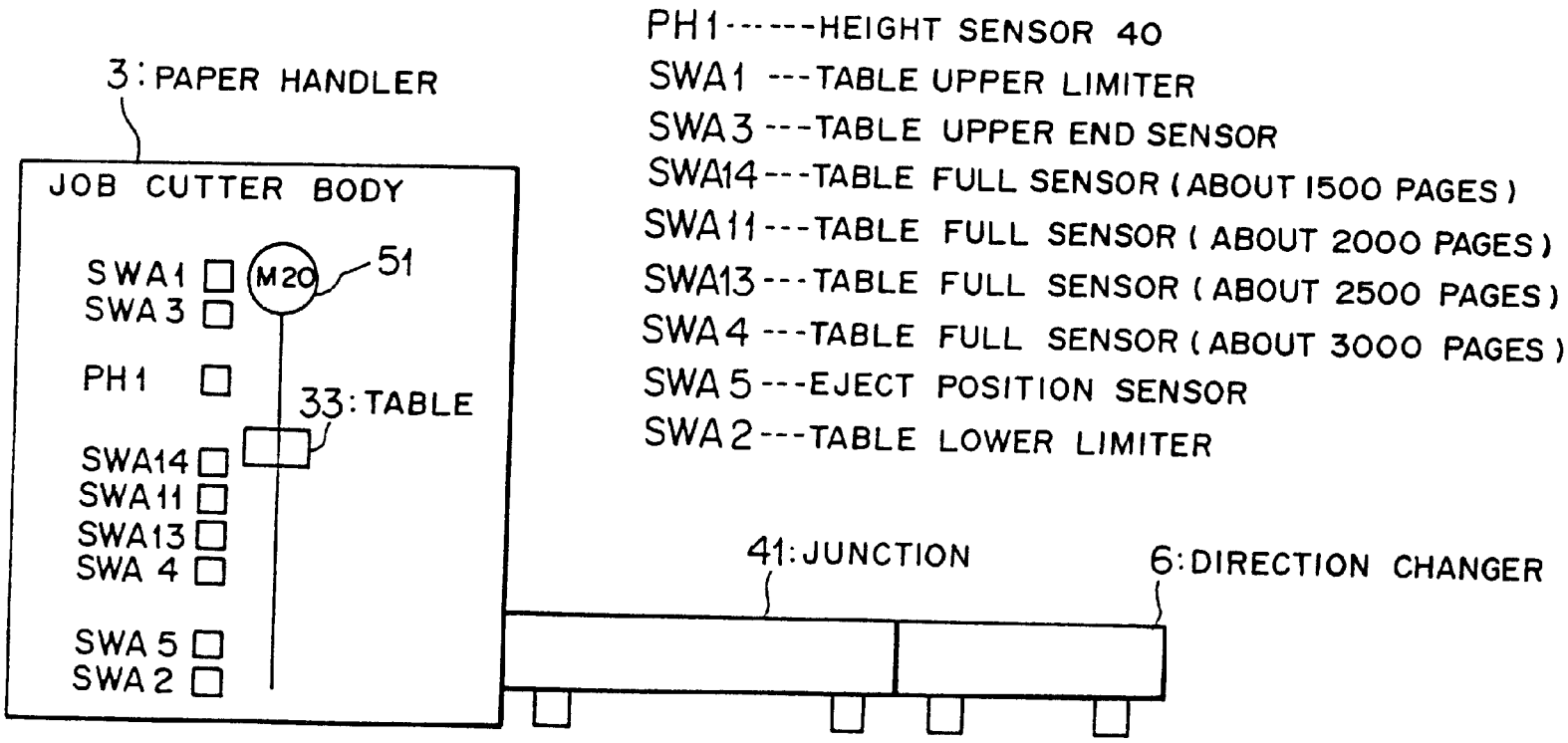
FIG. 4 is a schematic view showing the arrangement of sensors for detecting a position of a table according to the first embodiment.

FIG. 4 is a schematic view showing the arrangement of sensors for detecting a position of the table 33. As shown in FIG. 4, a vertical position of the table 33 is detected by the following plurality of sensors: table upper limiter SWA1, table upper end sensor SWA3, table full sensors SWA14, SWA11, SWA13, and SWA4, eject position sensor SWA5, and table lower limiter SWA2.

The table upper limiter SWA1 and the table lower limiter SWA2 detect that the table 33 has reached an upper limit position and lower limit position thereof, respectively.

The table upper end sensor SWA3 detects that the table 33 has reached a top position thereof, i.e., the position where the empty table 33 is to be located for starting to stack the printed paper 8 thereon.

In the paper handler 3 according to the present embodiment, in order to neatly stack the printed paper 8 on the table 33, while maintaining a fixed relative position among a stack of the printed paper 8, the swing guide 37, and the paddle wheel 39, the table 33 is lowered by the drive motor 51 (M20) to the position where the top edge of the printed paper 8 stacked thereon does not interrupt the height sensor 40 (PH1) each time a predetermined quantity of the printed paper 8 is stacked thereon.

In order to detect that a stacked quantity of the printed paper 8 on the table 33 has reached 3000 pages, 2500 pages, 2000 pages, and 1500 pages, the table full sensors SWA4, SWA13, SWA11, and SWA14 are provided which detect that the table 33 has reached corresponding positions. That is, when the printed paper 8 stacked on the table 33 interrupts the height sensor 40 and when, for example, the table full sensor SWA13 detects the table 33, a stacked quantity of the printed paper 8 on the table 33 is detected as 2500 pages.

By selecting any one of the table full sensors SWA4, SWA13, SWA11, and SWA14, it is possible to meet users' diversified needs, for example, a need for stacking the printed paper 8 on the table 33 in a suitable quantity for transport and a need for stacking the printed paper 8 for as many jobs as possible.

The eject position sensor SWA5 detects an eject position, i.e., the table 33 having reached a position for ejecting the printed paper 8 from the table 33 to the direction changer 6 via the junction 41.

Optical sensors or micro-switches may be used as the above-mentioned sensors (including limiters) SWA1 to SWA5, SWA11, SWA13, and SWA14.

When optical sensors are used, each sensor is composed of a light emitting element and a light receiving element, which are opposed to each other and mounted on the body (i.e., frame such as housing 50 (see FIG. 5)) of the paper handler 3. An interrupting member (not shown), mounted on the table 33 side, interrupts light which is emitted from the light emitting element to the light receiving element, whereby a position of the table 33 is detected.

When micro-switches are used, each microswitch is mounted on the body (i.e., frame such as housing 50 (see FIG. 5)) of the paper handler 3 at a proper height, and a detecting member 57 (see FIG. 5) is mounted on the table 33 side, as will be described later with reference to FIG. 5. As the table 33 moves vertically, the detecting member 57 actuates each microswitch, whereby a position of the table 33 is detected. Using micro-switches is lower in cost for the apparatus than is using optical sensors.

(a5) Mechanisms Associated with Table of Paper Handler

Mechanisms associated with the table 33 of the paper handler 3 will now be described in detail with reference to FIGS. 5 to 9. In the present embodiment, mechanisms associated with the table 33 are a mechanism for vertically moving the table 33 and the offset mechanism 70 for stacking the printed paper 8 on the table 33 such that a stack for one job is shifted from a stack for another job. The offset mechanism 70 shifts the position of stacking the printed paper 8 for a new job from the stacking position for the last job. In the present embodiment, the offset mechanism 70 also serves as part of the unloading mechanism for unloading the printed paper 8 stacked on the table 33 from the paper handler 3 to the outside.

Figure 5:
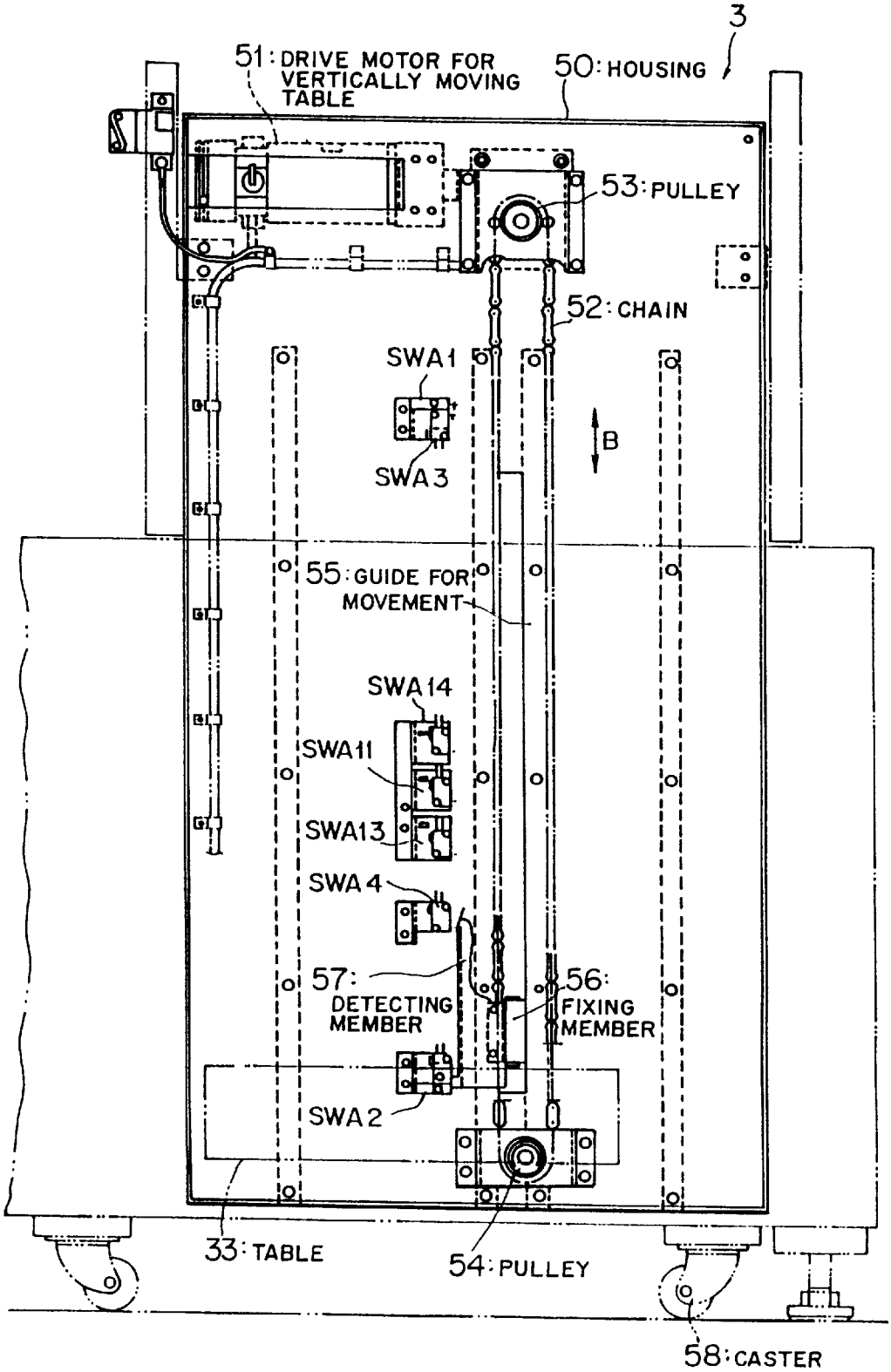
FIG. 5 is a view showing a mechanism for vertically moving the table in the paper handler according to the first embodiment as viewed from the side of the paper handler.

FIG. 5 is a view showing the mechanism for vertically moving the table 33 in the paper handler 3, according to the first embodiment, as viewed from the side of the paper handler 3. As shown in FIG. 5, the paper handler 3 is provided with casters 58 at the bottom thereof so as to be mobile. The paper handler 3 is detachable from the printer 2. Thus, the paper handler 3 is detached from the printer 2 and moved on the casters 58 away from the printer 2, whereby maintenance or similar can be performed more efficiently.

A guide 55, for movement, is mounted on the housing 50 of the paper handler 3 for guiding the table 33 in the vertical direction. The table 33 can move along the guide 55 in the direction of arrow B (in the vertical direction) in FIG. 5. Support rollers 62, for vertical movement on the table 33 side, are fitted to the guide 55, as will be described later with reference to FIG. 6, thereby allowing the table 33 to vertically move along the guide 55.

Pulleys 53 and 54 are located at the upper and lower positions, respectively, of the guide 55. The pulleys 53, 54 are rotatably mounted on the housing 50. A chain 52 is fitted to the pulleys 53 and 54, and the upper pulley 53 is rotated by the drive motor 51 for vertically moving the table 33. As the pulley 53 rotates, the chain 52 also rotates on the pulleys 53 and 54.

The table 33 is fixed to the chain 52 via a fixing member 56. Accordingly, by running the motor 51 for vertically moving the table 33, a rotational driving force of the motor 51 is transmitted to the table 33 via the pulley 53 and the chain 52 as a driving force for vertically moving the table 33. As a result, the table 33 vertically moves along the guide 55.

The sensors SWA1 to SWA4, SWA11, SWA13, and SWA14 (SWA5 not shown in FIG. 5), which have been described earlier with reference to FIG. 4, are fixed on the housing 50 with screws or similar along the guide 55 for movement. In the present embodiment, micro-switches are used as the sensors SWA1 to SWA4, SWA11, SWA13, and SWA14. The detecting member 57 is mounted on the table 33 so as to activate the micro-switches. As the table 33 moves vertically, the detecting member 57 activates the sensors SWA1 to SWA4, SWA11, SWA13, and SWA14 at respective positions of installation, whereby a vertical position of the table 33 is detected based on a detection signal from each of the sensors SWA1 to SWA4, SWA11, SWA13, and SWA14.

Figure 6:
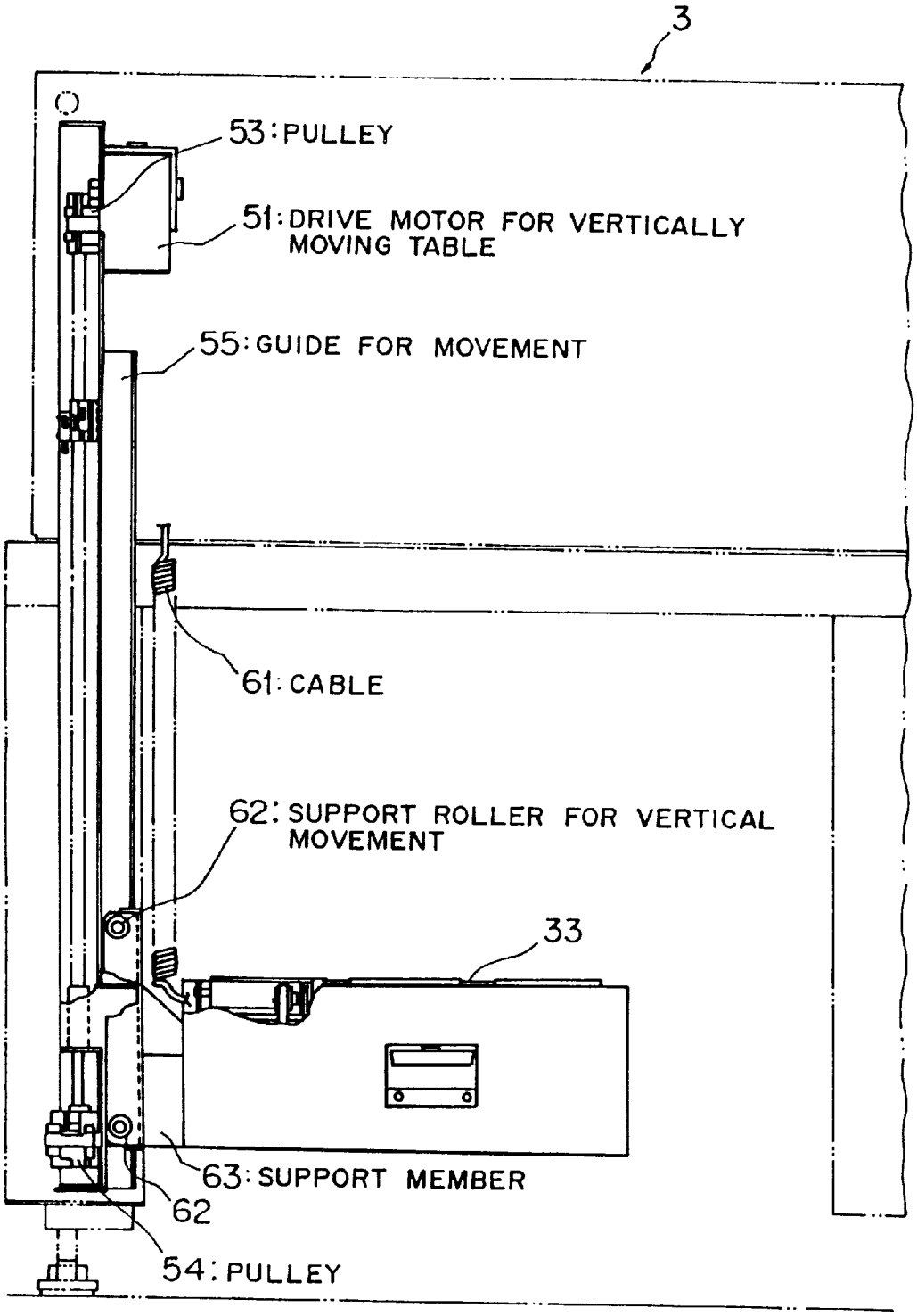
FIG. 6 is a view showing the mechanism for vertically moving the table in the paper handler according to the first embodiment as viewed from the front of the paper handler.

FIG. 6 is a view showing the mechanism for vertically moving the table 33 in the paper handler 3, according to the first embodiment, as viewed from the front of the paper handler 3. As shown in FIG. 6, for maintaining the top face of the table 33, on which the printed paper 8 is stacked, in a level, the table 33 is slidably mounted to the guide 55 for movement via a support member 63. For smoothly moving the support member 63 along the guide 55, the support member 63 is provided with a pair of upper and lower support rollers 62, 62 for vertical movement. The upper and lower support rollers 2 for vertical movement are fit to the guide 55 for movement and supported by the support member 63 so as to freely rotate as the table 33 moves vertically.

The table 33 and the body of the paper handler 3 are connected to each other with a cable 61. The cable 61 is adapted to supply power and control signals to a drive motor 81, which is a drive source for the offset mechanism 70, which will be described later with reference to FIGS. 7 to 9, so as to control the operation thereof. The cable 61 connects the drive motor 81 in the table 33 and a control system/electrical system on the body of the paper handler 3. Furthermore, the cable 61 is flexible so as to cope with a vertical movement of the table 33.

Figure 7:
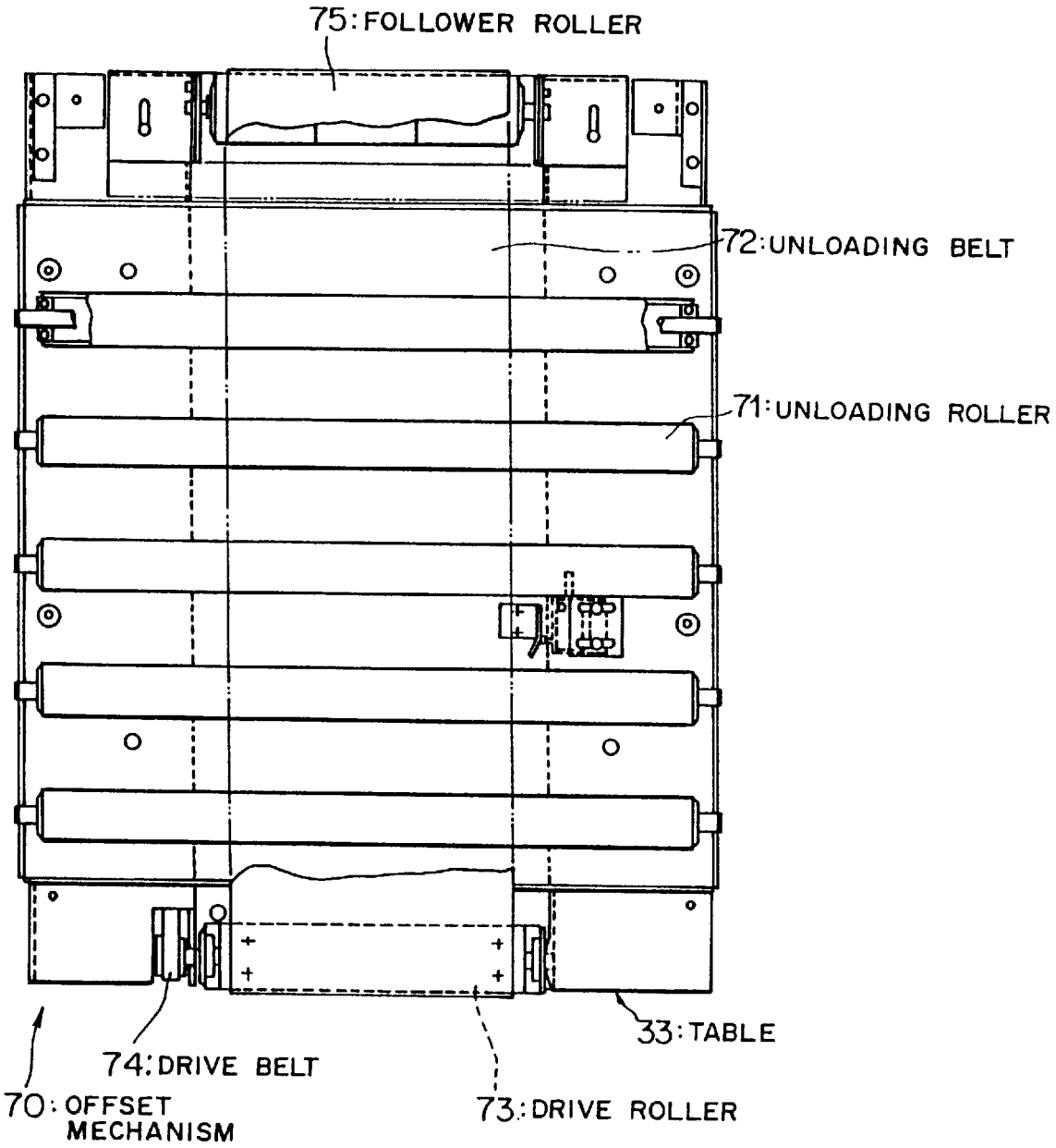
FIG. 7 is a view illustrating the structure of an offset mechanism in the paper handler according to the first embodiment as viewed from the top of the table.

FIG. 7 is a view illustrating the structure of the offset mechanism 70 in the paper handier 3, according to the first embodiment, as viewed from the top of the table 33. As shown in FIG. 7, in the table 33, a plurality of unloading rollers 71 are arranged in such a manner that axles thereof are arranged in parallel in the same horizontal plane.

A drive roller 73 and a follower roller 75 are disposed at both ends of the table 33 with the unloading rollers 71 arranged therebetween. The drive roller 73 and the follower roller 75 are also arranged in such a manner that axles thereof are arranged in parallel with the unloading rollers 71 in the same horizontal plane as that of the unloading rollers 71.

An unloading belt 72 is fitted onto the drive roller 73 and the follower roller 75. The printed paper 8 is stacked on the unloading belt 72 (i.e., the top face of the table 33).

As will be described later with reference to FIGS. 8 and 9, a rotational driving force is transmitted from the drive motor 81 to the drive roller 73 via the drive belt 74, and thus the drive roller 73 is rotated in a proper direction. As the drive roller 73 rotates, the unloading belt 72 also rotates on the rollers 75, 73, 75.

Figure 8:
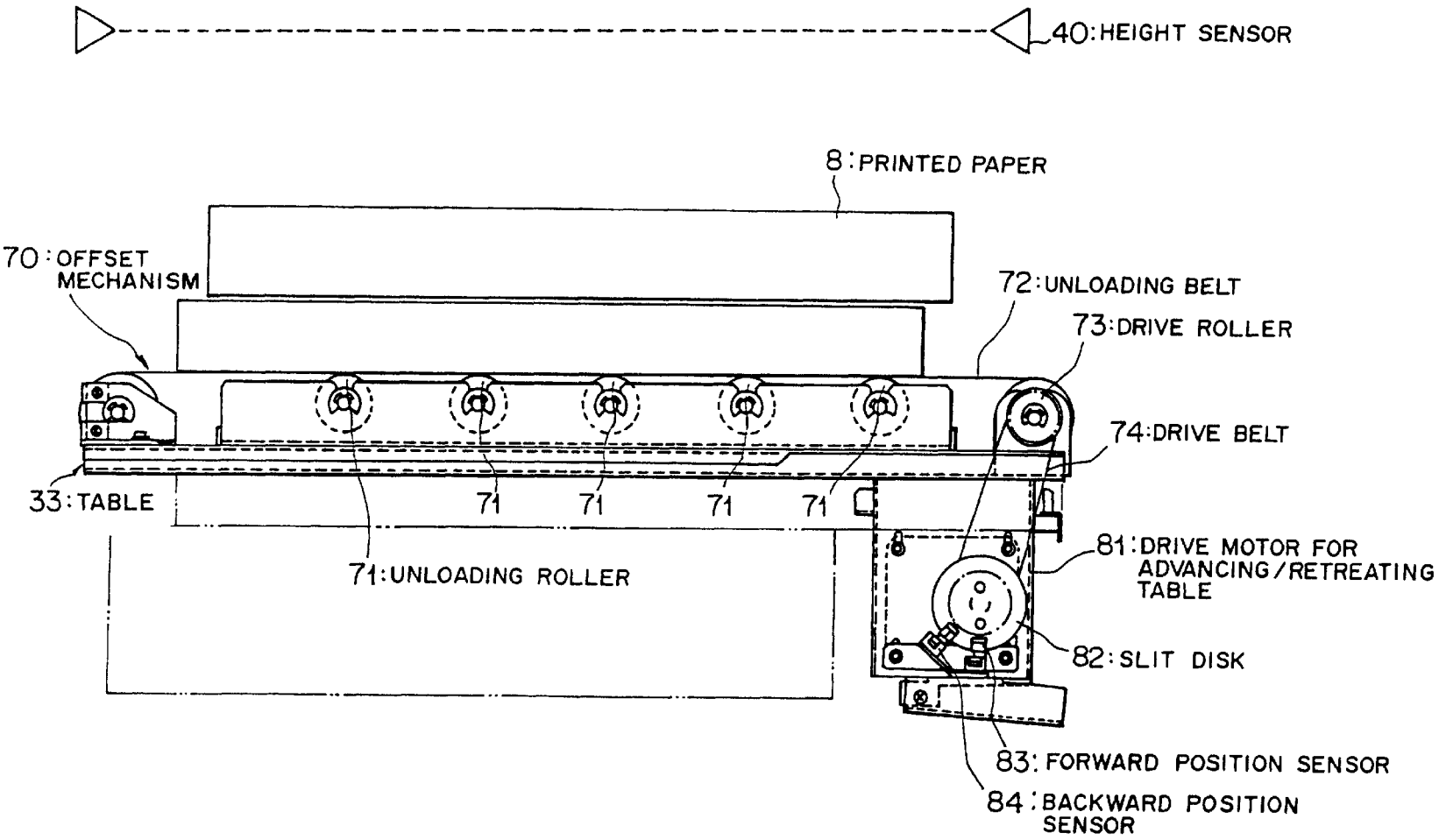
FIG. 8 is a view illustrating the structure of the offset mechanism in the paper handler according to the first embodiment as viewed from the side of the table.

FIG. 8 is a view illustrating the structure of the offset mechanism 70 in the paper handler 3, according to the first embodiment, as viewed from the side of the table 33 (i.e., as viewed in the same direction as in FIG. 5). FIG. 9 is a view illustrating the structure of the offset mechanism 70 in the paper handler 3, according to the first embodiment, as viewed from the front of the table 33 (i.e., as viewed in the same direction as in FIG. 6).

Figure 9:
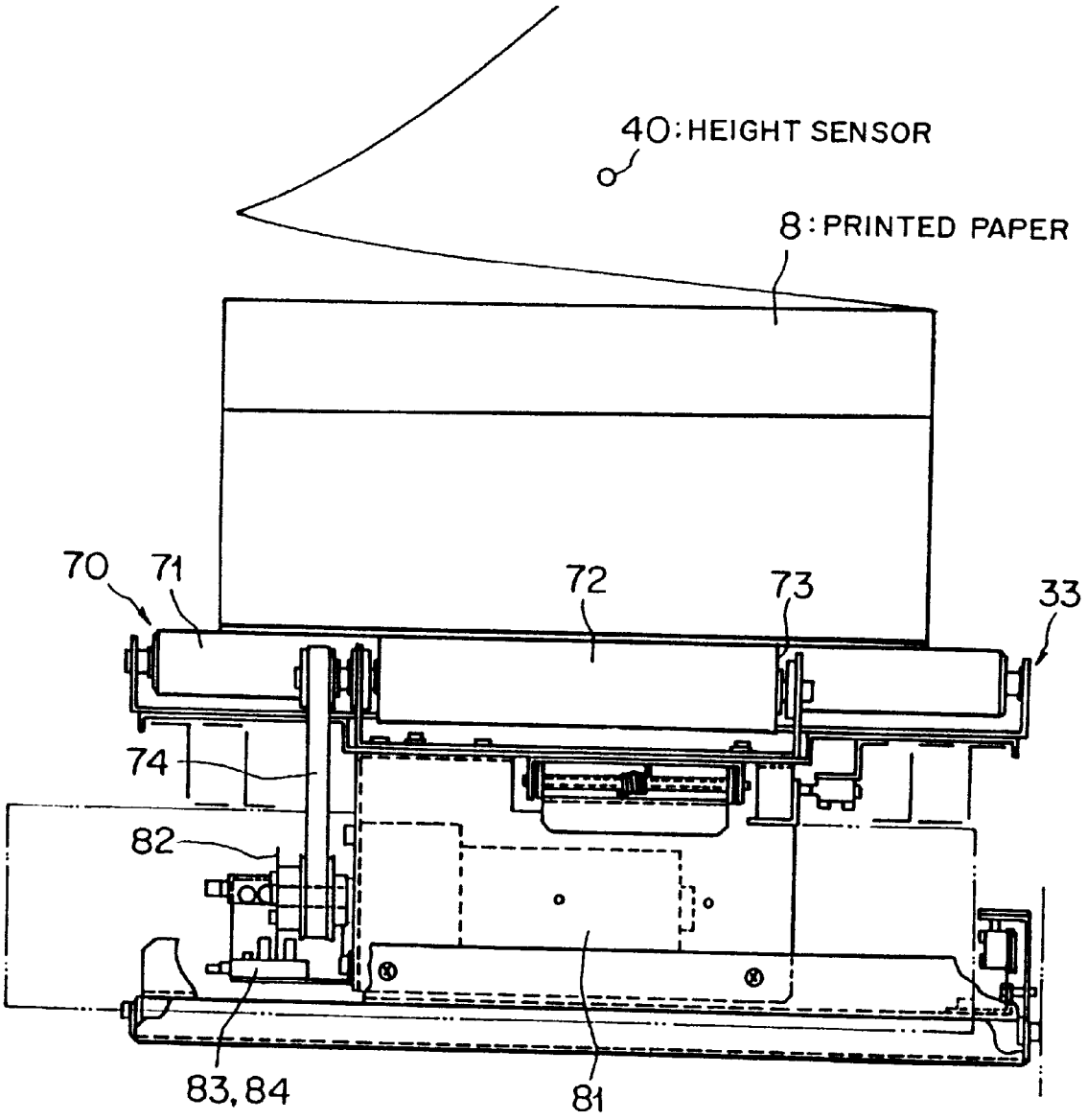
FIG. 9 is a view illustrating the structure of the offset mechanism in the paper handler according to the first embodiment as viewed from the front of the table.

As shown in FIGS. 8 and 9, the drive motor 81 for making the table 33 advance or retreat is provided under the table 33. The drive motor 81 rotates the drive roller 73 via the drive belt 74 and further rotates the unloading belt 72 on the rollers 71, 73, 75. By rotating the unloading belt 72, the position of stacking the printed paper 8 on the unloading belt 72 (on the table 33) is shifted, or the printed paper 8 stacked on the unloading belt 72 (on the table 33) is unloaded from the paper handler 3.

A slit disk 82 is mounted on the revolving shaft of the drive motor 81 for making the table 33 advance or retreat. The slit disk 82 rotates as the motor 81 rotates.

Furthermore, two sensors for detecting a slit in the disk 82, i.e., a forward position sensor 83 and a backward position sensor 84, are provided near the disk 82. The sensors 83, 84 are used for holding an offset (i.e., a quantity of shift) constant when the position of stacking the printed paper 8 is shifted by the offset mechanism 70.

That is, after the drive motor 81 for causing the table 33 to advance or retreat is rotated until the slit in the disk 82 is detected by the forward position sensor 83, the printed paper 2 is stacked on the unloading belt 72 (on the table 33). Then, before starting to stack the printed paper 8 for a next job, the motor 81 is rotated until the slit is detected by the backward position sensor 84. By repeating this back-and-forth movement, the printed paper 8 is stacked while being shifted forward or backward.

Also, by using the above-mentioned disk 82 and the sensors 83, 34 for determining the offset for the stacking position of the printed paper 8, a cheap motor such as an AC motor, not an expensive pulse motor, an be used as the motor 81 for causing the table 33 to advance or retreat so as to implement the offset mechanism 70 according to the present embodiment.

(a6) Control System for the Printing Apparatus and Operation of the Same

Figure 10:
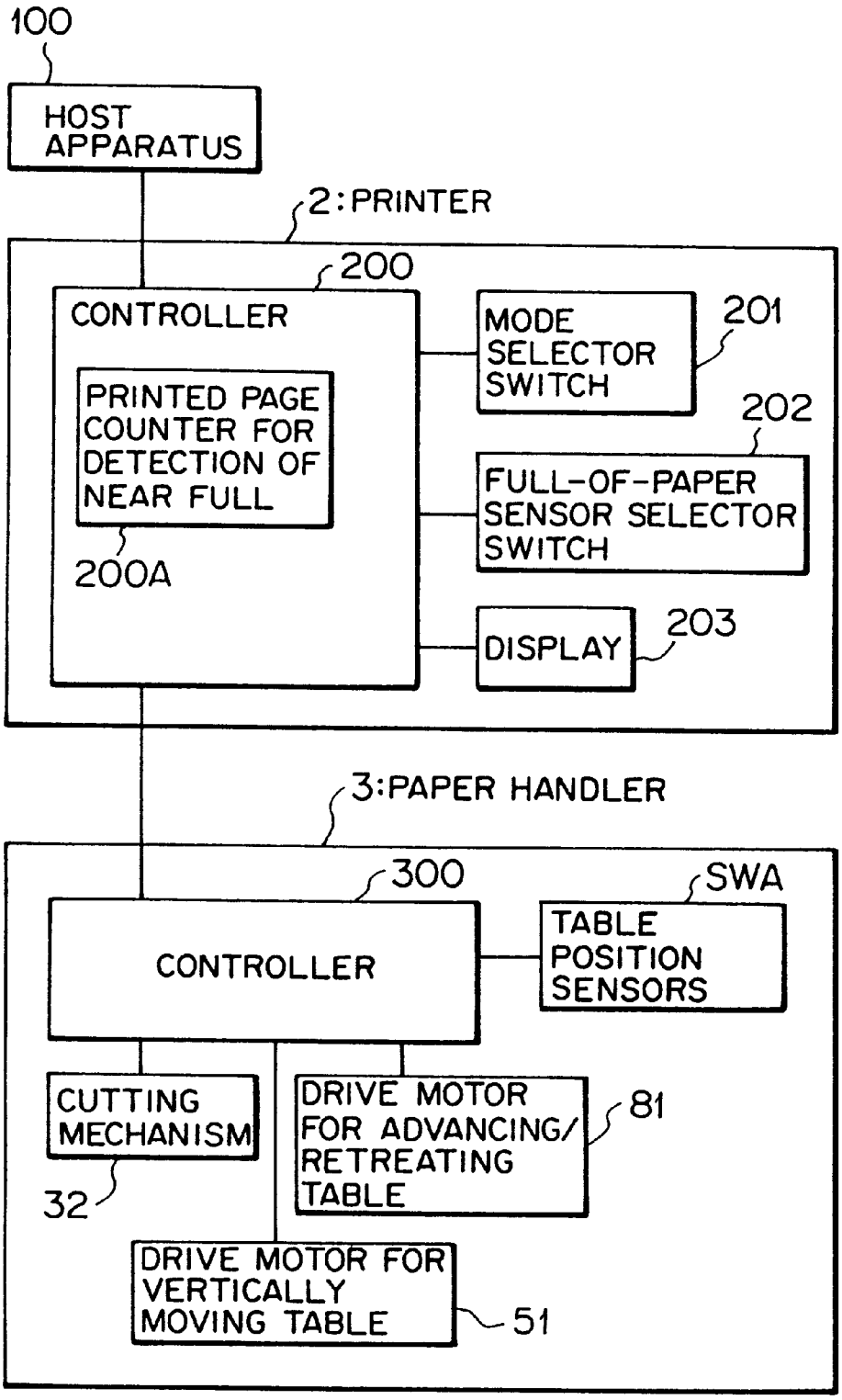
FIG. 10 is a block diagram showing a control system of the printing apparatus having a paper handling function according to the first embodiment.

FIG. 10 is a block diagram showing a control system of the printing apparatus having a paper handling function, according to the first embodiment. As shown in FIG. 10, the printer 2 is connected to the host apparatus 100, such as a host computer, through a network or a dedicated line.

In addition to sending print data to the printer 2, the host apparatus 100 sends information to the printer 2 about the end of the transmission of the print data upon the completion of sending print data for each job.

A controller 200 in the printer 2 controls the printing process section 10 (FIG. 2) so as to print, on the printing paper 7, print data received from the host apparatus 100. Also, the controller 200 in the printer 2 sends an instruction to the paper handler 3 for cutting the printed paper 8 and an instruction to the paper handler 3 for unloading the printed paper 8 stacked on the table 33.

On the other hand, a controller 300 in the paper handler 3 exercises control in response to an instruction, received from the controller 200, to begin cutting so as to cut the printed paper 8 with the cutter 32. Thus cut printed paper 8 is stacked on the table 33.

Also, the controller 300 in the paper handler 3 exercises control in response to an instruction, received from the controller 200, for unloading so as to eject the printed paper 8, stacked on the table 33, from the paper handler 3, with the unloading mechanism (i.e., the drive motor 81 for causing the table 33 to advance or retreat).

Also, the controller 300, in the paper handler 3, has a function as a halting means for halting the stacking of the printed paper 8 on the table 33 when a stacked quantity of the printed paper 8, which is detected by the aforesaid sensors (stacked quantity detecting means), reaches a predetermined quantity. Causing stacking to halt, the controller 300 exercises control so as to cut the printed paper 8 with the cutter 32 and then exercises control so as to eject the printed paper 8, on the table 33, from the paper handler 3, with the unloading mechanism.

Furthermore, as will be described later, in a job cut mode, the controller 300 in the paper handler 3 exercises control so that the offset mechanism 70 (i.e., a revolving operation of the motor 81 for causing the table 33 to advance or retreat) change the position where the printed paper 8 is stacked for each job.

Further, the controller 300, in the paper handler 3, has a function of notifying the printer 2 of the state of the printed paper 8 stacked on the table 33 (that is, the result of detection by the height sensor 40 and the result of detection (a position of the table 33) by each of the table position sensors SWA) (for this communication, the printer 2 and the paper handler 3 are connected with connectors, cables, and similar). The controller 300 also has a function of adjusting the height of the table 33 by controlling the operation of the drive motor 51 for vertically moving the table 33.

The printer 2 is provided with a mode selector switch 201 for selecting a mode of cutting the printed paper 8, such as a job cut mode or a connection cut mode, and for instructing the controller 200 and the paper handler 3 to operate accordingly. When a user (or administrator) of the printer 2 operates the selector switch 201, the controller 200 instructs the paper handler 3 to cut the printed paper 8 in a selected cut mode.

In the job cut mode, the printed paper 8 is cut along the boundary between jobs each time printing for a job is completed. On completion of printing for each job, the controller 200 in the printer 2 instructs the paper handler 3 to cut the printed paper 8.

When the job cut mode is selected, in response to an instruction to begin cutting received from the printer 2, the controller 300 in the paper handler 3 controls the cutter 32 to cut the printed paper 8 along perforations corresponding to the boundary between jobs. Also, the controller 300 exercises control so as to shift the position of stacking the printed paper 8 for a new job from the stacking position for the last job on the table 33 by rotating the unloading belt 72 of the offset mechanism 70.

In the connection cut mode, on detecting the connection between loading units (this connection is made on the stand 1 by connecting the printing paper 7 of one loading unit and the printing paper 7 of the subsequent loading unit using adhesive tape or similar), the printed paper 8 is cut along the connection. When the connection between loading units of the printed paper 8 is detected (a detecting method will be described later), the controller 200 in the printer 2 instructs the paper handler 3 to cut the printed paper 8 along the connection.

When the connection cut mode is selected, in response to an instruction to begin cutting received from the printer 2, the controller 300 in the paper handler 3 controls the cutter 32 to cut the printed paper 8 along the connection between loading units. Also, the controller 300 exercises control so as to unload the printed paper 8 of a loading unit from the table 33 to the junction 41, the direction changer 6, and then the conveyor 4 by rotating the unloading belt 72 of the offset mechanism 70.

Thus, in the connection cut mode, a cutting operation is performed on the printed paper 8 such that a stacked quantity of the printed paper 8 on the table 33 in the paper handler 3 becomes substantially identical to a loading unit (in the present embodiment, in a marketed box, about 1500 pages) on the stand 1. Accordingly, a quantity of the printed paper 8, which is unloaded from the table 33, is suitable for transport, thereby facilitating the transport of the printed paper 8. If the connection cut mode is selected when pages of the printed paper 8 for one job are expected to exceed maximum stackable pages (3000 pages in the present embodiment) for the table 33, the printed paper 8 will be unloaded in suitable blocks for transport.

The printer 2 is also provided with a full-of-paper sensor selector switch 202 for specifying which sensor is to be made effective among the full-of-paper sensors SWA4, SWA11, SWA13, and SWA13 (these sensors function as stacked quantity detecting means), i.e., for specifying a quantity of the printed paper 8 to be stacked on the table 33.

When a user (or administrator) of the printer 2 operates the full-of-paper sensor selector switch 202, the controller 200 notifies the paper handler 3 which sensor is selected.

When a sensor selected by the full-of-paper sensor selector switch 202 detects the table 33 (that is, when the amount of the printed paper 8 stacked on the table 33 reaches a predetermined amount set by the switch 202), the controller 300 in the paper handler 3 exercises control so as to cut the printed paper 8 with the cutter 32. Then, when thus cut printed paper 8 is all stacked on the table 33, the controller 300 exercises control so as to halt the stacking operation and eject the printed paper 8 stacked on the table 33 from the paper handler 3 with the unloading mechanism (i.e., drive motor OR for causing the table 33 to advance or retreat).

When the printing apparatus, according to the present embodiment, is installed in such a work environment that a print requester promptly comes and receives the printed paper 8 which is unloaded from the paper handler 3, a user selects a smaller quantity to be stacked on the table 33 with the full-of-paper sensor selector switch 202. Otherwise, the printed paper 8 for a job, which is located in a lower portion of a stack on the table 33, is difficult to take out. In this case, if a stacking quantity is set, for example, to 1500 pages or 2000 pages, the table full sensor SWA14 or SWA11 will be made effective.

When the printing apparatus, according to the present embodiment, is installed in such a work environment that a wide space is required for stocking the printed paper 8 (for example, the printed paper 8, which has been unloaded from the paper handler 3, tends to be left not received for a long period of time, or a large quantity of the printed paper 8 is ejected because of a frequent use of the printing apparatus), a user selects a larger quantity to be stacked on the table 33, thereby effectively using the conveyors 4 and 5, which serve as a space for stocking the printed paper 8. In this case, if a stacking quantity is set, for example, to 2500 pages or 3000 pages, the table full sensor SWA13 or SWA4 will be made effective.

Work environments for determining the setting of the full-of-paper sensor selector switch 202, i.e., a stacking quantity of the printed paper 8, are not to be limited to those described above, but a user or administrator of the printing apparatus may determine on his/her own judgment.

The printer 2 is provided with a liquid crystal display or LCD 203. The controller 200 controls display on the LCD 203. The LCD 203 displays various kinds of information such as information about trouble like a paper jam, information about replenishment of toner, maintenance information such as the necessity of drum replacement, and information about the selecting of the mode selector switch 201 and the table full sensor selector switch 202, thereby notifying a user or administrator with the information.

Furthermore, information set by the mode selector switch 201 and the table full sensor selector switch 202 is stored in a non-volatile memory such as an EEPROM, hard disk, or similar. The non-volatile memory does not lose the information when power is removed from the printing apparatus, whereby a user is freed from making the same selection about a cut mode and a stacking quantity each time the printing apparatus is powered.

The controller 200 of the printer 2 is provided with a printed page counter 200A (i.e., near full detecting means) for detection of a nearly full state. The counter 200A counts pages which have been printed in the printer 2 since the stacking of the printed paper 8 has been resumed, after a stack of the printed paper 8 on the table 33 was ejected.

The controller 200 has a near full detecting function as described below. The controller 200 compares a count value of the counter 200A with the number of pages corresponding to a full-of-paper state of the stacking section, which is selected with the full-of-paper sensor selector switch 202. When the difference between the count value and the selected number of pages falls within a predetermined range (i.e., pages of the printed paper 8 which are stackable on the table 33 before the table 33 becomes full of the printed paper 8), the controller 200 judges that the table 33 has entered a nearly full state.

Also, the controller 200 has a function of instructing the printer 2 to continue printing, if printing for a job is not completed, when a nearly full state is detected by the aforesaid near full detecting function, and instructing the paper handler 3 to unload a stack of the printed paper 8, with the unloading mechanism thereof, if printing for a job is completed, when a nearly full state is detected by the near full detecting function.

Figure 11:
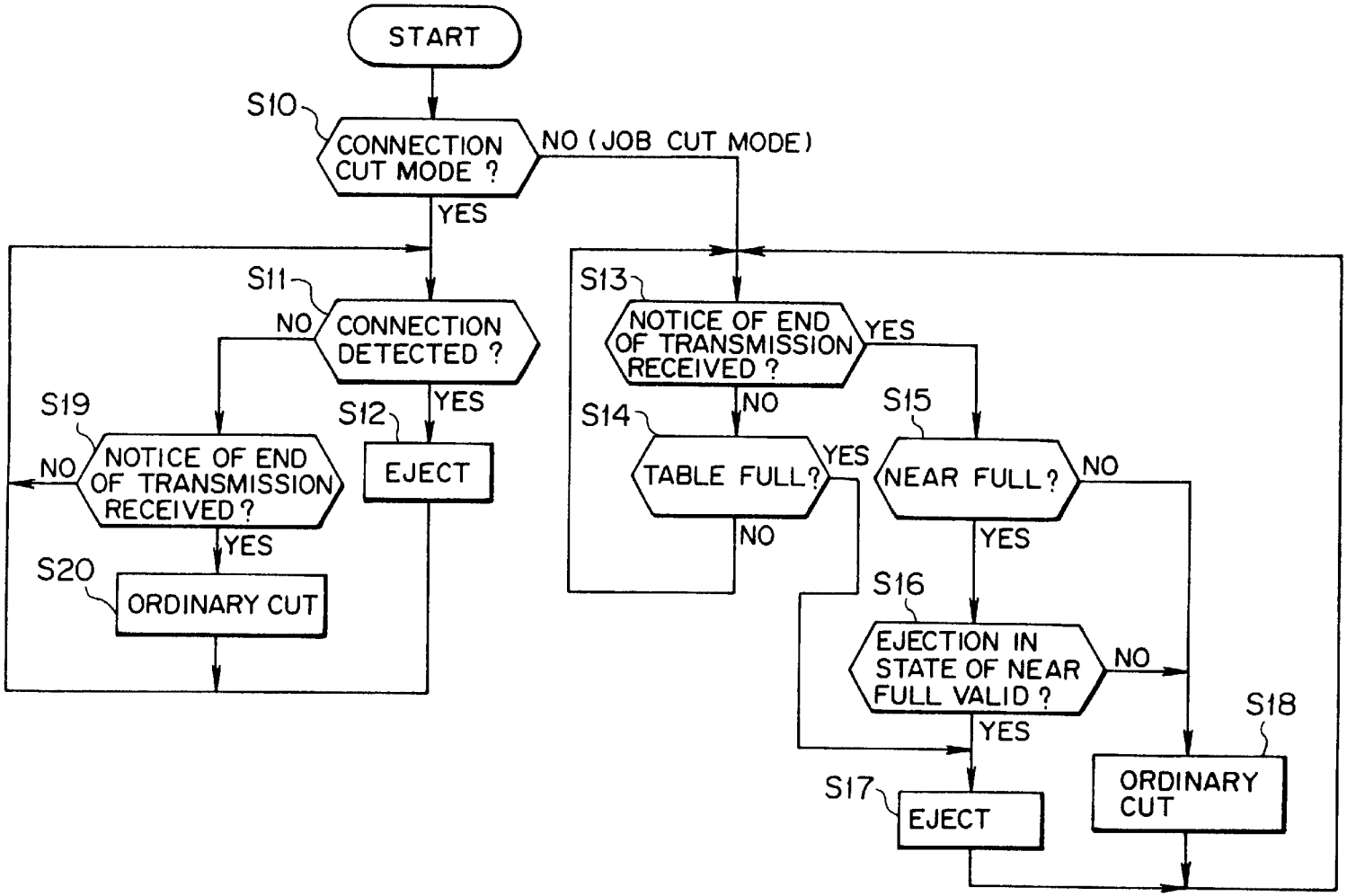
FIG. 11 is a flowchart illustrating the operation of the printing apparatus having a paper handling function according to the first embodiment.

The near full detecting function can also be implemented by using the aforesaid stacked quantity detecting means. For example, taking a state wherein 3000 pages of the printed paper 8 are stacked on the table 33 as a full state and a state wherein 2500 or more pages of the printed paper 8 are stacked as a nearly full state, the controller 200 can determine that a stacked quantity of the printed paper 8, on the table 33, has reached a nearly full state, i.e. 2500 pages, when the table full sensor SWA13 detects the table 33. FIG. 11 shows a flowchart of operation when the last-described near full detecting function is employed.

Furthermore, the controller 200, in the printer 2, or the controller 300, in the paper handler 3, has a function of serving as an end notice receiving section for receiving a notice indicating the end of each job (i.e., a notice indicating the end of transmission of print data for each job received from the host apparatus 100 or a notice indicating the end of printing received from the printer 2). Also, the printer 2 or the paper handler 3 has a function of serving as selecting means (not shown) as will be described below.

The selecting means is implemented in the form of a user operable switch. This switch allows a user to select either of the following two cutting control modes for the controller 300 which instructs the cutter 32 to perform a cutting operation.

In a first cutting control mode, when a stacked quantity detected by the aforesaid stacked quantity detecting means (table full sensors) reaches a first predetermined quantity, the cutter 32 is instructed to perform a cutting operation. In a second cutting control mode, when a stacked quantity detected by the stacked quantity detecting means (table full sensors) reaches a second predetermined quantity and a notice of the end of printing is received by the aforesaid function as an end notice receiving section, the cutter 32 is instructed to perform a cutting operation.

FIG. 11 shows a flowchart of operation when the printer 2 is provided with the functions serving as the end notice receiving section and the selecting means.

In the present embodiment, the first predetermined quantity is set to a loading unit (a quantity of loaded paper before starting printing (specifically, a quantity equivalent to a marketed box of paper), for example, 1500 pages) of the printing paper 7 (printed paper 8), and the second predetermined quantity is set to a quantity of nearly full (for example, 2500 pages).

(a7) Operation of Paper Handler

The operation of the printing apparatus having a paper handling function, according to the first embodiment, will now be described with reference to a flowchart (steps S10 to S20) shown in FIG. 11.

First, the controller 200 in the printer 2 determines whether the mode selector switch 201 selects the connection cut mode or the job cut mode (step S10).

(a7-1) Job Cut Mode

If it is judged in step S10 that the job cut mode is selected (i.e., a negative judgment is made), then the printer 2 prints print data transmitted from the host apparatus 100 on the printing paper 7, and the result of printing is ejected as the printed paper 8 to the paper handler 3. In the paper handler 3, the printed paper 8 is folded and stacked on the table 33 via the buffer 31, the cutter 32, and the swing guide 37.

When the printer 2 is performing a printing operation and while the paper handler 3 is performing a stacking operation, the controller 200 in the printer 2 is always monitoring whether or not information about the end of transmission of print data for one job (i.e., a notice indicating the end of transmission) is transmitted from the host apparatus 100 (step S13) and whether or not the table 33 has become full of the stacked printed paper 8 (step S14).

If it is judged in step S13 that a notice indicating the end of transmission is received from the host apparatus 100, then the controller 200 of the printer 2 instructs the paper handier 3 to cut the printed paper 8.

Usually, a speed of transmitting print data from the host apparatus 100 is faster than a speed of printing by the printer 2. Thus, print data accumulates in the printer 2. Thus accumulating print data are stored in a memory (not shown) in the printer 2. The printer 2 sequentially reads print data from the memory and prints the print data at the printing process section 10. Accordingly, when the controller 200 (end notice receiving section) in the printer 2 receives a notice indicating the end of transmission for one job from the host apparatus 100 (i.e., an affirmative judgment is made in step S13), the controller 200 outputs an instruction to being cutting to the print handler 3 at the time when print data stored in the memory are all printed.

In the present embodiment, if is judged in step S13 that a notice indicating the end of transmission is received from the host apparatus 100, the controller 200 determines from a detection signal transmitted from sensors in the paper handler 3 whether or not the printed paper 8 stacked on the table 33 has reached the second predetermined quantity, i.e., a nearly full state (step S15).

Suppose that a nearly full state (second predetermined quantity) is set to 2500 pages using the full-of-paper sensor selector switch 202 and that a state of full (first predetermined quantity) is set to 3000 pages. In this case, the controller 200 in the printer 2 determines whether or not the table 33 is nearly full of paper, based on whether or not the table full sensor SWA13 (table position sensor SWA) in the paper handler 3 is activated by the detecting member 57 and is outputting a detection signal.

If it is judged in step S15 that the table 33 is not nearly full of the printed paper 8 (i.e., a negative judgment is made), then the controller 200 outputs an instruction to begin cutting to the paper handler 3, and an ordinary cutting operation is performed in the paper handler 3 (step S18).

That is, in the paper handler 3, the cutter 32 cuts the printed paper 8 under the control of the controller 300, and the thus-cut printed paper 8 is stacked on the table 33.

In addition, the drive motor 81 for causing the table 33 to advance or retreat runs under the control of the controller 300 to rotate the unloading belt 72 via the drive belt 74 and the drive roller 73. As described earlier with reference to FIGS. 8 and 9, the drive motor 81, for causing the table 33 to advance or retreat, continues running until the forward position sensor 83 or the backward position sensor 84 detects that a slit in the disk 82 has moved from the position of the forward position sensor 83 to the position of the backward position sensor 84 or vice versa (i.e., from the position of the backward position sensor 84 to the position of the forward position sensor 83). When the forward position sensor 83 or the backward position sensor 84 detects the slit, the controller 300 stops running the drive motor 81 for causing the table 33 to advance or retreat.

Figure 12:
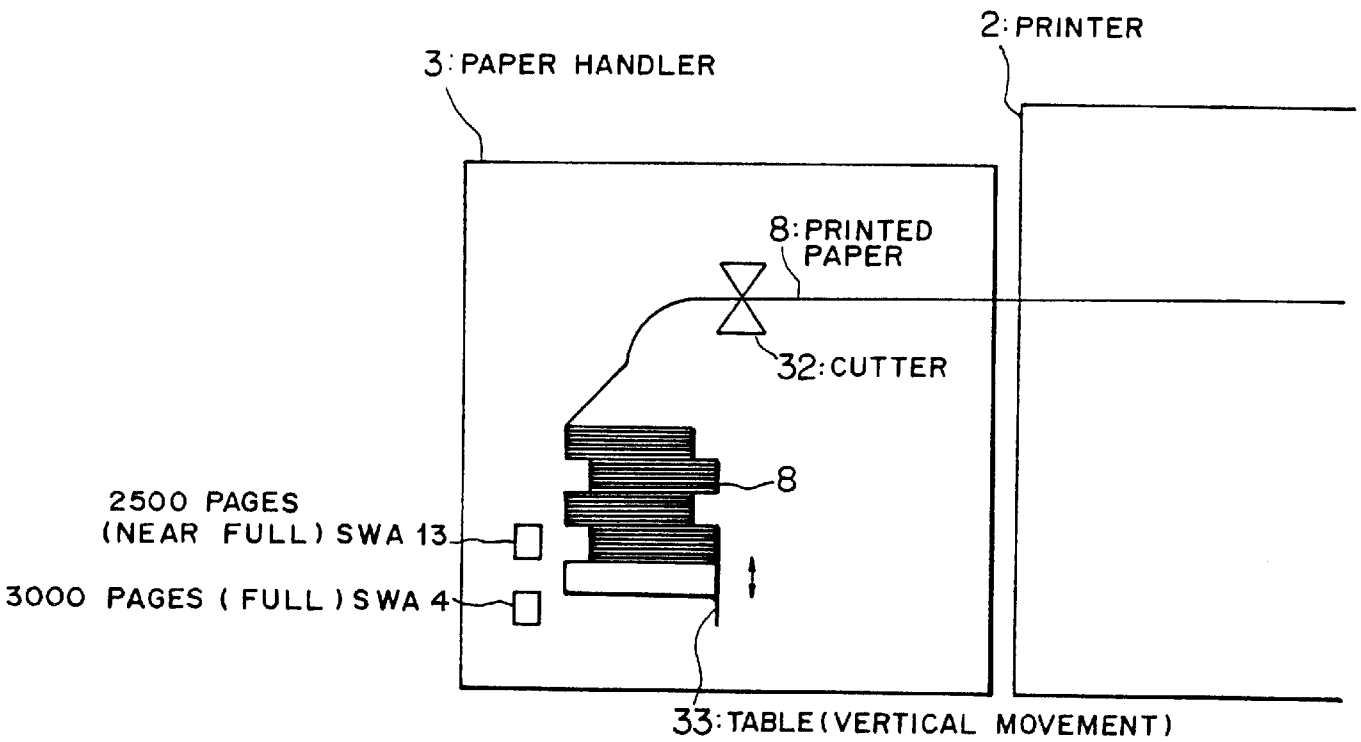
FIG. 12 is a schematic side view showing the state of stacking printed paper on the table according to the first embodiment.

As a result of repeating steps S13, S15, and S18, the printed paper 8 is stacked on the table 33 such that a stack for one job is shifted from a stack for another job, as shown in FIG. 12. This allows a user to easily identify the printed paper 8 for each job.

Repeating steps S13, S15, and S18, the controller 300 controls the operation of the drive motor 51 for vertically moving the table 33 so as to adjust the height of the table 33 in such a manner that the height sensor 40 always detects the top edge of the printed paper 8 stacked on the table 33.

If it is judged in step S15 that the table 33 is nearly full of the printed paper 8, i.e., if the number of pages of the printed paper 8 stacked on the table 33 exceeds 2500 (a nearly full state), but does not exceed 3000 (a full state) as shown in FIG. 12, then the controller 200 determines whether or not an ejection in a nearly full state is effective (step S16).

If it is judged in step S16 that an ejection in a nearly full state is not effective (that is, an ejection of paper in a nearly full state is disabled by selection), then processing proceeds to step S18 to perform an ordinary cutting operation, and then a user is notified of a nearly full state, to be described later. If it is judged in step S16 that an ejection in a nearly full state is effective (that is, an ejection of paper in a nearly full state is enabled by selection), then a cutting operation is performed as in step S18, and then the printed paper 8 stacked on the table 33 is unloaded (step S17; eject) from the paper handler 3.

In this unloading operation, the table 33 is vertically moved by the drive motor 51 until the eject position sensor SWA5 detects the top edge of the table 33, and then the offset mechanism 70 is operated, whereby a stack of the printed paper 8 is unloaded from the table 33 to the conveyors 4, 5 via the junction 41 and the direction changer 6.

After the ejecting operation is completed, the table 33 is raised by the drive motor 51 for vertically moving the table 33 until the table upper end position sensor SWA3 detects the top edge of the table 33. Then, the empty table 33 begins to be stacked again with the printed paper 8 which has undergone printing in the printer 2 in response to an instruction to begin printing for a next job from the host apparatus 100.

As described above, when printing for one job is completed, whether or not a stacked quantity on the table 33 has exceeded a nearly full state is detected. If the stacked quantity does not exceed the nearly full state, printing for a next job starts, and if the stacked quantity exceeds the nearly full state, an ejecting operation (i.e., an operation in the second cutting control mode as described earlier) is performed, whereby the result of printing for one job is prevented from being divided into two blocks. Accordingly, a user who comes to receive the printed paper 8 can receive the entire printed paper 8 for his/her job without fail.

Also, as described earlier, the controller 200 in the printer 2 monitors, for not only a notice indicating the end of transmission from the host apparatus 100 in step S13, but also for a detection signal from the table full sensor SWA4 (information from the paper handler 3) so as to determine whether or not a stacked quantity of the printed paper 8 on the table 33 has reached a stacker full state (i.e., 3000 pages).

When a detection signal outputted from the table full sensor SWA4 indicates the detection of the top edge of the table 33, i.e., when the table 33 becomes full of the printed paper 8, no further printed paper 8 can be stacked on the table 33. Thus, the controller 200 instructs the printer 2 to halt printing and outputs an instruction to begin cutting to the paper handler 3.

In response to the instruction to begin cutting, the cutter 32 in the paper handler 3 cuts the printed paper 8 under the control of the controller 300, and the thus-separated printed paper 8 is stacked on the table 33. The separated stack of printed paper 8 is unloaded from the paper handler 3 (step S17). Also, in this case, the table 33 is vertically moved by the drive motor 51 until the eject position sensor SWA5 detects the top edge of the table 33, and then the offset mechanism 70 is operated, whereby a stack of the printed paper 8 is unloaded from the table 33 to the conveyors 4, 5 via the junction 41 and the direction changer 6.

(a7-2) Connection Cut Mode

If it is judged in step S10 that the connection cut mode is selected (i.e., an affirmative judgment is made; the first cutting control mode as described earlier is selected), then as in the job cut mode, the printer 2 prints print data transmitted from the host apparatus 100 on the printing paper 7, and the result of printing is ejected as the printed paper 8 to the paper handler 3. In the paper handler 3, the printed paper 8 is folded and stacked on the table 33 via the buffer 31, the cutter 32, and the swing guide 37.

While the printer 2 is performing the printing operation and while the paper handler 3 is performing the stacking operation, the controller 200 in the printer 2 monitors the printing paper 7 for the connection (a connected section) between loading units thereof (step S11). For detecting the connection, a mark may be put on the starting or ending page of the printing paper 7 of one loading unit, and a sensor (not shown, connection detecting means) for detecting the mark may be installed in the printer 2.

If the mark is put on the starting or ending page of the printing paper 7 of one loading unit at the stage of marking, an accidental breaking of the marked page may disable the detection of connection. To prevent this problem, when a certain loading unit of the printing paper 7 is connected with a next loading unit, the starting or ending page may be manually punched to form the mark, whereby the printing paper 7 is reliably marked for detecting the connection.

The controller 200 in the printer 2 keeps monitoring whether or not information about the end of the transmission of the print data for one job (a notice indicating the end of transmission) is transmitted from the host apparatus 100 (step S19), as in steps S13 and S18 in the job cut mode, until the connection is detected in step S11 (i.e., a negative judgment is made).

When the controller 200 (end notice receiving section) in the printer 2 receives a notice indicating the end of the transmission for the one job from the host apparatus 100 (i.e., an affirmative judgment is made in step S19), the controller 200 outputs an instruction to begin cutting to the print handler 3, and an ordinary cutting operation is performed in the paper handler 3 (step S20).

That is, in the paper handler 3, the cutter 32 cuts the printed paper 8 under the control of the controller 300. Also, the offset mechanism 70 is operated so as to stack the printed paper 8 in such a state that a stack for one job is shifted from a stack for another job. This allows a user to easily identify the printed paper 8 for each job.

If it is judged in step S11 that the connection is detected (i.e., an affirmative judgment is made), then the controller 200 instructs the printer 2 to halt printing and outputs an instruction to begin cutting to the paper handler 3.

In response to the instruction to begin cutting, the cutter 32 in the paper handler 3 cuts the printed paper 8 along a connection (a connected section) under the control of the controller 300. Thus, the printed paper 8 of a quantity equivalent to a loading unit is stacked on the table 33, and the thus-stacked printed paper 8 is unloaded from the paper handler 3 (step S17). Also, in this case, the table 33 is vertically moved by the drive motor 51 until the eject position sensor SWA5 detects the top edge of the table 33, and then the offset mechanism 70 is operated, whereby a stack of the printed paper 8 is unloaded from the table 33 to the conveyors 4, 5 via the junction 41 and the direction changer 6.

However, if a connection is detected in step S11 immediately after completing the printing for one job (unit of a print process) and cutting the printed paper 8 in step S20, a cutting operation will be performed again along the detected connection. This may cause the printed paper 8 to be cut after only a few pages are printed for a certain job.

A conceivable method for preventing the above-described problem is that a cutting operation is only performed in response to detection of a connection without being combined with a job-oriented cutting operation in steps S19 and S20 in FIG. 11. This method can avoid the problem that the printed paper 8 is cut after only a few pages are printed. When this method is used, for distinguishing the printed paper 8 for one job from the printed paper 8 for another job, the printer 2 prints a mark at the edge portion of a page each time printing for one job is completed. The marks allow a user to distinguish a portion of one job from a portion of another job in the printed paper 8 which is straightly stacked on the table 33, by viewing the stacked printed paper 8 from the side thereof.

Another method for avoiding the problem that the printed paper 8 is cut after only a few pages are printed can be implemented by using the near full detecting function (printed page counter 200A for detection of a nearly full state), as described earlier, of the controller 200. This method will be described below.

The number of pages of the printing paper 7 in a marked box (loading unit) is known because it is marked on a box or similar. The number of pages is previously stored in the printer 2 (or the paper handler 3). For example, in the present embodiment, the number of pages (for example, 1500 pages) corresponding to a loading unit is selected as the number of pages corresponding to a full-of-paper state using the full-of-paper sensor selector switch 202.

The counter 200A of the controller 200 in the printer 2 (or a counter function of the controller 300 in the paper handler 3) is used to count pages which have been printed in the printer 2 since stacking the printed paper 8 has resumed after a stack of the printed paper 8 on the table 33 was ejected.

The controller 200 compares a count value of the counter 200A and the number of pages of the loading unit. When their difference (i.e., the residual number of pages of the printed paper 8 stackable on the table 33) falls in a predetermined range, the controller 200 further compares the number of pages of the printing paper 7 required for printing print data to be transmitted from the host apparatus 100 with the residual number of pages stackable (the difference described above) in order to determine whether or not the residual number of pages is large enough to complete the printing for a job. If the controller 200 determines that the residual number of pages stackable is large enough to complete the printing for a job, the controller 200 exercises control so as to continue printing for the job. After printing for the job is completed, the controller 200 compares the number of pages of the printing paper 7 required for printing a next job with the current residual number of pages stackable, and repeats the above-mentioned process.

On the other hand, if the controller 200 determines that the residual number of pages stackable is too small to complete the printing for a job, the controller 200 exercises control so as to stack the printing paper 7 on the table 33 without printing thereon and then instructs the cutter 32 to perform a cutting operation when a mark indicating connection is detected.

Thus, the problem can be avoided that the printed paper 8 is cut after only a few pages have undergone printing.

As has been stated above, the printed paper 8 is cut at a connection with the printed paper 8 of a next loading unit, whereby the number of pages of the printed paper 8 stacked on the table 33 becomes equivalent to a marked box of the printing paper 7 (for example, 1500 pages or so). Thus, a stack of the printed paper 8 on the table 33 is easy to transport.

(a8) Structure and Operation of Unloading Mechanism

Figure 13:
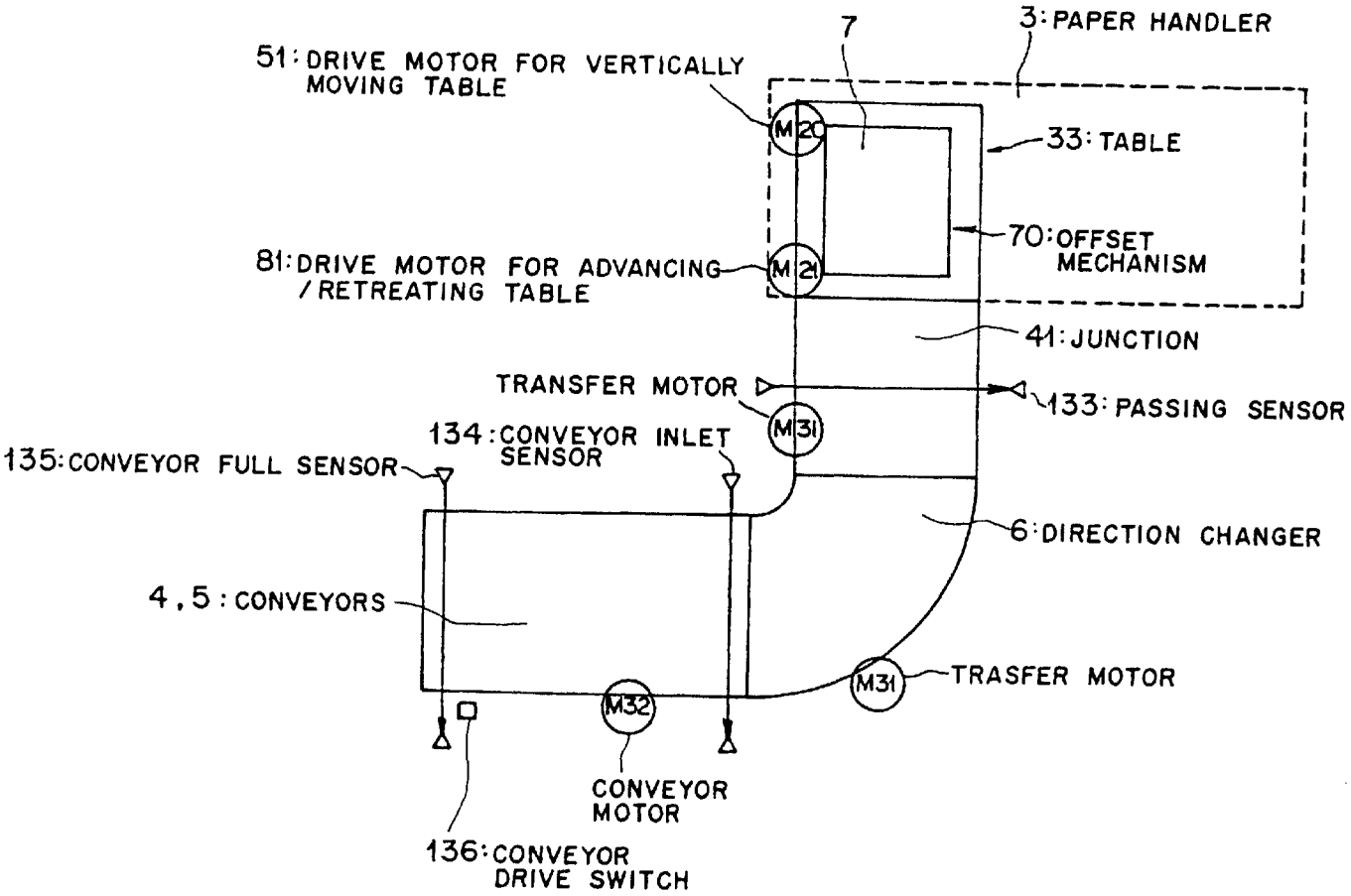
FIG. 13 is a schematic plan view showing an unloading mechanism in the paper handler according to the first embodiment.

FIG. 13 is a schematic plan view showing an unloading mechanism in the paper handler 3, according to the first embodiment. As shown in FIG. 13, the unloading mechanism, according to the first embodiment, is composed of the offset mechanism 70 provided on the table 33, the junction 41, the direction changer 6, and the conveyors 4, 5.

As described earlier with reference to FIG. 1, the direction changer 6 changes the direction of transfer of the printed paper 8 which has been unloaded from the table 33 of the paper handler 3 to the direction changer 6 via the junction 41, to the direction (a conveying direction of the conveyors 4, 5) in which the stand 1, the printer 2, and the paper handler 3 are arranged.

The layout of the unloading mechanism is not to be limited to that shown in FIG. 13. For example, the junction 41 and the direction changer 6 may be omitted according to an application of the printing apparatus, installation place and other conditions of installation. Furthermore, for increasing a quantity of stocking (carrying) the printed paper 8 on the conveyors 4, 5, another conveyor may be added to the conveyors 4, 5.

For unloading the printed paper 8, the controller 300 in the paper handler 3 runs the drive motor 51 (M20) so as to vertically move the table 33 to the position where the eject position sensor SWA5 is activated with the detecting member 57 of the table 33.

In the state where the table 33 is located in the thus-reached position (that is, in the state where the eject position sensor SWA5 detects the top edge of the table 33), the top face of the table 33 (top face of the unloading belt 72) is substantially flush with the carrying surface of the junction 41, the direction changer 6, and the conveyors 4, 5. If the top face of the table 33 is at a different level from the carrying surface of the junction 41, the direction changer 6, and the conveyors 4, 5, trouble, such as the printed paper 8 getting stuck, may take place. Hence, as described above, when components of the unloading mechanism have flush carrying surfaces with respect to each other, the printed paper 8 is smoothly unloaded.

The controller 300 stops the motor 51 for vertically moving the table 33 when the table 33 reaches the position where the eject position sensor SWA5 is activated.

Then, the controller 300 runs the drive motor 81 (M21) for causing the table 33 to advance or retreat so as to rotate the unloading belt 72, whereby a stack of the printed paper 8 is ejected from the table 33 to the junction 41.

The junction 41 is formed of a belt conveyor, for example, and is driven by a transfer motor (M30) so as to transfer the printed paper 8 to the direction changer 6. In this case, the passing of the printed paper 8 is detected by the passing sensor 133, thereby allowing the controller 300 to know that the printed paper 8 has been smoothly transferred from the table 33 to the junction 41.

When the passing of the printed paper 8 is not detected by the passing sensor 133 in a predetermined time after the controller 300 has started running the drive motor 81 for causing the table 33 to advance or retreat so as to unload the printed paper 8, the controller 300 interprets the failure in detection as the occurrence of trouble, such as the printed paper 8 getting stuck, and notifies a user of the occurrence of trouble by means of the LCD 203 on the printer 2 or a buzzer (not shown). This notification allows an administrator or user to remedy the trouble.

Furthermore, the printed paper 8, which has been transferred to the direction changer 6 via the junction 41, is changed in its direction of transfer thereof with respect to the conveying direction of the conveyor 4 by running a transfer motor (M31).

A conveyor inlet sensor 134 is provided at the entrance to the conveyors 4, 5 so as to detect the arrival of the printed paper 8 which has been transmitted from the direction changer 6. When the arrival of the printed paper 8 is detected by the conveyor inlet sensor 134, the controller 300 starts the conveyor motor (M32) to run the conveyors 4, 5, whereby the printed paper 8 is conveyed further forward. When the arrival of the printed paper 8 is not detected by the conveyor inlet sensor 134 in a predetermined time after the passing sensor 133 has detected the printed paper 8, the controller 300 interprets the failure in detection as the occurrence of trouble, such as the printed paper 8 getting stuck in the portion between the junction 41 and the direction changer 6, and notifies an administrator or user of the occurrence of trouble in the same manner as described above.

When the printed paper 8 is conveyed on the conveyors 4, 5 by a predetermined length after the conveyor inlet sensor 134 has detected the printed paper 8, the controller 300 stops running the conveyor motor (M32). That is, when the printed paper 8 is conveyed on the conveyors 4, 5 by a length which is substantially equal to the width of the printed paper 8, the conveyor motor (M32) is stopped, whereby the printed paper 8 is stocked there. Then, when the another block of the printed paper 8 is transferred to the conveyors 4, 5 via the junction 41 and the direction changer 6, the conveyor motor (M32) is run so as to stock the block of the printed paper 8 on the conveyors 4, 5 in the same manner as described above. By repeating this operation, a plurality of blocks of the printed paper 8 are stocked on the conveyors 4, 5.

In this connection, by providing the printer 2 or the paper handler 3 with a sensor for detecting the width of the printing paper 7 or the printed paper 8, a length of one conveying action on the conveyors 4, 5 can be obtained.

The conveyor 5 is provided with a conveyor full sensor 135 at the downstream end for detecting the arrival of the printed paper 8. When another block of the printed paper 8 is attempted to be stocked on the conveyors 4, 5 in addition to a plurality of blocks of the printed paper 8 which are already stocked thereon, and when the conveyor full sensor 135 detects the arrival of the printed paper 8 (that is, when the conveyors 4, 5 are full of the printed paper 8), the controller 300 stops transferring the additional block of the printed paper 8 and notifies an administrator or user of a conveyor full on the LCD 203 or similar, thereby prompting him/her to remove the printed paper 8 from the conveyors 4, 5.

As described above, when the conveyor full sensor 135 detects the printed paper 8, an additional block of the printed paper 8 cannot be stocked on the conveyors 4, 5. In this case, therefore, when the table 33 becomes full of the printed paper 8, the controller 200 in the printer 2 stops printing in the printer 2.

An additional block of the printed paper 8 may be stocked on the junction 41 and the direction changer 6. For implementing this stocking method, the junction 41 and the direction changer 6 may be provided with a sensor for detecting the position of the printed paper 8, and the controller 300 may control the operation of the transfer motors (M30, M31) in response to a detection signal from the sensors.

When the conveyor full sensor 135 returns to the state of not detecting the printed paper 8 as a result of a user or similar removing blocks of the printed paper 8 from the conveyors 4, 5 after the conveyor full sensor 135 detected the printed paper 8 and before the table 33 becomes full of the printed paper 8, it becomes possible to unload the printed paper 8 which is stacked on the table 33.

Furthermore, the conveyors 4, 5 are provided with a conveyor drive switch 136 for allowing a user or similar to manually operate the conveyors 4, 5 in order to run the conveyors 4, 5 either forwardly or backwardly. That is, when a space for stocking another block of the printed paper 8 becomes available as a result of removing a block or blocks of the printed paper 8 from the conveyors 4, 5, a user may manually operate the conveyor drive switch 136 to run the conveyors 4, 5 in either direction, whereby the printed paper 8 which remains on the conveyors 4, 5 can be moved to a suitable position.

The above-mentioned unloading mechanism, i.e., the junction 41, the direction changer 6, and the conveyors 4, 5 can be provided as options. When the unloading mechanism is not provided, a stacking quantity of the printed paper 8 in the paper handler 3 is reduced considerably. However, in a configuration that the conveyors 4, 5, the direction changer 6, and the junction 42 (which are all optional), and the paper handier 3, are adapted to be connectable to the printer 2, as needed, it is possible to meet diversified needs with the printer 2 serving as a common apparatus, whereby the cost of the apparatus can be reduced.

Accordingly, in order to cope with the case where the unloading mechanism (that is, the junction 41, the direction changer 6, and the conveyors 4, 5) is not provided, the printer 2, according to the present embodiment, allows a user to select whether or not the unloading of the printed paper 8 is made effective in a nearly full state (or a full state), as stated earlier in the description of step S16 of FIG. 11. If the unloading of the printed paper 8 in a nearly full state is disabled by selection, even when the table 33 becomes nearly full of the printed paper 8, an ordinary cutting operation is performed, i.e., the printed paper 8 is cut by driving the cutter 32 (steps S15, S15, and S18 in FIG. 11).

Then, the LCD 203 of the printer 2 displays, for notification to a user or administrator, that the table 33 is nearly full of the printed paper 8. In this case, printing can be continued until the table 33 becomes full of the printed paper 8. When a full state is detected as a result of continuing printing, the printed paper 8 is cut with the cutter 32, and the LCD 203 of the printer 2 displays, for notification to a user or administrator, that the table 33 is full of the printed paper 8.

(a9) Action and Effect of First Embodiment

As has been stated above, in the printing apparatus having a paper handling function according to the first embodiment of the present invention, a space for stocking the printed paper 8 for a plurality of jobs within the apparatus can be minimized, and the problem can be solved that the printed paper 8, stacked during an initial job, cannot be taken out due to there being too much printed paper 8 stacked on the table 33.

Accordingly, the printed paper 8 can be efficiently stacked without increasing the cost and size of the apparatus or decreasing printing efficiency and without imposing a heavy burden on a user. When it is detected that the table 33 is nearly full of the printed paper 8 and when printing for a certain job is not completed, the printer 2 continues printing until printing for the job is completed, thereby preventing an incomplete termination of printing for one job. This reliably prevents the printed paper 8 for the same job from being stacked and unloaded in different blocks.

Also, the printed paper 8 can be stacked on the table 33 in a suitable quantity for transport (for example, a quantity equivalent to a marked box of the printing paper 7 (loading unit)). In addition, the use of the unloading mechanism reduces the space for stocking the printed paper 8 within the apparatus. Accordingly, the printed paper 8 can be efficiently stacked without increasing the cost and size of the apparatus or decreasing printing efficiency and without imposing a heavy burden on a user.

Furthermore, the offset mechanism 70 causes the printed paper 8 to be stacked in such a state that a stack for one job is shifted from a stack for another job, whereby the printed paper 8 for one job can be easily distinguished from the printed paper a for another. Thus, a burden on a user can be reduced greatly. The offset mechanism 70 can be implemented to have a quite simple structure using the unloading belt 72, the drive motor 51 for vertically moving the table and similar.

If part of the unloading mechanism is adapted to serve as the offset mechanism 70 as in the present embodiment, there is no need for providing an independent offset mechanism, whereby the apparatus can be made more compact.

Also, it is possible for a user to select whether a cutting operation is performed only according to a stacked quantity of the printed paper 8 on the table 33 or a cutting operation is performed according to a stacked quantity of the printed paper 8 on the table 33 and a notice indicating the end of a job, whereby diversified needs of users can be coped with.

(b) Second Embodiment

Figure 14:
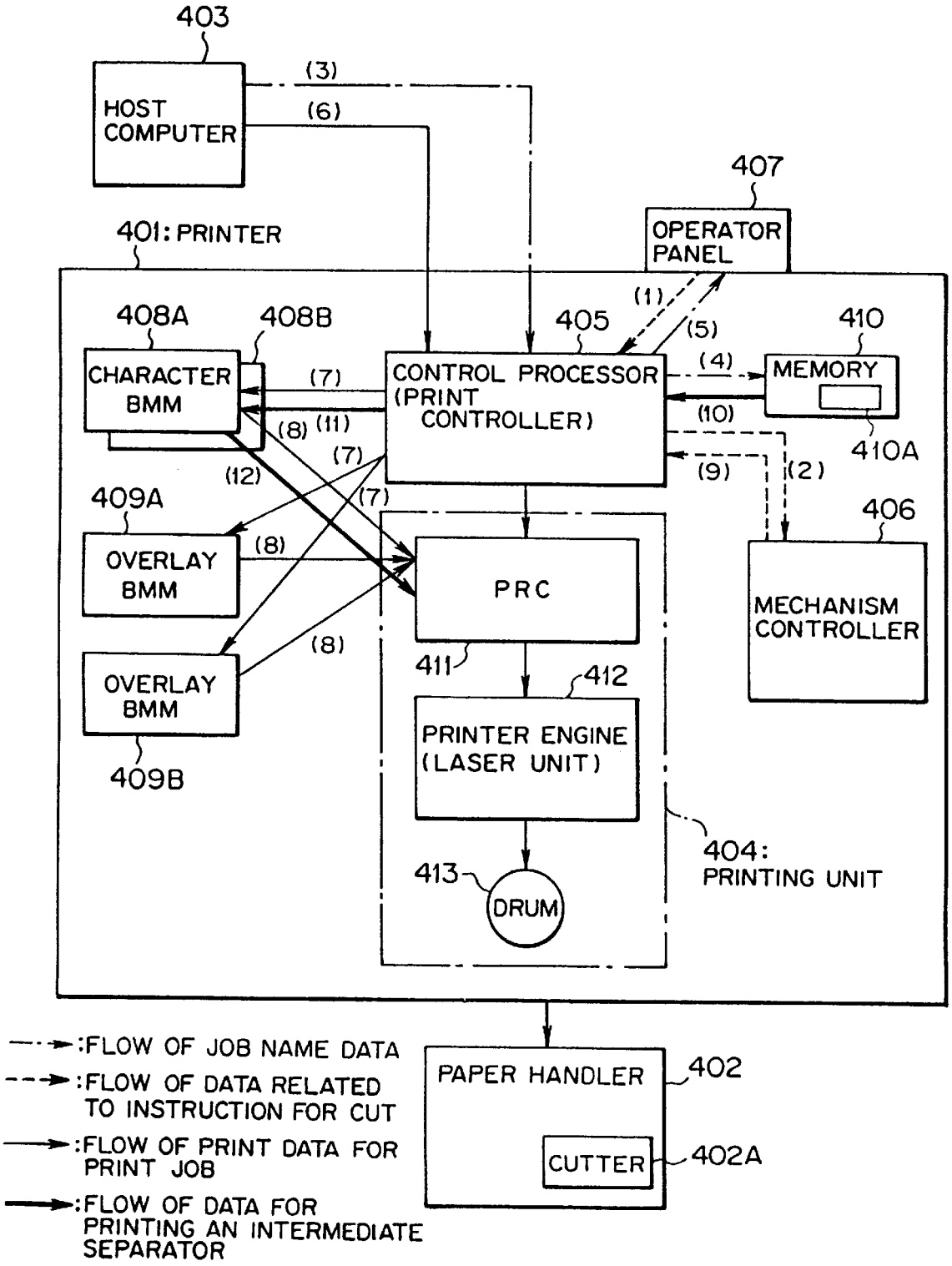
FIG. 14 is a block diagram showing a printing apparatus having a paper handling function according to a second embodiment of the present invention.
Figure 32:
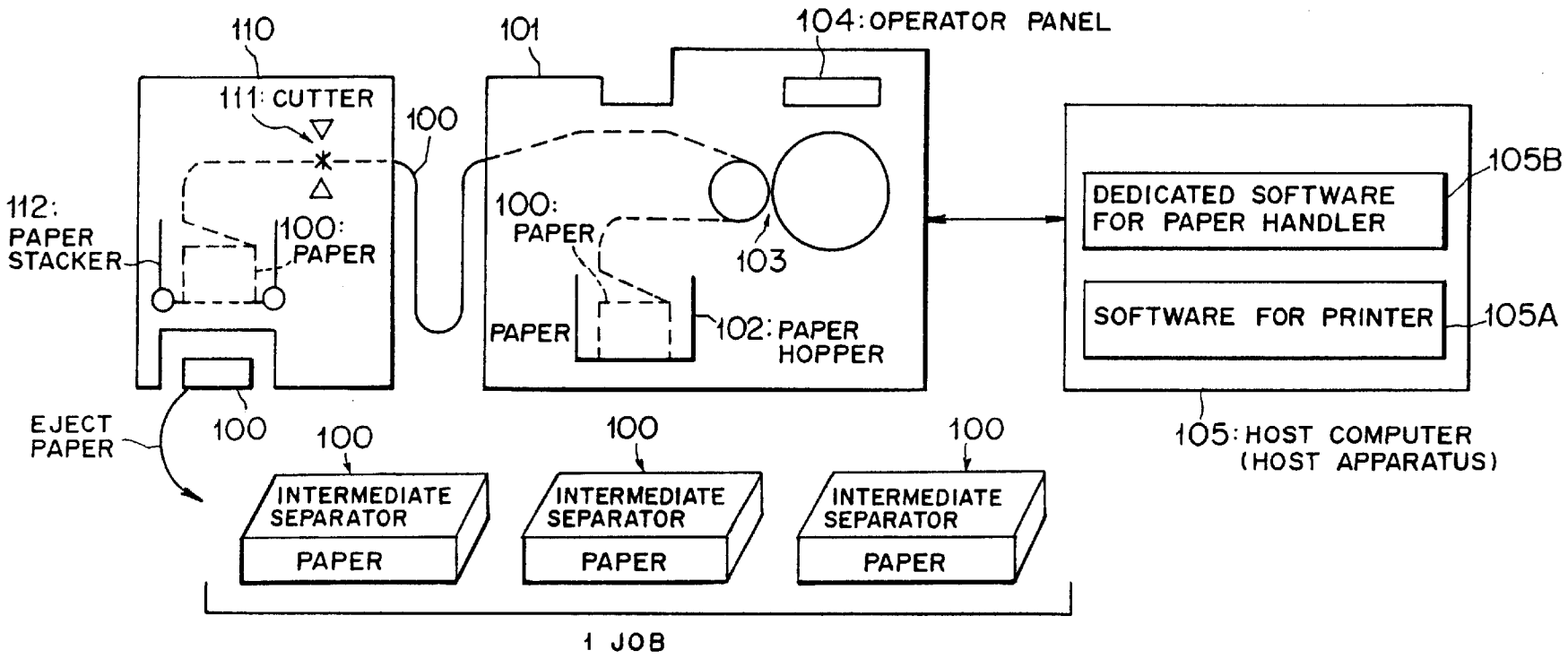
FIG. 32 PRIOR ART
FIG. 32 is a view illustrating the structure and operation of another conventional printing apparatus having a paper handling function.

FIG. 14 is a block diagram showing a printing apparatus having a paper handling function according to a second embodiment of the present invention. The printing apparatus, according to the present embodiment, is basically of the same structure as the conventional apparatus shown in FIGS. 32 and 33. As shown in FIG. 14, the printing apparatus, according to the present embodiment, is composed of a printer 401 and a paper handler 402 which is connected to the printer 401 on the paper handler's stage side (i.e., on the paper eject side).

The paper handler 402 is fed and handles continuous paper 400 (see FIGS. 18, 21, and 23) which has undergone printing in the printer 401. The paper handler 402 has a cutter (cutting mechanism) 402A which cuts the continuous paper 400 in response to an instruction to begin cutting from the printer 401. The paper handler 402 is basically of the same structure as the paper handler 3 which was described earlier with reference to FIG. 3.

Figure 18:
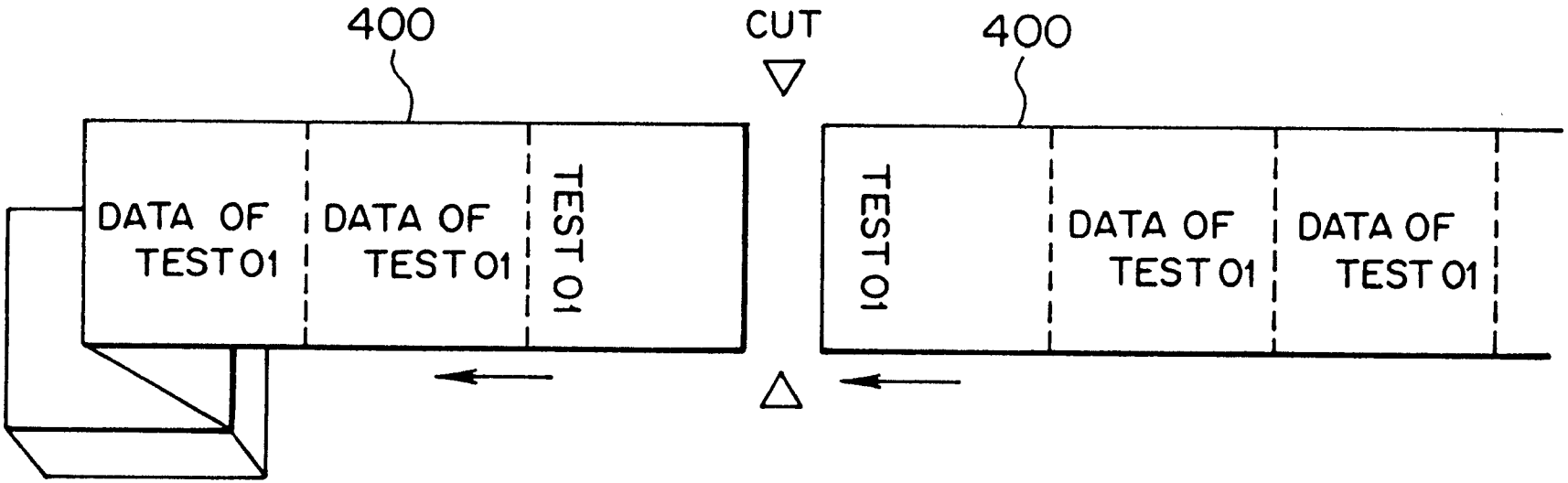
FIG. 18 is a view exemplifying printed intermediate separators in the second embodiment.
Figure 21:
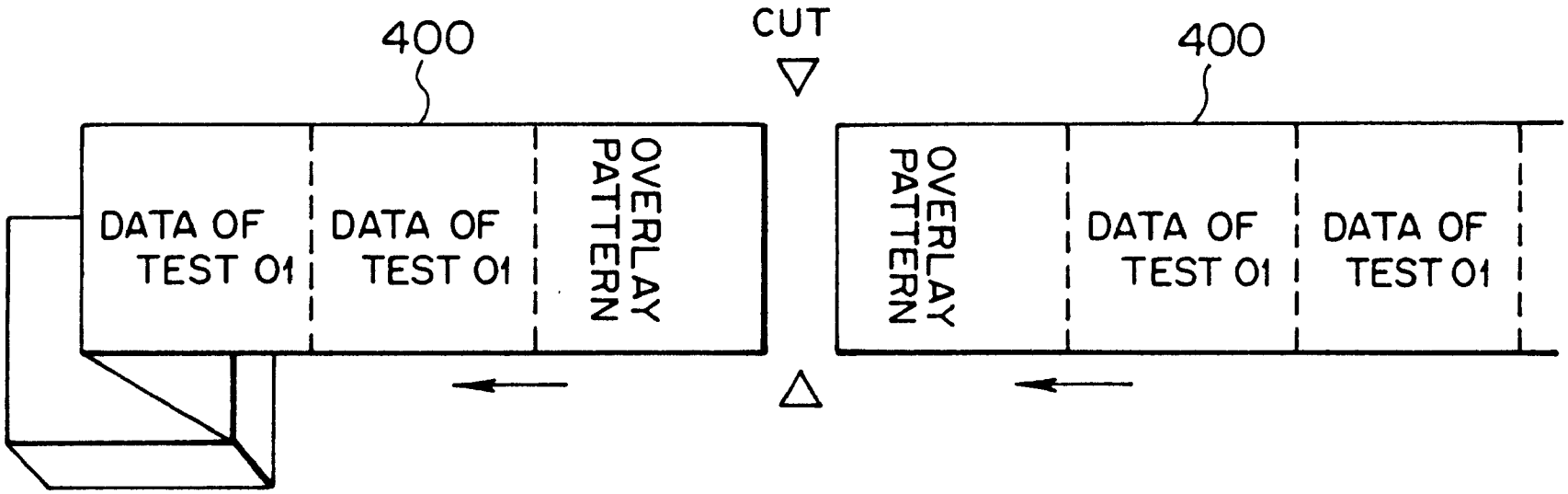
FIG. 21 is a view exemplifying printed intermediate separators in the first modification of the second embodiment.
Figure 23:
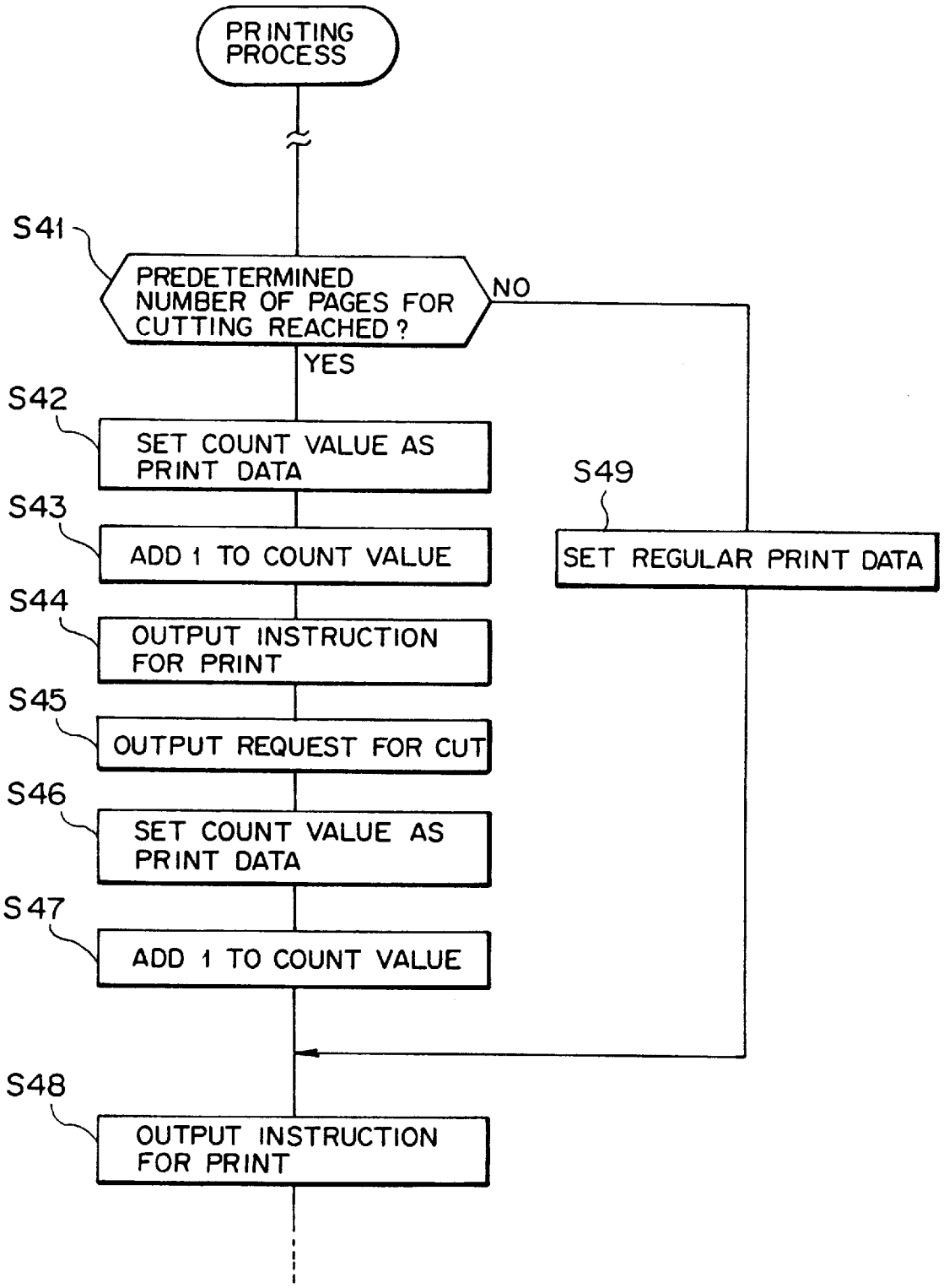
FIG. 23 is a flowchart illustrating the operation of the second modification of the second embodiment (i.e., the procedure for printing an intermediate separator)

The continuous paper 400 is loaded/stacked in a state of being folded at perforations as described earlier. The cutter 402A cuts the continuous paper 400 along perforations as shown in FIGS. 18, 21 and 23.

In the second embodiment, as will be described later, the printer 401 outputs an instruction to the paper handler 402 to begin cutting each time predetermined pages (i.e., a portion of paper between two lines of perforations is taken as one page) of the continuous paper 400 are printed, whereby the cutter 402A performs a cutting operation every predetermined number of pages.

The printer 401 performs printing based on print information received from a host computer (host apparatus or print requester) 403 and has a printing unit 404, a control processor 405, a mechanism controller 406, an operator panel 407, character bit map memories (BMMs) 408A and 408B, overlay bit map memories (BMMs) 409A and 409B and a memory 410.

The printing unit 404 prints print data on the continuous paper 400 and has a hardware controller (PRC) 411, a printer engine (laser unit) 412, and a drum 413. Receiving an instruction to begin printing from the control processor 405, as will be described later, the hardware controller 411 controls the printer engine 412 so as to form, on the surface of the drum 413, an electrostatic latent image of patterns corresponding to print data which is expanded in BMMs 408A, 408B, 409A, 409B. As described earlier with reference to FIG. 2, a developing unit (not shown) supplies toner onto the drum 413 and consequently, a visible toner image is developed from the electrostatic latent image. The visible toner image is then transferred onto the continuous paper 400. Printing is thus performed on the continuous paper 400.

The printer engine 412 corresponds to the exposure unit 22, shown in FIG. 2, and the drum 423 corresponds to the photosensitive drum 20 shown in FIG. 2. The printing unit 404 (not shown in FIG. 14), according to the present embodiment, is also provided with a feature similar to the printing process section 10, shown in FIG. 2.

The control processor (print controller) 405 controls a printing operation of the printing unit 404. The control processor 405 analyzes print data received from a host computer 403, expands the analyzed print data in the character BMMs 408A, 408B or the overlay BMMs 409A, 409B, and instructs the printing unit 404 to print the result of the expansion on the continuous paper 400. In the present embodiment, when the cutter 32 cuts the continuous paper 400 in the midst of printing one job, the control processor 405 controls the printing unit 404 so as to print a job name for print data being currently printed on a page before and after a cutting position to act as an intermediate separator.

The mechanism controller 406 controls the operation of various mechanisms, such as a mechanism for feeding the continuous paper 400, in the printer 401. In the present embodiment, the mechanism controller 406 counts pages of the continuous paper 400 which have been printed at the printing unit 404. When the thus-counted pages reach a predetermined number of pages for performing a cutting operation, the mechanism controller 406 sends an instruction to begin cutting to the control processor 405. In response to an instruction to begin cutting from the mechanism controller 406, the control processor 405 exercises control so as to print an intermediate separator as described earlier.

Figure 17:
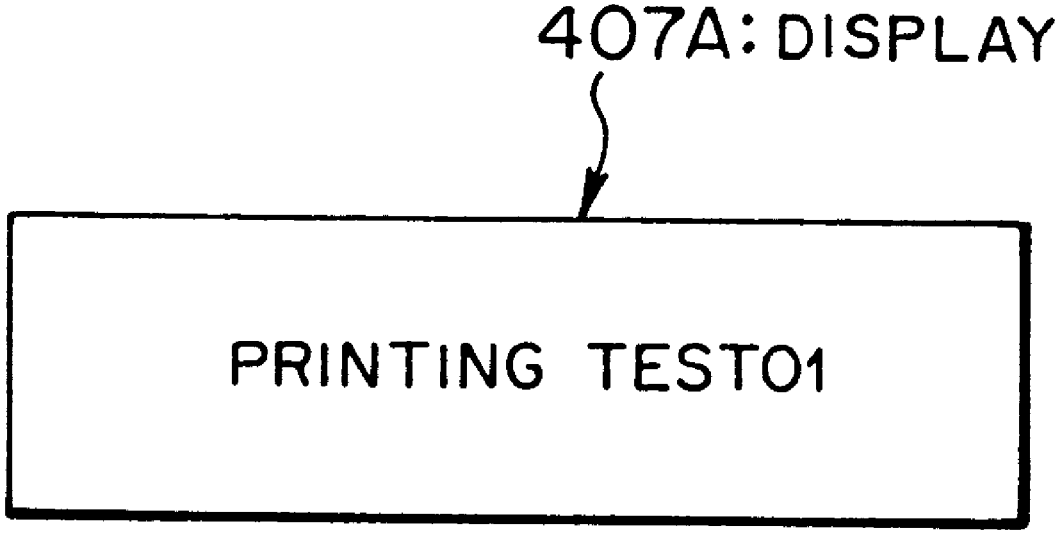
FIG. 17 is a view showing a display of a job name in the second embodiment.

The operator panel 407 is provided on the printer 401 and has switches for making various kinds of setting on the printer 401 and the paper handler 402 and a display 407A (see (FIG. 17) for displaying the state of operation of the printer 401.

The memory (storage) 410 stores various data and programs required for the control processor 405 to exercise control. The memory 410 has a job name storage area 410A for saving job name information associated with print data being currently printed. In the second embodiment, job name information, which together with print data, is transmitted from the host computer (print requester) 403, is saved in the job name storage area 410A so as to display a job name for print data currently being printed on the display 407A on the operator panel 407 (see an example in FIG. 18) according to an ordinary procedure for displaying a job name.

Utilizing the above-mentioned ordinary procedure for displaying a job name where the name of a job currently being printed is read from the host computer 403 and displayed on the display 407A on the operator panel 407 the printing apparatus, according to the second embodiment, prints an intermediate separator. An operation of printing an intermediate separator will now be described in detail with reference to a block diagram of FIG. 14 and a flowchart (steps S21 to S30) of FIGS. 15 and 16.

Before starting printing, a user specifies, from the operator panel 407, how many pages are to be printed, before the cutter 402A performs a cutting operation in the paper handler 402 (see arrow (1) in FIG. 14). The control processor 405 notifies the mechanism controller 406 of the specified number of pages (see arrow (2) in FIG. 14).

Figure 15:
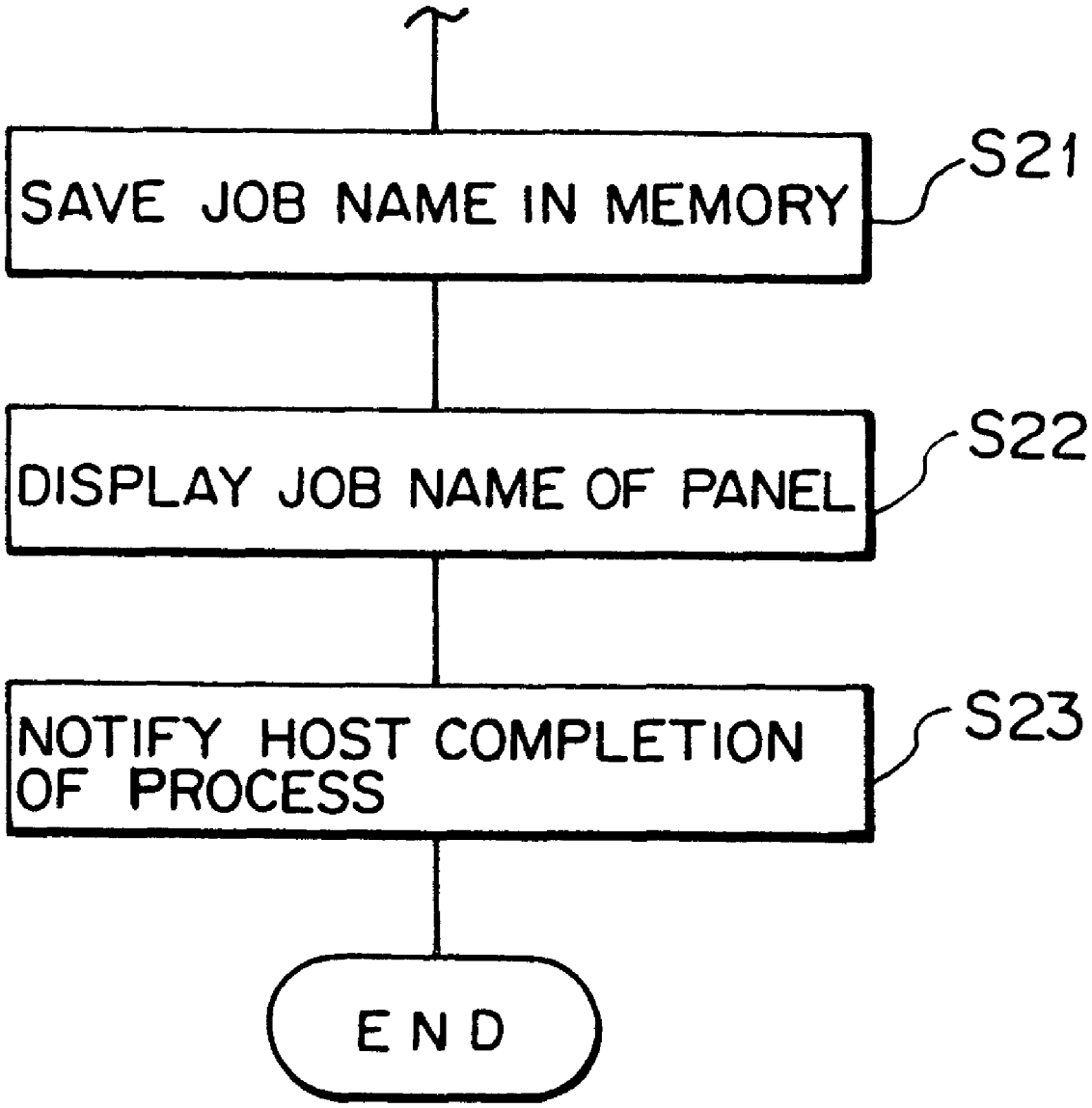
FIG. 15 is a flowchart illustrating the operation of the second embodiment (i.e., the procedure for displaying a job name)

Then, receiving an instruction for job name display from the host computer 403 before printing starts, the control processor 405 follows the procedure for displaying a job name, as shown in FIG. 15.

That is, reading a job name for printing from the host computer 403 (see arrow (3) in FIG. 14), the control processor 405 saves the read job name in the memory 410 at the job name storage area 410A (step S12, see arrow (4) in FIG. 14) and displays, on the display 407A, on the operator panel 407, as shown in FIG. 18 (step S22, see arrow (5) in FIG. 14). After displaying the job name, the control processor 405 notifies the host computer 403 that the display has been completed (step S23).

Subsequently, the control processor 405 reads print data corresponding to the job name from the host computer 403 (see arrow (6) in (FIG. 14), analyzes the print data, and expands the analyzed print data in the character BMMs 408A, 408B or the overlay BMMs 409A, 409B (see arrow (7) in FIG. 14).

Receiving an instruction to begin printing from the control processor 405, the hardware controller 411 reads the expanded print data from the BMMs 408A, 408B, 409A, 409B (see arrow (8) in FIG. 14) and controls the printer engine 412 so as to form an electrostatic latent image of patterns corresponding to the print data on the surface of the drum 413. Then, toner is supplied to develop a toner image from the electrostatic latent image, and the thus-developed toner image is transferred onto the continuous paper 400 for printing thereon.

Figure 16:
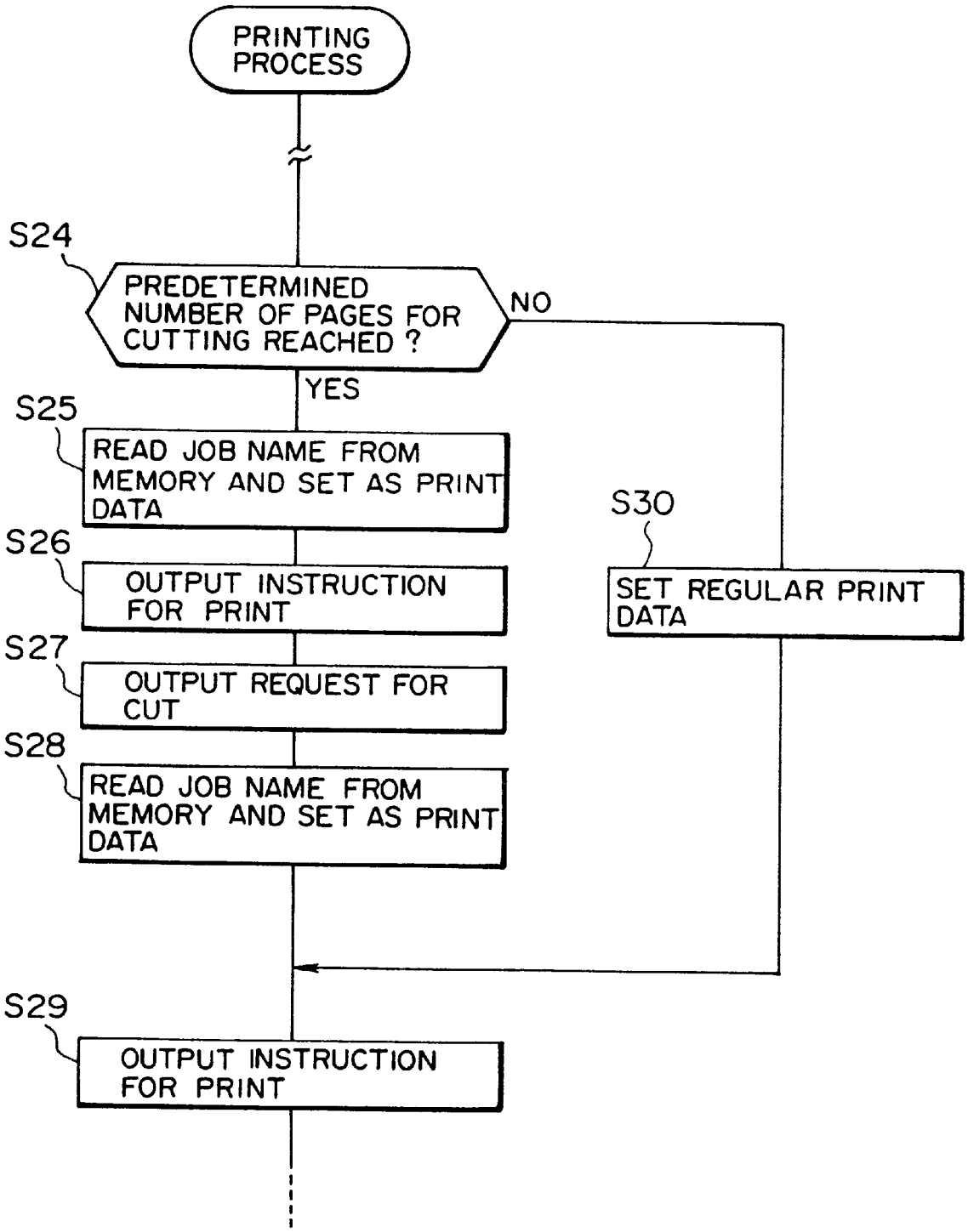
FIG. 16 is a flowchart illustrating the operation of the second embodiment (i.e., the procedure for printing an intermediate separator)

During the above printing process, the control processor 405 follows the procedure of FIG. 16 for printing an intermediate separator.

That is, the control processor 405 determines whether or not an instruction to begin cutting (see arrow (9) in FIG. 14) is received from the mechanism controller 406, thereby determining whether or not pages of the continuous paper 400, which have been printed at the printing unit 404, have reached a predetermined number of pages for performing a cutting operation (step S24). If it is judged in step S24, that the number of pages for performing a cutting operation is not reached (i.e., a negative judgment is made), then the control processor 405 expands the regular print data in the BMMs 408A, 408B, 409A, 409B (step S30) and outputs an instruction to the printing unit 404 (step S29) to begin printing, thereby executing an ordinary printing process.

If it is judged in step S24, that the number of pages for performing a cutting operation is reached and if an instruction to begin cutting (see arrow (9) in FIG. 14) is outputted from the mechanism controller 406 (i.e., an affirmative judgment is made), then the control processor 405 reads saved job name information from the job name storage area 410A in the memory 410 (see arrow (10) in FIG. 14) and expands the read job name information in the character BMM 408A (see arrow (12) in FIG. 14) and step S25).

Then, the control processor 405 outputs an instruction to the printing unit 404 (step S26) to begin printing. Receiving the instruction to begin printing, the printing unit 404, as in the ordinary printing process, reads the expanded job name information from the character BMM 408A (see arrow (12) in FIG. 14) and prints the job name (i.e., the name of a job currently being printed, which is displayed on the operator panel 407, for example, "TESTO1," as shown in FIG. 18) on a page, before a cutting position (perforations), to act as an intermediate separator.

Then, the control processor 405 outputs a request to the cutter 402A in the paper handler 402 to begin cutting, so as to cut the continuous paper 400, when a cutting position on the continuous paper 400, reaches the cutting position of the cutter 402A (step S27).

After outputting a request to begin cutting, the control processor 405 reads the saved job name information again, from the job name storage area 410A, in the memory 410 (see arrow (10) in FIG. 14) and expands the job name information in the character BMM 408A (see arrow (11) in FIG. 14 and step S28).

Then, the control processor 405 outputs an instruction to the printing unit 404 (step S29) to begin printing, whereby the job name is printed as an intermediate separator, in the same manner as described above, on a page after the cutting position (perforations), as shown in FIG. 18.

As has been stated above, in the printing apparatus having a paper handling function according to the second embodiment of the present invention, when the continuous paper 400 is cut by the cutter 402A in the midst of printing one job, the control processor 405 and the printing unit 404 are adapted to read a job name for print data being currently printed from the job name storage area 410A in the memory 410 and print the read job name on a page before and after a cutting position, as shown in FIG. 18.

That is, job name information which is conventionally transmitted from the host computer 403 for display use can be used for printing the job name as an intermediate separator. Thus, even when the printed continuous paper 400 for one job is divided into blocks by cutting, a user can easily determine which block of the printed continuous paper 400 is for which job, by referring to a job name printed as an intermediate separator on each block of the continuous paper 400, whereby confusion of printed results due to divided print data can be prevented.

Accordingly, an intermediate separator can be printed without greatly modifying the hardware configuration of an existing printing apparatus or adding new hardware components and without modifying software on the side of the host computer 403. Thus, when a paper handling function involving cutting paper is introduced, required man-hours can be greatly reduced.

(b1) First modification of second embodiment

Figure 19:
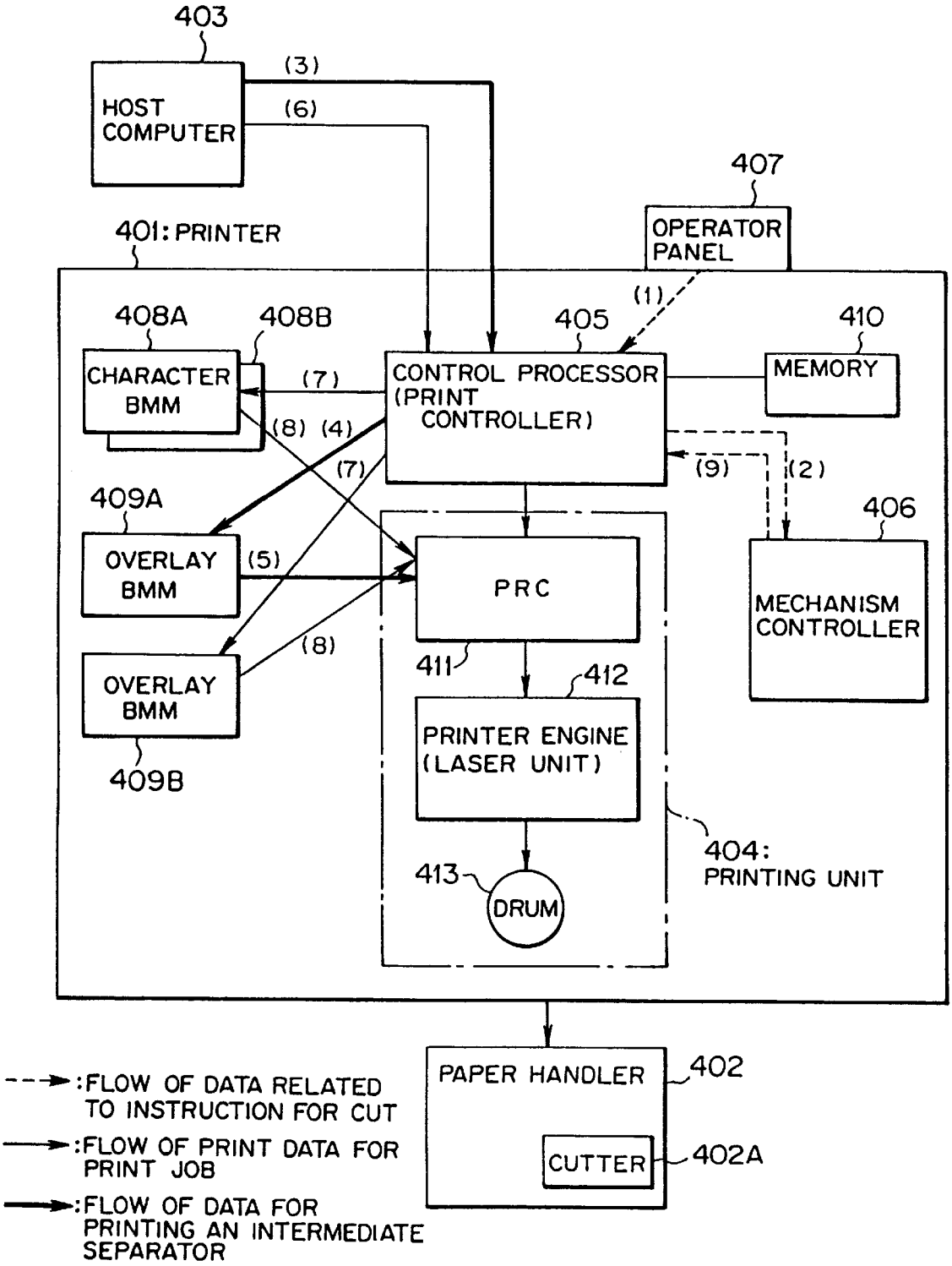
FIG. 19 is a block diagram showing the structure of a printing apparatus having a paper handling function according to a first modification of the second embodiment of the present invention.

FIG. 19 is a block diagram showing a printing apparatus having a paper handling function according to a first modification of the second embodiment of the present invention. As shown in FIG. 19, the printing apparatus, according to the first modification of the second embodiment, is basically of the same structure as in FIG. 14, but is different in that pre-registered pattern data (here, an overlay pattern) is printed as an intermediate separator in place of a job name as described above.

Thus, in the first modification of the second embodiment, the host computer 403 registers an overlay pattern, which is pattern data about an intermediate separator, in the existing overlay BMM (storage, an overlay memory) 409A.

In distinction from the second embodiment where a job name is printed, when the cutter 32 cuts the continuous paper 400 in the midst of printing one job, the control processor 405, according to the first modification of the second embodiment, controls the printing unit 404 so as to print an overlay pattern, which is stored in the overlay BMM 409A, on a page before and after a cutting position, to act as an intermediate separator.

Figure 20:
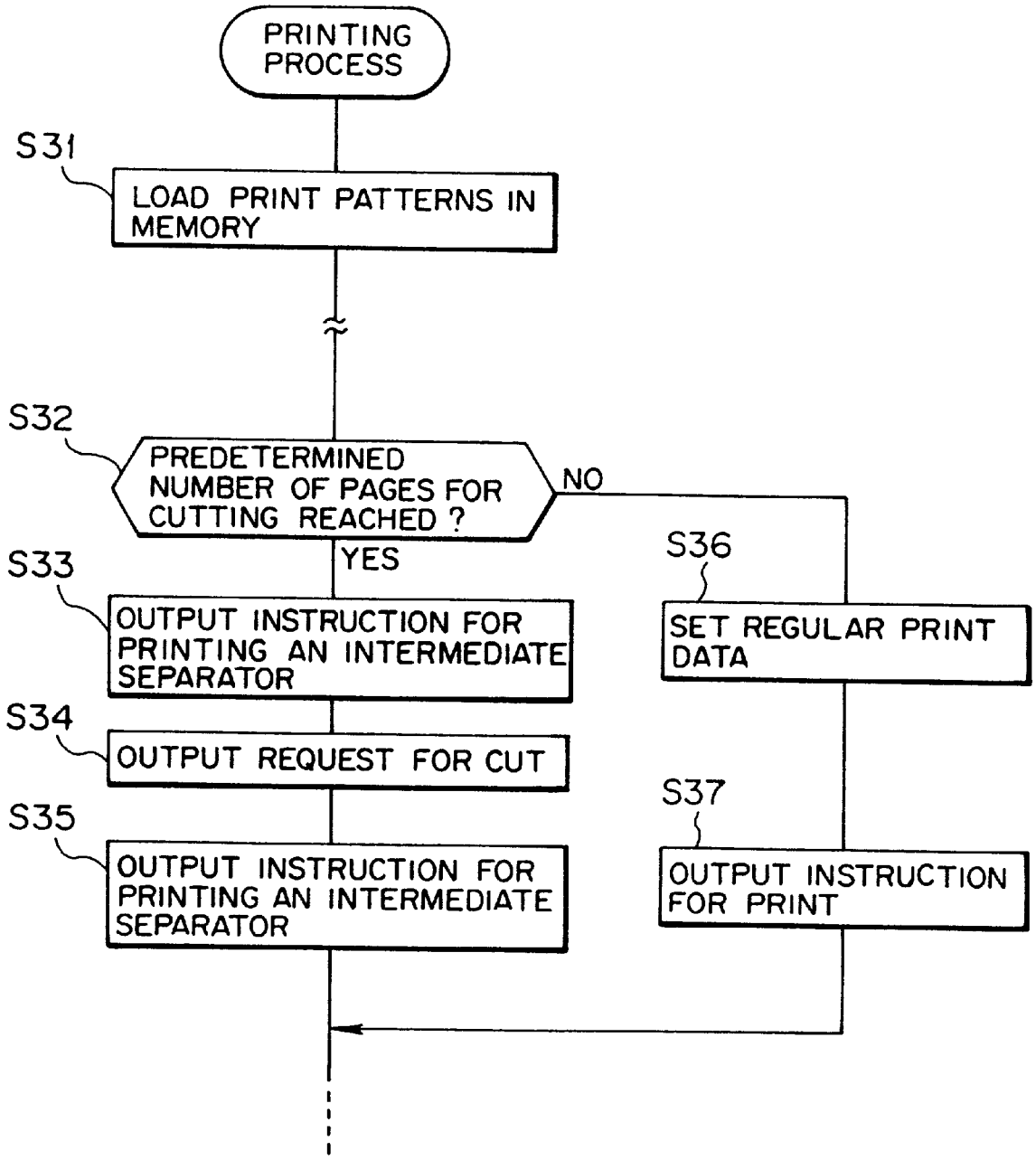
FIG. 20 is a flowchart illustrating the operation of the first modification of the second embodiment (i.e., the procedure for printing an intermediate separator)

The operation of the thus-constructed printing apparatus, according to the first modification of the second embodiment, will now be described with reference to a block diagram shown in FIG. 19 and a flowchart (steps S31 to S37) shown in FIG. 20.

Before starting printing, a user specifies from the operator panel 407 how many pages are to be printed before the cutter 402A performs a cutting operation in the paper handler 402 (see arrow (1) in FIG. 19). The control processor 405 notifies the mechanism controller 406 of the specified number of pages (see arrow (2) in FIG. 19).

Then, reading data about an intermediate separator (overlay pattern) from the host computer 403 (see arrow (3) in FIG. 19), the control processor 405 expands and saves the read data in the overlay BMM 409A (step S31, see arrow (4) in FIG. 19). After this, the overlay BMM 409A is used for saving an overlay pattern, which is printed as an intermediate separator.

Subsequently, the control processor 405 reads print data from the host computer 403 (see arrow (6) in FIG. 19), analyzes the print data, and expands the analyzed print data in the character BMMs, 408A, 408B or the overlay BMM 409B (see arrow (7) in FIG. 19).

Receiving an instruction print from the control processor 405 to begin printing, the hardware controller 411 reads the expanded print data from the BMMs 408A, 408B, 409B (see arrow (8) in FIG. 19) and controls the printer engine 412 so as to form an electrostatic latent image of patterns corresponding to the print data on the surface of the drum 413. Then, toner is supplied to develop a toner image from the electrostatic latent image, and the thus-developed toner image is transferred onto the continuous paper 400 for printing thereon.

During the above printing process, the control processor 405 determines whether or not an instruction to begin cutting (see arrow (9) in FIG. 19) is received from the mechanism controller 406, thereby determining whether or not pages of the continuous paper 400, which have been printed at the printing unit 404, have reached a predetermined number of pages for performing a cutting operation (step S32). If it is judged in step S32 that the number of pages for performing a cutting operation is not reached (i.e., a negative judgment is made), then the control processor 405 expands the regular print data in the BMMs 408A, 408B, 409B (step S36) and outputs an instruction to begin printing to the printing unit 404 (step S37), thereby executing an ordinary printing process.

If it is judged in step S32 that the number of pages for performing a cutting operation is reached and if an instruction to begin cutting (see arrow (9) in FIG. 19) is outputted from the mechanism controller 406 (i.e., an affirmative judgment is made), then the control processor 405 outputs an instruction to begin printing an intermediate separator to the printing unit 404 (step S33).

Receiving the instruction to begin printing an intermediate separator, the printing unit 404 reads a previously expanded overlay pattern from the overlay BMM 409A (see arrow (5) in FIG. 19) and prints the overlay pattern on a page before a cutting position (perforations) as an intermediate separator, as shown in FIG. 21.

Then, the control processor 405 outputs a request to begin cutting to the cutter 402A in the paper handler 402 so as to cut the continuous paper 400 when a cutting position on the continuous paper 400 reaches the cutting position of the cutter 402A (step S34).

After outputting a request to begin cutting, the control processor 405 again outputs an instruction to begin printing an intermediate separator to the printing unit 404 (step S35). Receiving the instruction to begin printing an intermediate separator, the printing unit 404 reads a previously expanded overlay pattern from the overlay BMM 409A (see arrow (5) in FIG. 19) and prints the overlay pattern on a page after a cutting position (perforations) as an Intermediate separator, as shown in FIG. 21.

As has been stated above, also, in the printing apparatus having a paper handling function according to the first modification of the second embodiment of the present invention, when the continuous paper 400 is cut by the cutter 402A in the midst of printing one job, the control processor 405 and the printing unit 404 are adapted to print an overlay pattern, which is previously expanded and registered in the overlay pattern BMM 409A, on a page before and after a cutting position as an intermediate separator, as shown in FIG. 21.

Thus, even when the printed continuous paper 400 for one job is divided into blocks by cutting, a user can easily determine which block of the printed continuous paper 400 is for which job, by referring to an overlay pattern printed as an intermediate separator on each block of the continuous paper 400, whereby confusion of printed results due to divided print data can be prevented.

By registering pattern data in the existing overlay BMM 409A as an overlay pattern, there is no need for preparing a new storage for storing pattern data, an intermediate separator can be printed without greatly modifying the hardware configuration of an existing printing apparatus or adding new hardware components and without modifying software on the side of the host computer 403. Thus, when a paper handling function involving cutting paper is introduced, required man-hours can be greatly reduced.

(b2) Second modification of second embodiment

Figure 22:
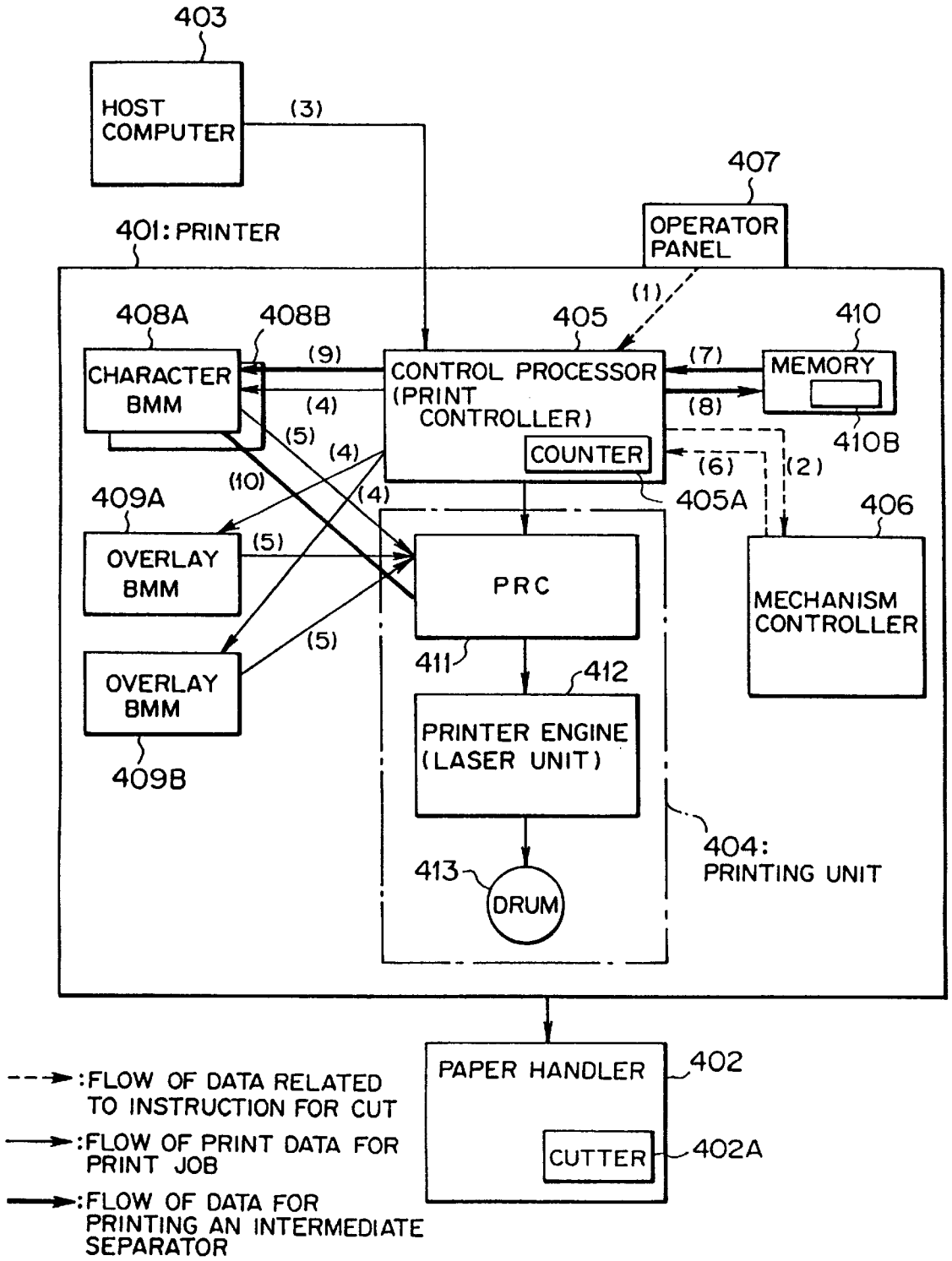
FIG. 22 is a block diagram showing the structure of a printing apparatus having a paper handling function according to a second modification of the second embodiment of the present invention.

FIG. 22 is a block diagram showing a printing apparatus having a paper handling function according to a second modification of the second embodiment of the present invention. As shown in FIG. 22, the printing apparatus, according to the second modification of the second embodiment, is basically of the same structure as in FIG. 14, but is different in that the order of outputting paper (i.e., a count value of a counter 405A) is printed as an intermediate separator in place of a job name as described earlier.

Thus, in the second modification of the second embodiment, the control processor 405 is provided with a counter 405A, which performs a counting operation at the time of cutting with the cutter 402A in the paper handler 402, and which outputs the thus-counted value, and the memory 410 has a count value storage area 410B for saving a value of the counter 405A.

In distinction from the second embodiment where a job name is printed, when the cutter 32 cuts the continuous paper 400 in the midst of printing one job, the control processor 405, according to the second modification of the second embodiment, controls the printing unit 404 so as to sequentially print a value of the counter 405A (i.e., a value saved in the count value storage area 410B in the memory 410) on a page before and after a cutting position as an intermediate separator.

The counter 405A is adapted to increment a value, saved in the count value storage area 410B in the memory 410, by one each time an intermediate separator is printed on a page before or after a cutting position under the control of the control processor 405. The value "1" is initially stored in the count value storage area 410B in the memory 410.

The operation of the thus-constructed printing apparatus, according to the second modification of the second embodiment, will now be described with reference to a block diagram shown in FIG. 22 and a flowchart (steps S41 to S49) shown in FIG. 23.

Before starting printing, a user specifies, from the operator panel 407, how many pages are to be printed, before the cutter 402A performs a cutting operation in the paper handler 402 (see arrow (1) in FIG. 22). The control processor 405 notifies the mechanism controller 406 of the specified number of pages (see arrow (2) in FIG. 22).

Then, the control processor 405 reads print data from the host computer 403 (see arrow (3) in FIG. 22), analyzes the print data, and expands the analyzed print data in the character BMMs 408A, 408B or the overlay BMMs 409A, 409B (see arrow (4) in FIG. 22).

Receiving an instruction to begin printing from the control processor 405, the hardware controller 411 reads the expanded print data from the BMMs 408A, 408B, 409A, 409B (see arrow (5) in FIG. 22) and controls the printer engine 412 so as to form an electrostatic latent image of patterns corresponding to the print data on the surface of the drum 413. Then, toner is supplied to develop a toner image from the electrostatic latent image, and the thus-developed toner image is transferred onto the continuous paper 400 for printing thereon.

During the above-described printing process, the control processor 405 determines whether or not an instruction to begin cutting (see arrow (6) in FIG. 22) is received from the mechanism controller 406, thereby determining whether or not pages of the continuous paper 400, which have been printed at the printing unit 404, have reached a predetermined number of pages for performing a cutting operation (step S41). If it is judged in step S41 that the number of pages for performing a cutting operation is not reached (i.e., a negative judgment is made), then the control processor 405 expands the regular print data in the BMMs 408A, 408B, 409A, 409B (step S49) and outputs an instruction to begin printing to the printing unit 404 (step S48), thereby executing an ordinary printing process.

If it is judged in step S41 that the number of pages for performing a cutting operation is reached and if an instruction to begin cutting (see arrow (6) in FIG. 22) is outputted from the mechanism controller 406 (i.e., an affirmative decision is made), then the control processor 405 reads a saved count value from the count value storage area 410B in the memory 410 (see arrow (7) in FIG. 22) and expands the read count value in the character BMM 408A (see arrow (9) in FIG. 22, step S42).

The control processor 405 again saves, into the count value storage area 410B, a value which is obtained by incrementing the read count value by one at the counter 405A (see arrow (8) in FIG. 22, step S43).

Then, the control processor 405 outputs an instruction to the printing unit 404 (step S44) to begin printing. Receiving the instruction to begin printing, the printing unit 404, as in the ordinary printing process, reads the expanded count value from the character BMM 408A (see arrow (10) in FIG. 22) and prints the read count value (1, 3, . . . ) on a page, before a cutting position (perforations), as an intermediate separator, as shown in FIG. 23.

Then, the control processor 405 outputs a request to begin cutting to the cutter 402A in the paper handler 402 so as to cut the continuous paper 400 when a cutting position on the continuous paper 400 reaches the cutting position of the cutter 402A (step S45).

After outputting a request to begin cutting, the control processor 405 again reads a saved count value from the count value storage area 410B in the memory 410 (see arrow (7) in FIG. 22) and expands the read count value in the character BMM 408A (see arrow (9) in FIG. 22, step S46).

Also, the control processor 405 again saves, into the count value storage area 410B, a value which is obtained by incrementing the read count value by one at the counter 405A (see arrow (8) in FIG. 22, step S47).

Then, the control processor 405 outputs an instruction to the printing unit 404 (step S48) to begin printing. Receiving the instruction to begin printing, the printing unit 404, as described earlier, prints a count value (2, 4, . . . ) on a page after a cutting position (perforations) as an intermediate separator, as shown in FIG. 23.

As has been stated above, in the printing apparatus having a paper handling function, according to the second modification of the second embodiment of the present invention, when the continuous paper 400 is cut by the cutter 402A in the midst of printing one job, the control processor 405 and the printing unit 404 are adapted to access the count value storage area 410B in the memory 410 for a value which has been counted by the counter 405A at the time of cutting and to print the thus-read count value on a page before and after a cutting position as an intermediate separator, as shown in FIG. 23.

Thus, even when the printed continuous paper 400 for one job is divided into blocks by cutting, a user can easily determine the connection relationship among blocks of the printed continuous paper 400, whereby confusion of printed results due to divided print data can be prevented.

Since the function of the counter 405A can be easily implemented by software means and as one of the functions of the control processor 405, also in the second modification of the second embodiment, an intermediate separator can be printed without greatly modifying the hardware configuration of an existing printing apparatus or adding new hardware components and without modifying software on the side of the host computer 403. Thus, when a paper handling function involving cutting paper is introduced, required man-hours can be greatly reduced.

Figure 24:
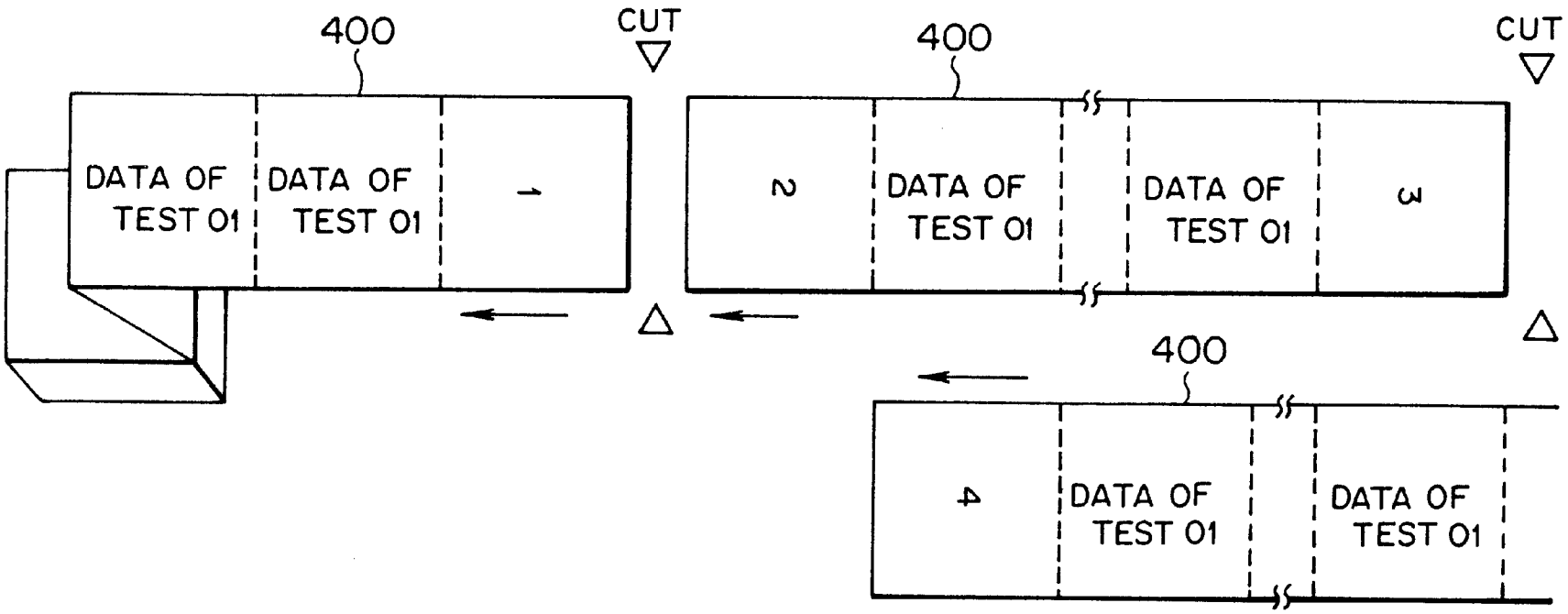
FIG. 24 is a view exemplifying printed intermediate separators in the second modification of the second embodiment.

In the second modification of the second embodiment which has been described above with reference to FIGS. 23 and 24, a count value for a page before a cutting position is incremented by one to make a count value for a page after the cutting position. However, the same count value may be printed as an intermediate separator on a page before and after a cutting position, and the counter 405A may be incremented by one each time cutting is performed.

(c) Third embodiment

Figure 25:
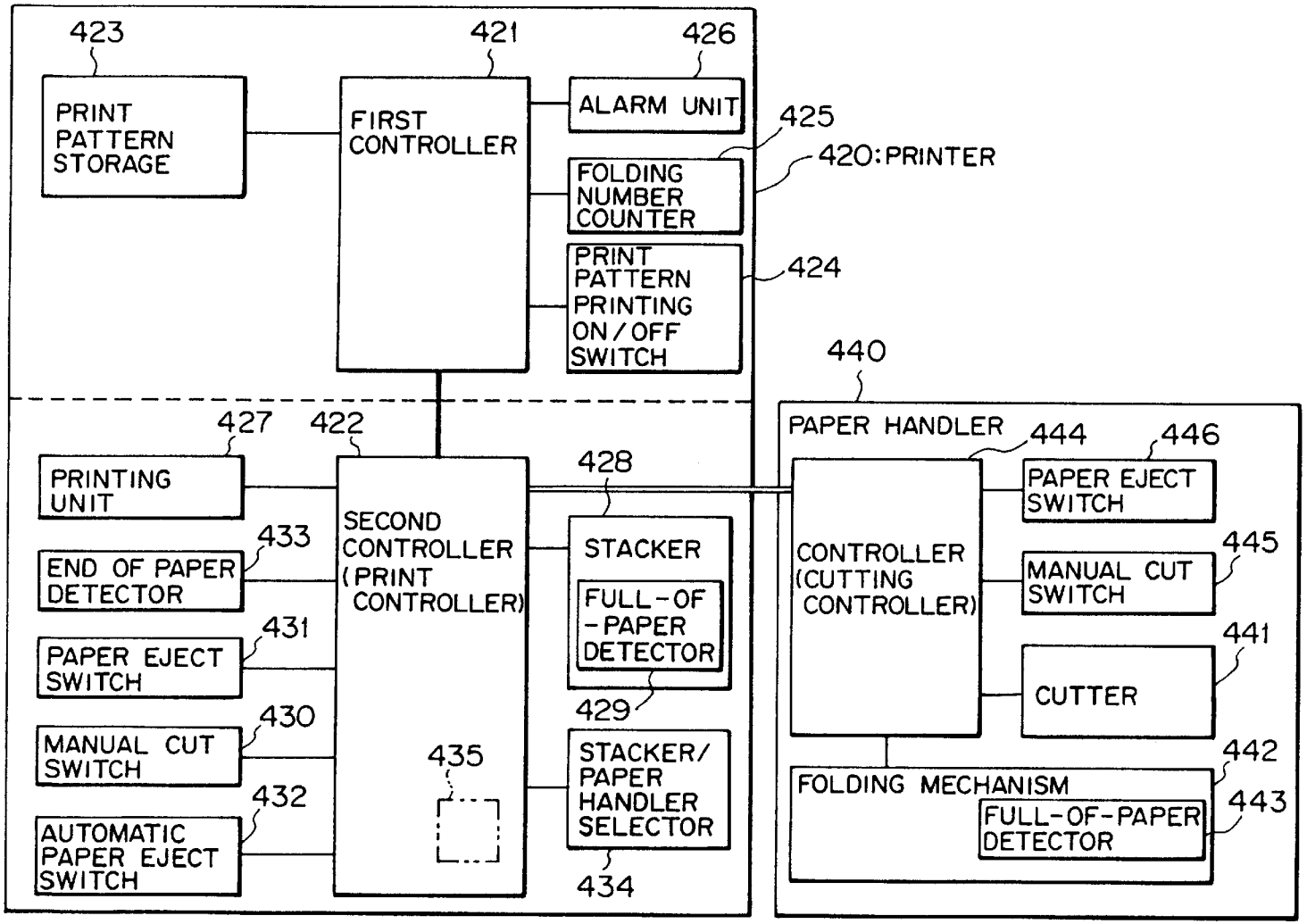
FIG. 25 is a block diagram showing the structure of a printing apparatus having a paper handling function according to a third embodiment of the present invention.

FIG. 25 is a block diagram showing a printing apparatus having a paper handling function according to a third embodiment of the present invention. As shown in FIG. 25, the printing apparatus according to the third embodiment is also composed of a printer 420 and a paper handler 440, which is connected to the printer 420 on the paper handler's stage side (on the paper eject side). The paper handler 440 is basically of the same structure as the paper handler 3, which has been described above with reference to FIG. 3.

The printer 420, according to the third embodiment, is roughly divided into two portions. One is controlled by a first controller 421, and the other is controlled by a second controller 422.

The first controller 421 is connected to a host apparatus, or a host computer (not shown) and transmits data to and from the host computer. A print pattern storage 423, a print pattern printing on/off switch 424, an folding number counter 425, and an alarm unit 426 are connected to the first controller 421. The features 423 to 426 will be described in further detail below.

The second controller 422 serves basically as a print controller for controlling a printing unit (recording unit) 427, which prints on continuous paper (not shown). A stacker 428, a full-of-paper detector 429, a manual cut switch 430, a paper eject switch 431, an automatic paper eject switch 432, an end-of-paper detector 433, and a stacker/paper handler selector switch 434, are connected to the second controller 422. The features 428 to 434 will be described in further detail below. The printing unit 427 (not shown in FIG. 25), according to the third embodiment, is also provided with a feature similar to the printing process section 10 shown in FIG. 2.

The paper handler 440, according to the third embodiment, is fed with continuous paper, which has undergone printing for each job in the printer 420, and handles the printed continuous paper. The paper handler 440 is provided with a cutter (cutting mechanism) 441, a folding mechanism (stacker) 442, a full-of-paper detector 443, a controller 444, a manual cut switch 445, and a paper eject switch 446.

The cutter 441 is adapted to cut continuous paper along perforations. The folding mechanism 442 is adapted to fold and stack printed continuous paper. The full-of-paper detector 443 is adapted to detect the state when the folding mechanism 442 becomes full of continuous paper.

The manual cut switch 445 is operated by a user or similar and adapted to input, to the controller 444, an instruction to begin cutting continuous paper with the cutter 441. The paper eject switch 446 is operated by a user or similar and adapted to input, to the controller 444, an instruction to begin ejecting continuous paper to the folding mechanism 442.

The controller 444 exercises general control over the paper handler 440 and has a function, as a cutting controller, for controlling the cutting operation of the cutter 441. That is, the controller 444 controls the cutter 441 so as to perform a cutting operation in response to an instruction to begin cutting from the second controller 422 in the printer 420 or an instruction to begin cutting, which is output as a result of a user operating the manual cut switch 445.

The second controller 422 in the printer 420 outputs an instruction to begin cutting to the controller 444, when the full-of-paper detector 443 detects the state when the folding mechanism 442 is full of paper or when a user operates the manual cut switch 430 on the printer 420 as will be described below.

The controller 444 exercises control so as to eject continuous paper to the folding mechanism 442 in response to an instruction to eject paper, which is received from the second controller 422 in the printer 420, or an instruction to eject paper, which has been output as a result of a user operating the paper eject switch 446 on the paper handler 440.

On the other hand, receiving print information from a host computer, the first controller 421 instructs the second controller 422 to print on the basis of the received print information.

The print pattern storage 423 stores at least one page of print pattern (hereinafter the print pattern may be referred to as a job continuation indicator pattern) indicating a job being continued (i.e., printing for a job not yet completed). The print pattern printing on/off switch 424 (print mode setting unit) is used for selecting a mode for printing or not printing a job continuation indicator pattern. The following description of the third embodiment assumes that a mode for printing a job continuation indicator pattern is selected with the print pattern printing on/off switch 424.

The folding number counter 425 counts, on the basis of print information received from the host computer, a number of folding portions of continuous paper which is folded along perforations. The second controller 422 uses a count value of the folding number counter 425 in determining on what page a job continuation indicator pattern is printed.

The alarm unit 426 gives off or sounds the alarm (by sounding a buzzer, lighting a lamp or similar) to a user or similar, when the second controller 422 instructs the printing unit 427 to print a job continuation indicator pattern.

The stacker 428 is provided in the printer 420 for containing printed continuous paper which is folded along perforations. Printed continuous paper is stacked in the stacker 428 when the stacker 428 is selected with the stacker/paper handier selector switch 434 and thus, when a destination of ejected paper is switched to the stacker 428 under the control of the second controller 422. The following description of the third embodiment assumes that the paper handler 440 is selected with the stacker/paper handler selector switch 434 and thus, that a destination of ejected paper is switched to the paper handler 440 under the control of the second controller 422, to thereby stack the continuous paper in the folding mechanism 442 in the paper handler 440.

The full-of-paper detector 429 is adapted to detect the state that the stacker 428 is full of continuous paper. The manual cut switch 430 is operated by a user or similar and adapted to input, to the second controller 422, an instruction to being cutting continuous paper with the cutter 441. The paper eject switch 431 is operated by a user or similar and adapted to input, to the second controller 422, an instruction for ejecting continuous paper to the folding mechanism 442 (or stacker 428).

The automatic paper eject switch 432 is adapted to select the automatic paper eject mode for automatically ejecting residual continuous paper without printing thereon, when paper runs out during printing. The end-of-paper detector 433 is adapted to detect the end of continuous paper (paper runout) contained in a hopper (not shown) or similar in the printer 420.

In the third embodiment, a job continuation indicator pattern is previously stored in the print pattern storage 423, which is connected to the first controller 421, but may be previously stored in a print pattern storage 435 (in actuality, a partial area of the memory), which is prepared in the second controller 422 as represented with a two-dot-and-dashed line.

In addition to controlling the printing operation of the printing unit 427 in response to an instruction to begin printing received from the first controller 421, the second controller 422 exercises control so as to eject continuous paper to the folding mechanism 442 (or the stacker 428) in response to an instruction to eject paper, which is outputted by a user operating the paper eject switch 431, or in the automatic paper eject mode which is established by a user operating the automatic paper eject switch 432.

When the full-of-paper detector 443, in the paper handler 440, detects the state, during printing one job, that the folding mechanism 442 has become full of paper, the second controller 422, according to the third embodiment, outputs an instruction to begin cutting continuous paper to the controller 444 in the paper handler 440, and also reads a pattern indicating job continuation (a job continuation indicator pattern) from the print pattern storage 423 (or the print pattern storage 435) via the first controller 421 and instructs the printing unit 427 to print the pattern on continuous paper to be parted from the printer side.

The second controller 422 instructs the printing unit 427, based on a count value of the folding number counter 425, to print a job continuation indicator pattern on a page which will become a top face (i.e., skip, for an outside print face), when the parted continuous paper is stacked in the folding mechanism 442.

The second controller 422 is adapted to instruct the printing unit 427 to print a job continuation indicator pattern only when the paper handler 440 is in use. That is, when the folding mechanism 442 in the paper handler 440 is selected as a destination of ejected paper with the stacker/paper handler selector switch 434.

Furthermore, the second controller 422, according to the third embodiment has the following control functions (1) to (3).

(1) When an instruction to begin cutting continuous paper, with the cutter 441, is inputted by a user operating the manual cut switch 430 or 446, and when the full-of-paper detector 443 detects the state that the folding mechanism 442 is full of paper, the second controller 422 outputs an instruction to begin cutting continuous paper to the controller 444, and also reads a job continuation indicator pattern from the print pattern storage 423 (or the print pattern storage 435) and instructs the printing unit 427 to print the pattern on the continuous paper to be parted from the printer side.

(2) When an instruction to begin ejecting continuous paper, to the folding mechanism 442, is inputted by a user operating the paper eject switch 431 or 446, and when the full-of-paper detector 443 detects the state that the folding mechanism 442 is full of paper, the second controller 422 outputs an instruction to begin cutting continuous paper to the controller 444, and also reads a job continuation indicator pattern from the print pattern storage 423 (or the print pattern storage 435) and instructs the printing unit 427 to print the pattern on the continuous paper to be parted from the printer side, and then lets a paper ejection operation be performed.

(3) When the automatic paper eject mode is selected by a user operating the automatic paper eject switch 432, and the end-of-paper detector 433 detects that continuous paper has run out, the second controller 422 outputs an instruction to begin cutting continuous paper to the controller 444, and instructs the printing unit to print a job continuation indicator pattern on the continuous paper, and then lets an automatic paper ejecting operation be performed.

Figure 26:
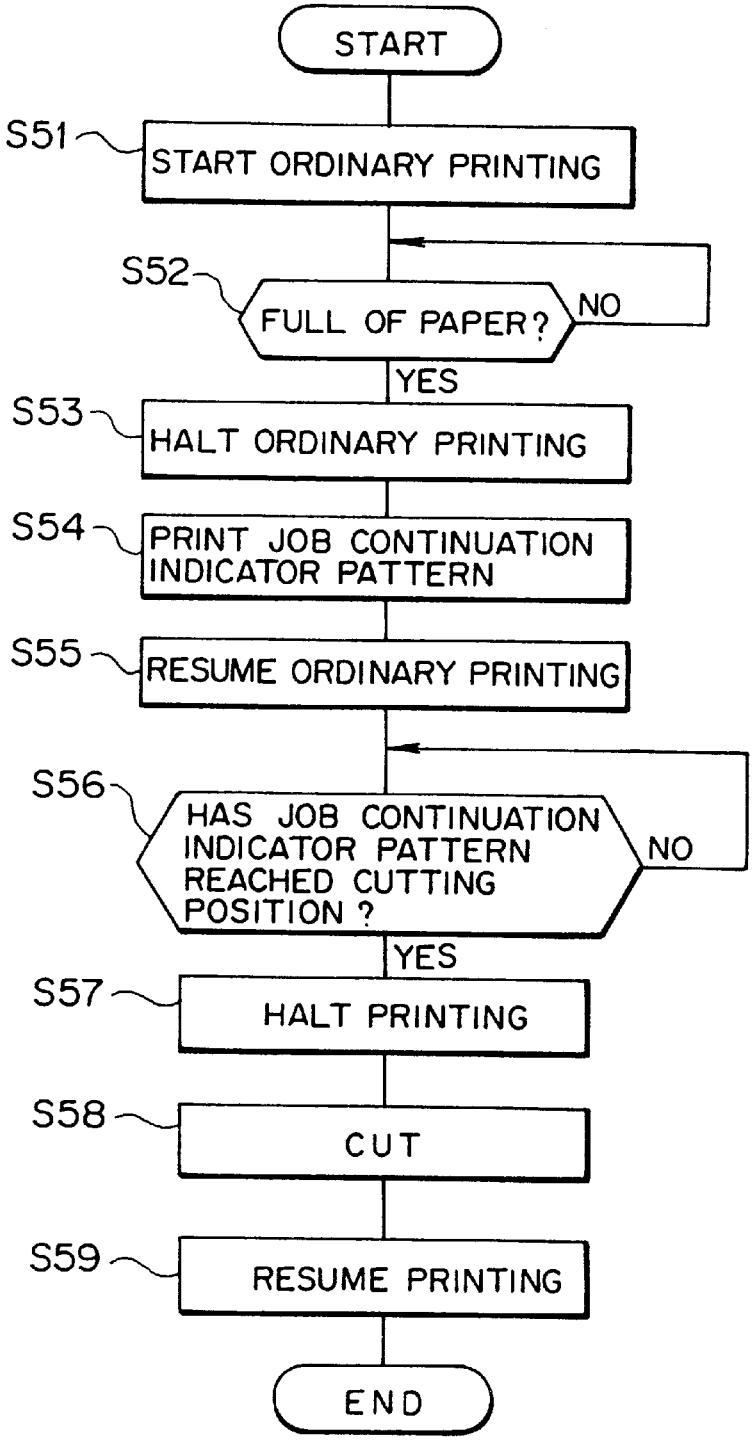
FIG. 26 is a flowchart illustrating the operation of the third embodiment.

The basic operation of the thus-constructed printing apparatus, according to the third embodiment, will be described with reference to a flowchart (steps S41 to S59) shown in FIG. 26.

When ordinary printing starts under the control of the second controller 422 (step S51) while the first controller 421 is receiving print data from the host computer, continuous paper, which has undergone printing at the printing unit 427, is ejected from the printer 420 to the paper handler 440. The thus-ejected printed continuous paper is folded along perforations and stacked in the folding mechanism 442 in the paper handler 440.

In the folding mechanism 442, the full-of-paper detector 443 detects whether the folding mechanism 442 is full of continuous paper (step S52). If it is detected in step S52 that the folding mechanism 442 is full of paper, then the second controller 422 instructs the printing unit 427 to halt the ordinary printing operation (step S53), reads a job continuation indicator pattern from the print pattern storage 423 (or the print pattern storage 435), and then instructs the printing unit 427 to print the thus-read job continuation indicator pattern on the continuous paper to be parted from the printer side (step S54). A job continuation indicator pattern is printed on a page which will become a top face (i.e., skip, for an outside print face), when the parted continuous paper is stacked in the folding mechanism 442.

Then, the second controller 422 instructs the printing unit 427 to resume ordinary printing (step S55) for printing on the portion of continuous paper which corresponds to a paper path extending from the image transfer position of the printing unit 427 to the cutting position of the cutter 441 in the paper handler 440. Then, the thus-printed portion of continuous paper is fed to the paper handler 440.

When the page printed with a job continuation indicator pattern reaches the cutting position of the cutter 441 (i.e., an affirmative judgment is made in step S56), the second controller 422 instructs the printing unit 427 to halt printing (step S57), outputs an instruction to begin cutting to the controller 444 in the paper handler 440 so as to cut continuous paper with the cutter 441 along perforations which are located at the end of the page printed with a job continuation indicator pattern (step S58), and then instructs the printing unit 427 to resume printing (step S59).

As has been stated above, in the printing apparatus having a paper handling function according to the third embodiment of the present invention, when the full-of-paper detector 443 detects, in the midst of printing one job, the state that the folding mechanism 442 is full of paper, the second controller 422 and the printing unit 427 are adapted to print a job continuation indicator pattern on continuous paper to be parted from the printer side. Accordingly, a job continuation indicator pattern can be reliably printed regardless of a paper thickness, whereby a user can recognize at a glance the state of a job being continued when the folding mechanism 442 becomes full of paper. This reliably prevents a job from splitting and greatly reduces a burden on a user.

Also, when the full-of-paper detector 443 detects that the folding mechanism 442 is full of paper at the time of an instruction to begin cutting or an instruction to eject paper is inputted, or when the end-of-paper detector 433 detects that continuous paper has run out or in any other similar situations, the second controller 422 and the printing unit 427 are adapted to reliably print a job continuation indicator pattern on continuous paper to be parted from the printer side, whereby a user can recognize at a glance the state of a job being continued when the folding mechanism 443 is full of paper. This reliably prevents a job from splitting and contributes to a reduction in a burden on a user.

The print pattern printing on/off switch 424, allows a user to select whether to print a job continuation indicator pattern or not, whereby diversified needs of users can be coped with.

Also, based on the result of counting with the folding number counter 425, a job continuation indicator pattern is printed on a page which will become a top face, when continuous paper, which is parted from the printer side, is stacked in the folding mechanism 442. Accordingly, a job continuation indicator pattern is printed in such a position that a user does not fail to view, whereby the user can recognize more surely the state of a job being continued when the folding mechanism 442 is full of paper. This further contributes to a reduction in a burden on a user.

Furthermore, the alarm unit 426 gives off or sounds the alarm when the printing unit 427 prints a job continuation indicator pattern, thereby reliably notifying a user that the folding mechanism 442 has become full of paper while a job is continuing. This further contributes to a reduction in a burden on a user.

If the second controller 422 is provided with the print pattern storage 435 as represented with a two-dot-and-dashed line in FIG. 25 for storing a job continuation indicator pattern, the second controller 422 can read a job continuation indicator pattern from the print pattern storage 435, not the print pattern storage 423 on the side of the first controller 421. Accordingly, the printing of a job continuation indicator pattern can be handled within a print control system, thereby bringing out an advantage that there is no need for selecting/registering a job continuation indicator pattern from outside the print control system.

(d) Fourth embodiment

Figure 27:
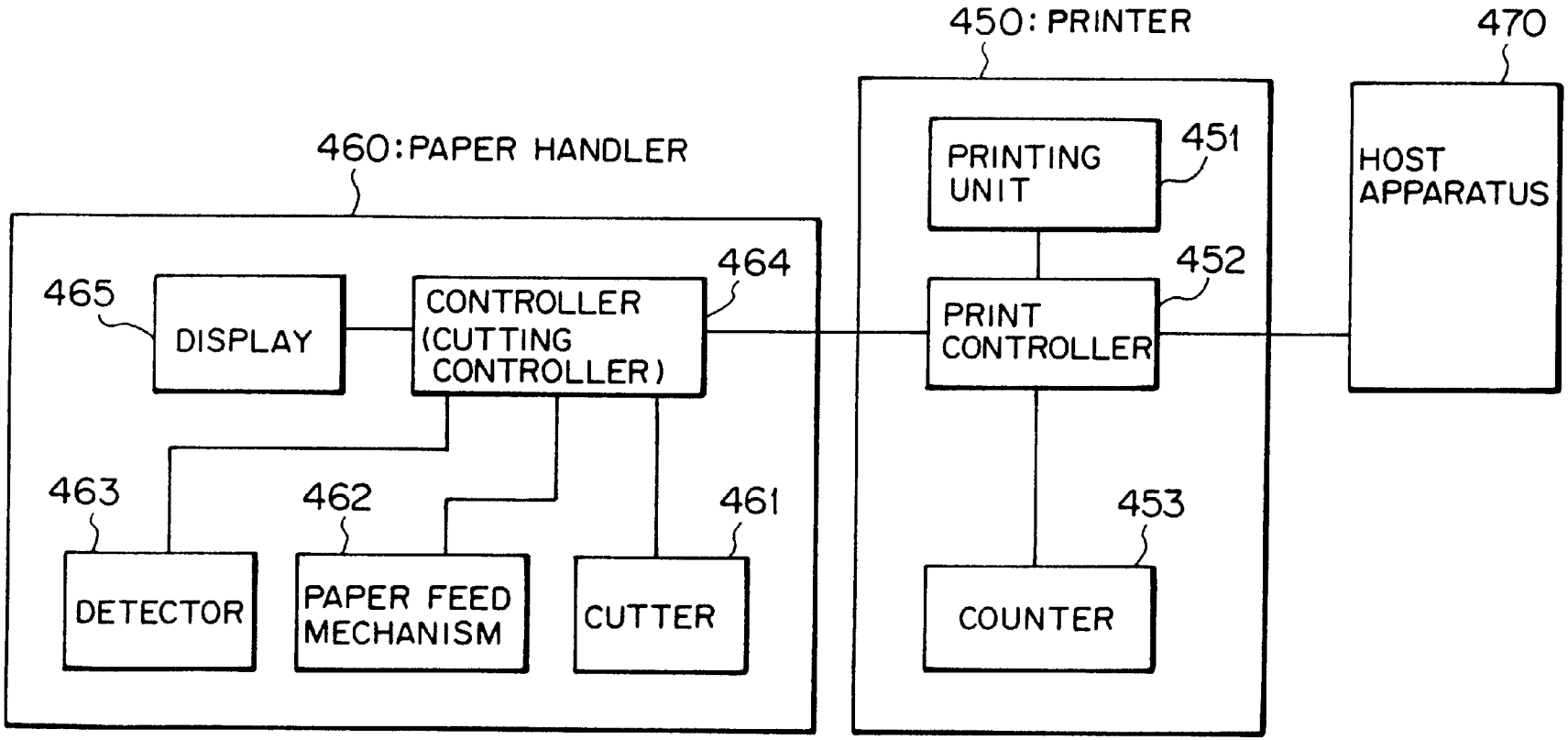
FIG. 27 is a block diagram showing the structure of a printing apparatus having a paper handling function according to a fourth embodiment of the present invention.

FIG. 27 is a block diagram showing a printing apparatus having a paper handling function according to a fourth embodiment of the present invention. As shown in FIG. 27, the printing apparatus, according to the fourth embodiment, is also composed of a printer 450 and a paper handler 460, which is connected to the printer 450, on the paper handler's stage side (i.e., on the paper eject side).

The printer 450 is connected to a host apparatus 470, such as a host computer, and performs printing based on print information which is received from the host apparatus 470. The printer 450 is composed of a printing unit 451, a print controller 452, and a counter 453. The printing unit 451 (not shown in FIG. 27), according to the fourth embodiment, is also provided with a feature similar to the printing process section 10, as shown in FIG. 2.

The printing unit 451 prints on continuous paper (continuous form, not shown) as described above. The print controller 452 controls a printing operation of the printing unit 451 and manages the state of feeding continuous paper in the printer 450. The counter 453 counts pages of recovery printing based on information received from the print controller 452 at recovery printing, to be described further below.

The paper handler 460, according to the fourth embodiment, is fed with continuous paper which has undergone printing in the printer 450 and handles the printed continuous paper. The paper handler 460 has a cutter 461, a paper feed mechanism 462, a detector 463, a controller 464, and a display 465. The paper handler 460 is also basically of the same structure as the paper handler 3 which has been described above with reference to FIG. 3.

The cutter 461 is adapted to cut continuous paper along perforations. The paper feed mechanism 462 buffers continuous paper which is ejected from the printer 450 and feeds the continuous paper from the cutting position of the cutter 461 to a stacking section (not shown in FIG. 27; see table 33 in FIG. 3), where the continuous paper is folded and stacked.

The detector 463 functions as trouble detecting means for detecting the occurrence of trouble which requires recovery printing at the printing unit 451. In the fourth embodiment, the detector 463 detects a trouble, such as a paper jam, which occurs in the section between the image transfer position of the printing unit 451 in the printer 450, and the cutting position of the cutter 461 in the paper handler 460, and is implemented, for example, as an optical sensor. In FIG. 27, the detector 463 is represented as one block, but in actuality a plurality of detectors 463 are arranged in the section extending from the image transfer position to the cutting position so as to detect a paper jam which may occur therein.

The print controller 452 in the printer 450 has a function of recovery printing as will be described further below. According to the recovery printing function, when the detector 463 detects the occurrence of a paper jam and when an operator or similar corrects the paper jam without cutting continuous paper, the print controller 452 instructs the printing unit 451 to reprint the same data for a portion of continuous paper which extends from the image transfer position to the cutting position at the time of the occurrence of the paper jam, i.e., to perform recovery printing.

On the other hand, in response to an instruction from the print controller 452, the controller 464 instructs the cutter 461 to cut continuous paper along perforations for each job or every number of specified pages, as specified by an operator or similar. Also, in response to an instruction from the print controller 452, the controller 464 instructs the paper feed mechanism 462 to feed continuous paper.

Also, when the detector 463 detects the occurrence of a paper jam and when the printer 450 performs recovery printing, the controller 464, according to the fourth embodiment, instructs the cutter 461 to cut continuous paper along perforations before and after a portion of continuous paper which extends from the image transfer position to the cutting position at the time of the occurrence of the paper jam (a portion subject to recovery printing, i.e. a portion which is redundantly printed by recovery printing), thereby cutting off the portion from the continuous paper.

Furthermore, when the printer 450 performs recovery printing, the display 465 indicates the presence of a redundantly printed portion due to recovery printing under control of the controller 464.

The display 465 is located on the paper handler 460 in FIG. 27, but may be located on an operator panel (not shown) on the printer 450. The presence of a redundantly printed portion may be displayed in various ways, including the display of characters on a liquid crystal display or LCD, the lighting of a lamp such as a light emitting diode or LED, and the sounding of a buzzer or similar.

Figure 28:
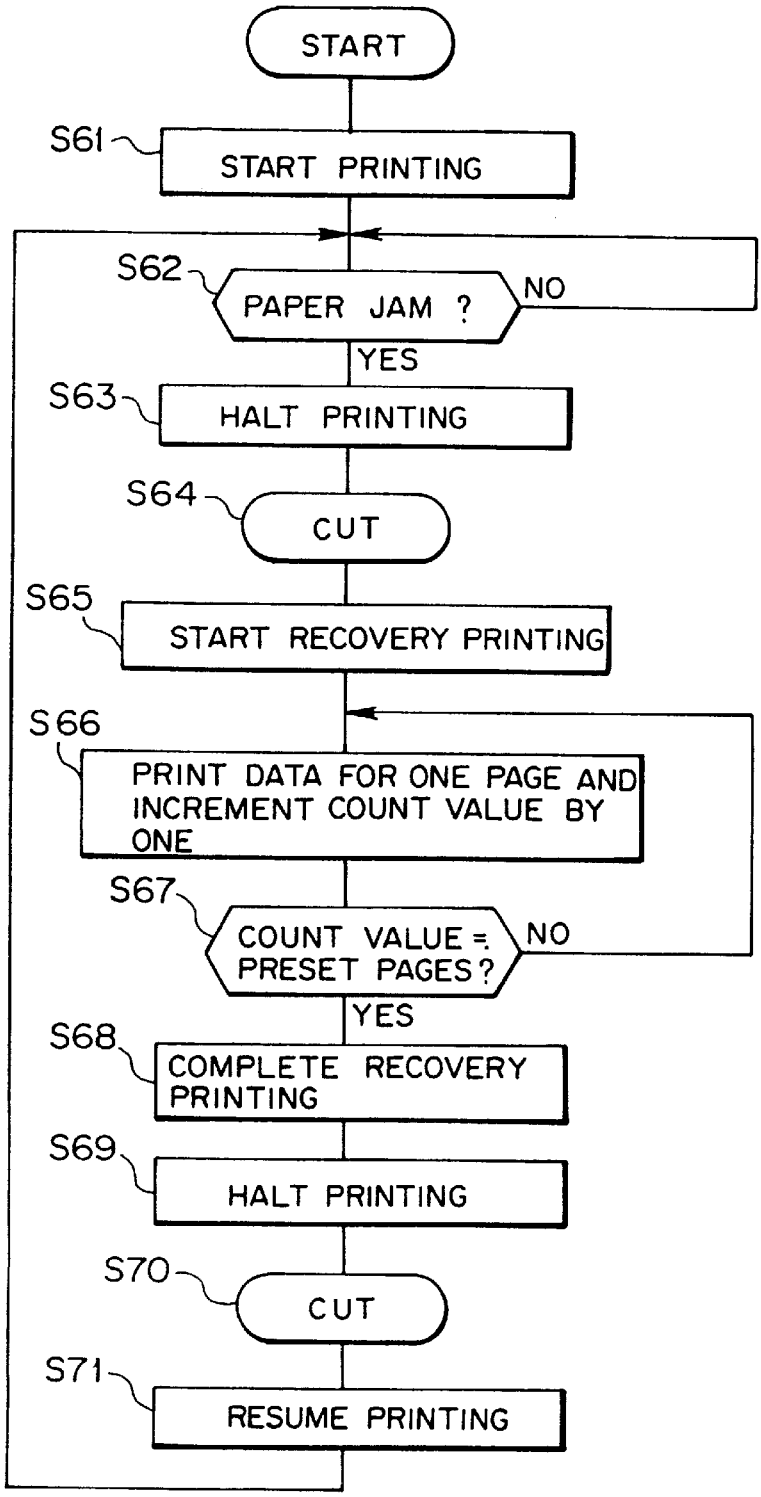
FIG. 28 is a flowchart illustrating the operation of the fourth embodiment.

The operation of the thus-constructed printing apparatus, according to the fourth embodiment, will now be described with reference to a flowchart (steps S61 to S71) shown in FIG. 28.

When the printer 450 starts printing (step S61), the detector 463 continuously monitors whether or not a paper jam has occurred (step S62). When the detector 463 detects a paper jam (i.e., an affirmative judgment is made in step S62), the controller 464 and the print controller 452 are notified of the occurrence of the paper jam, and then the print controller 452 instructs the printing unit 451 to halt printing (step S63).

Also, when a paper jam occurs, it is indicated on a display on the operator panel on the printer 450. Viewing this indication, an operator corrects the paper jam.

When the operator corrects the paper jam without cutting continuous paper and when a command for reprinting is entered to the print controller 452 by the operator pressing a reprint button on the operator panel, the print controller 452 exercises control so as to feed continuous paper until the nearest perforations upstream of the image transfer position of the printing unit 451 come to the image transfer position, and at the same time instructs the controller 464 to feed continuous paper until the nearest perforations upstream of the cutting position of the cutter 461 come to the cutting position.

When printing is halted in step S63, if perforations in continuous paper are located at the cutting position and at the image transfer position, the aforesaid feed control does not need to be exercised.

After exercising the feed control described above, the print controller 452 outputs an instruction to begin cutting to the controller 464, whereby the cutter 461 cuts the continuous paper along the downstream (heading) perforations of a portion subject to recovery printing (step S64).

Then, the print controller 452 instructs the printing unit 451 to start recovery printing for a portion of continuous paper which extends from the image transfer position to the cutting position at the time of the occurrence of a paper jam (step S65).

When recovery printing starts in the printer 450, the counter 453 counts the number of pages of recovery printing based on information transmitted from the print controller 452 (step S66). Then, the print controller 452 determines whether or not the count value has become equal to a preset number of pages (seven pages, for example) (step S67).

The preset number of pages is the number of pages of continuous paper which usually exists in the section between the image transfer position and the cutting position (as described above with reference to FIG. 3, the structure of the apparatus is such that there exists "n" number of pages of continuous paper in the section, wherein "n" is an integer). An operator or similar presets the number of pages according to the size of the continuous paper.

If it is judged in step S67 that the count number becomes equal to the preset number of pages (i.e., an affirmative judgment is made), indicating that a portion subject to recovery printing has all been printed by the printing unit 451, then the print controller 452 completes recovery printing (step S68) and instructs the printing unit 451 to halt printing (step S69).

Then, the print controller 452 outputs an instruction to begin cutting to the controller 464, whereby the cutter 461 cuts continuous paper along the upstream (end) perforations of a portion subject to recovery printing (step S70). Then, the printer 450 resumes ordinary printing (step S71).

As has been stated above, in the printing apparatus having a paper handling function according to the fourth embodiment of the present invention, when the detector 463 detects the occurrence of a paper jam (i.e., a trouble which requires recovery printing), the print controller 452 instructs the controller 464 to being cutting the continuous paper in a position before and after a portion subject to recovery printing, whereby cutting off the portion (i.e. a redundantly printed portion due to recovery printing) from the continuous paper.

Accordingly, a user can easily identify and remove redundant pages due to recovery printing which was performed after the occurrence of the trouble. Thus, a burden on a user can be greatly reduced.

In this connection, the display 465 displays the presence of a redundantly printed portion due to recovery printing, thereby prompting a user to remove the redundantly printed portion. Thus, a burden on a user can be further reduced.

Furthermore, if the offset mechanism 70, which was described above with respect to the first embodiment, stacks the redundantly printed portion which has been cut off from the continuous paper in such a state that the portion is shifted from other printed paper, the presence of the redundantly printed portion will be noticed more definitely. This will further contribute to a reduction in a burden on a user.

(e) Paper feed mechanism and pinch force control system

A paper feed mechanism and a pinch force control system for the printing paper for use in the embodiments which have been described above with reference to FIGS. 1 to 28 will now be described with reference to FIGS. 29 and 30.

Figure 29:
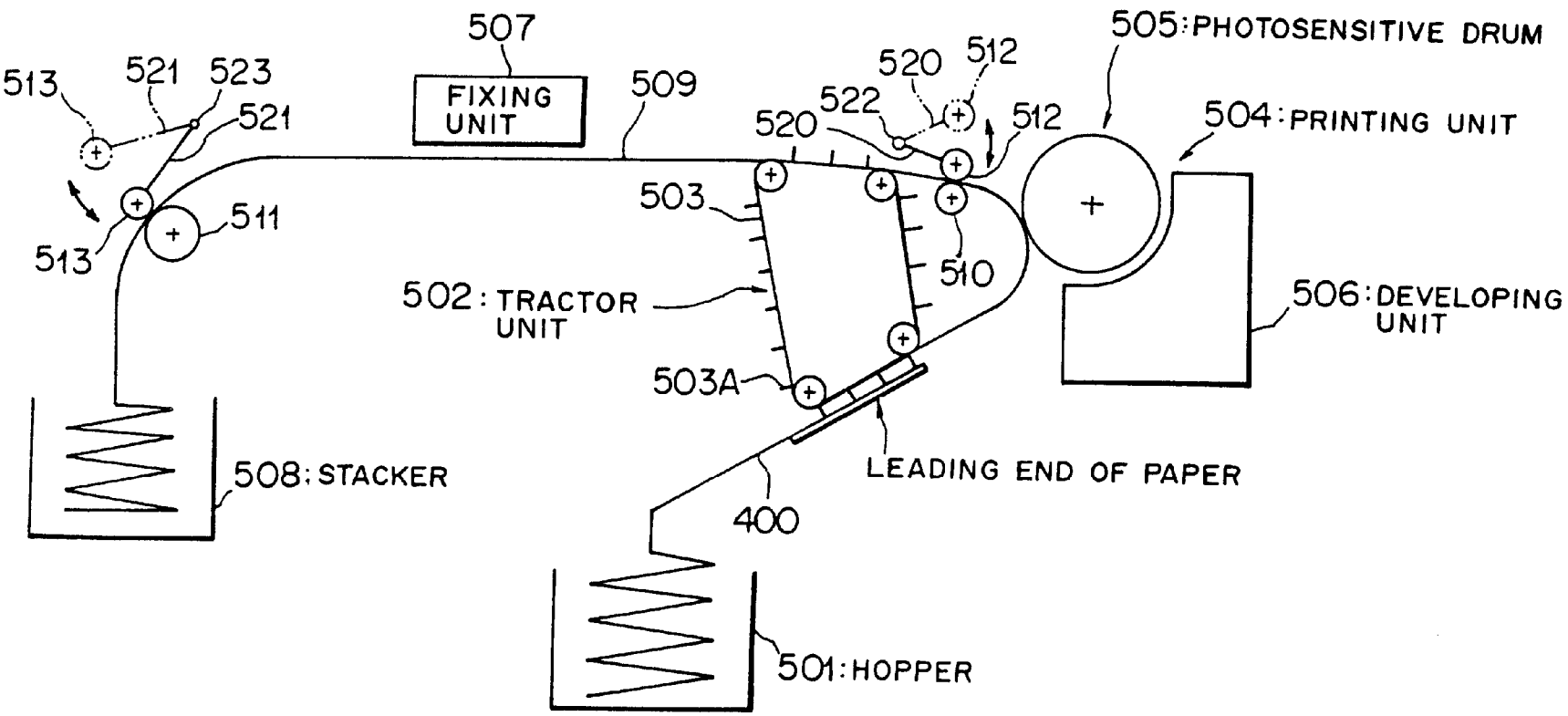
FIG. 29 is a schematic side view of a paper feed mechanism of a printing apparatus.

FIG. 29 is a schematic side view of a paper feed mechanism of a printing apparatus. As shown in FIG. 29, in the printing apparatus for printing on the continuous paper 400, the continuous paper 400 is folded along perforations and contained in a hopper 501. A tractor unit 502 takes out the continuous paper 400 from the hopper 501 and feeds to a printing unit 504, where toner is transferred onto the continuous paper 400.

Then, the continuous paper 400 is fed along a paper path 509 to a fixing unit 507, where the transferred toner is fixed, and then folded along perforations and stacked in a stacker 508 (i.e., corresponding to the table 33 in the first embodiment).

The tractor unit 502 has a belt 503 which is driven by a driving source or motor (not shown), and on which many projections 503A are continuously formed. The sprocket 503A engages in sprocket holes (not shown) which are formed in the continuous paper 400 along both side edges, whereby the continuous paper 400, together with the belt 503, is driven and fed along the paper path 509.

The printing unit 504 has a photosensitive drum 505 and a developing unit 506. The photosensitive drum 505 corresponds to the photosensitive drum 20 shown in FIG. 2, and the developing unit 506 corresponds to the developing unit 23 shown in FIG. 2. In actuality, the printing unit 504 (not shown in FIG. 29), is also provided with the same feature as the printing process section 10 shown in FIG. 2.

Furthermore, a feed roller 510 and a pinch roller 512 are disposed along the paper path 509 between the tractor unit 502 and the printing unit 504. When the continuous paper 400 passes between the feed roller 510 and the pinch roller 512, the pinch roller 512 is adapted to apply a pinch force to the continuous paper 400. The pinch roller 512 is pivoted on the tip of an arm 520 whose base end is fixed to an axle 522, whereby the pinch roller 512 can swing about the axle 522.

Likewise, a feed roller 511 and a pinch roller 513 are disposed along the paper path 509 between the fixing unit 507 and the stacker 508. When the continuous paper 400 passes between the feed roller 511 and the pinch roller 513, the pinch roller 513 is adapted to apply a pinch force to the continuous paper 400. The pinch roller 513 is pivoted on the tip of an arm 521 whose base end is fixed to an axle 523, whereby the pinch roller 513 can swing about the axle 523.

In the paper feed mechanism described above, the continuous paper 400 is automatically loaded as will be described further below.

(1) The leading end portion of the continuous paper 400 is attached to a portion of the belt 503 which is located under the tractor unit 502 (the sprocket 503A on the belt 503 is engaged in sprocket holes in the continuous paper 400 which are arranged in the leading end portion along both side edges).

(2) The tractor unit 502 rotates to feed the continuous paper 400 until the leading end portion of the continuous paper 400 reaches under the pinch roller 512. At this time, the pinch roller 512 is positioned apart from the feed roller 510 (open state).

(3) The pinch roller 512 is closed to hold the leading end portion of the continuous paper 400 between the pinch roller 512 and the feed roller 510. Then, the feed roller 510 rotates to remove slack from the continuous paper 400. At this time, the tractor unit 502 is stopped from feeding paper.

(4) Then, the tractor unit 502 resumes feeding paper. As a result, sprocket holes in the continuous paper 400 engage the belt 503 at a top portion of the tractor unit 502.

(5) The continuous paper 400 passes under the fixing unit 507 and is fed up to the stacker 508, thereby completing automatic loading. At this time, the pinch roller 513 is pressed against the feed roller 511 to thereby hold the continuous paper therebetween. Because of a pressing force (pinch force) which is applied by the pinch roller 513, a rotating force of the feed roller 511 is reliably transmitted to the continuous paper 400, whereby revolutions of the feed roller 511 help feed the continuous paper 400.

Since the thickness of the continuous paper 400 varies depending on ream weight ranging from 45 to 150 kg, the pinch roller 513 is adapted to vary a pressing force at multiple stage according to paper thickness. For example, a switching lever (not shown) is attached to the axle 523 for operator use, whereby an operator can switch a pressing force of the pinch roller 513 using the selector lever.

On the other hand, usually, a pressing force (pinch force) of the pinch roller 512 is not switchable, and hence it is difficult to vary the pressing force according to paper thickness which corresponds to a ream weight ranging from 45 to 150 kg.

That is, since a pinch force of the pinch roller 512 is held fixed, when the pinch force is set smaller for handling thin paper, the thus-set pinch force is too small to properly handle thicker paper, if fed. On the other hand, when the pinch force is set larger for handling thick paper, the thus-set pinch force is too large to properly handle thinner paper, if fed, causing various problems including damage to the sprocket holes in the continuous paper 400 and a failure to pass the continuous paper 400 between the pinch roller 512 and the feed roller 510.

To allow a pressing force of the pinch roller 512 to be selectable, a selector lever may be attached to the pinch roller 512 as in the case of the pinch roller 513. This, however, means an increase in work items for adjusting a pinch force, thereby increasing a burden on an operator.

Figure 30:
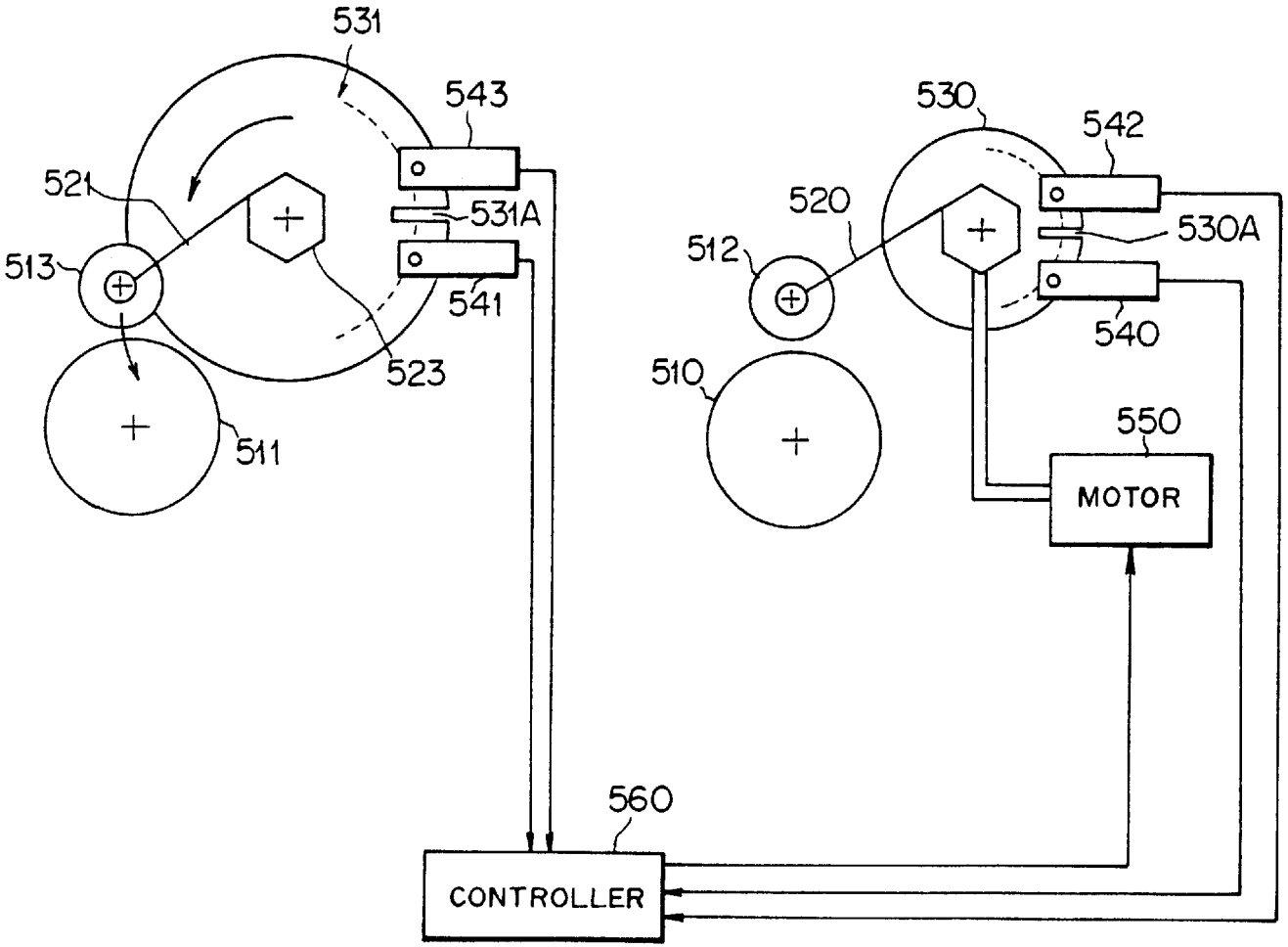
FIG. 30 is a schematic view showing a pinch force control system in the paper feed mechanism of FIG. 29.
Figure 31:
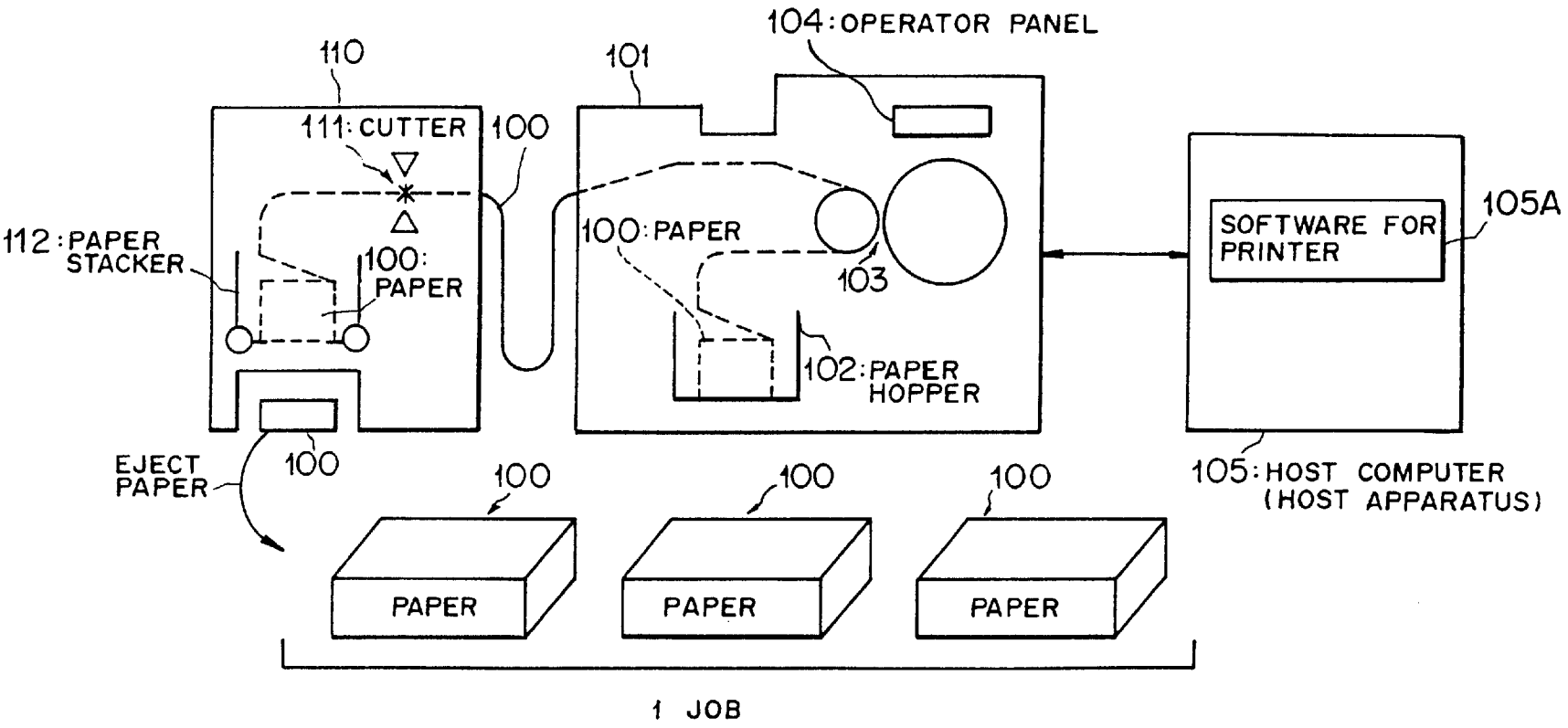
FIG. 31 PRIOR ART
FIG. 31 is a view illustrating the structure and operation of a conventional printing apparatus having a paper handling function.

To prevent this problem, the printing apparatus, according to the embodiments, is provided with a pinch force control system, as shown in FIG. 30.

As shown in FIG. 30, the axles 522 and 523 are provided with code disks 530 and 531, respectively, in which many slits 530A and 531A are formed, respectively, for detecting a rotation angle.

A pair of photo-sensors 540 and 542 are located near the code disk 530 so as to detect slits 530A in the code disk 530. Also, a pair of photo-sensors 541 and 543 are located near the code disk 531 so as to detect slits 531A in the code-disk 531.

A rotary drive shaft of a motor 550 is directly or indirectly connected to the axle 522 which is linked with the pinch roller 512. A rotary drive force of the motor 550 causes the pinch roller 512 to swing via the axle 522 and the arm 520, whereby the pinch force can be adjusted.

In this connection, a controller 560 is provided that controls a rotating operation of the motor 550 in the manner to be described below, in accordance with the result of detecting slits with the photo-sensors 540 to 543.

When an operator adjusts a pinch force of the pinch roller 513 (the position of the pinch roller 513) with the selector lever, a swing angle of the pinch roller 513, i.e., a rotation angle of the axle 523, associated with a movement of the selector lever is detected as a result of the photo-sensors 541 and 543 detecting slits 531A in the code disk 531. That is, based on the number of slits 531A which the photo-sensors 541, 543 detected, in which direction and how much the code disk 531 (i.e., the axle 523) rotated, can be detected.

The controller 560 controls the motor 550 so as to rotate the axle 522, which is linked with the pinch roller 512, by the same rotation angle as that of the axle 523 which was obtained from the result of detection with the photo-sensors 541, 543. Also, the controller 560 exercises feedback control over the motor 550 based on the result of detection with the photo-sensors 540, 542.

As a result, the position of the pinch roller 512, with respect to the feed roller 510, is automatically controlled so as to be identical to the operator adjusted position of the pinch roller 513 with respect to the feed roller 511. Accordingly, if the initial position of the pinch roller 512, with respect to the feed roller 510, is made identical to the initial position of the pinch roller 513, with respect to the feed roller 511, a pinch force of the pinch roller 512 will be automatically controlled so as to be identical to a pinch force of the pinch roller 513.

As a result of adding the pinch force control system described above, in the printing apparatus according to the embodiments, a pressing force of the pinch roller 512 is automatically controlled so as to be identical to an operator adjusted pressing force of the pinch roller 513, whereby a stable feed of the continuous paper 400 can be implemented without increasing a burden on an operator.

In the example shown in FIGS. 29 and 30, two pairs of pinch rollers and feed rollers are provided along the paper path 509. However, even when three or more pairs of pinch rollers and feed rollers are provided, the pinch force control system shown in FIG. 30 is applicable. In this case, only by setting a pinch force of one pinch roller, a pinch force can be set automatically for other two or more pinch rollers, whereby an operation of setting a pinch force does not involve an increase in a burden on an operator.

(f) Others

Apparatus according to the first to fourth embodiments have been described as different apparatus. However, functions of the embodiments may be incorporated into one apparatus, or some functions of the embodiments may be combined as appropriate.

What is claimed is:

1. A paper handling apparatus adapted to receive and handle paper from each print process unit of a plurality of print process units, wherein said paper has been printed on to form printed paper, said paper handling apparatus comprising:

a stacking section, located within said paper handling apparatus, for sequentially stacking said printed paper for each print processing unit of said plurality of print process units, wherein said printed paper is stacked in said stacking section such that stacks for respective print process units can be distinguished from each other;

an unloading mechanism for unloading a stack of said printed paper from said stacking section to a location outside of said paper handling apparatus; and an offset mechanism for shifting a position of stacking said printed paper in said stacking section from a stacking position for a last print process unit to a position for a new print process unit, wherein said offset mechanism comprises an unloading belt, which is located in said stacking section and on which said printed paper is stacked and a drive motor for moving said unloading belt.

2. A paper handling apparatus adapted to receive and handle paper from each print process unit of a plurality of print process units, wherein said paper has been printed on to form printed paper, said paper handling apparatus comprising:

a stacking section, located within said paper handling apparatus, for sequentially stacking said printed paper for a plurality of print process units to form a stacked quantity of said printed paper and wherein said printed paper is stacked in said stacking section such that stacks for respective print process units can be distinguished from each other;

stacked quantity detecting means for detecting said stacked quantity of said printed paper on said table in said stacking section;

halting means for halting an operation of stacking of said printed paper in said stacking section when said stacked quantity, which is detected by said stacked quantity detecting means, reaches a predetermined quantity;

an unloading mechanism for unloading a stack of said printed paper from said stacking section to an outside after an operation of stacking said printed paper in said stacking section has been halted by said halting means; and an offset mechanism for shifting a position of stacking said printed paper in said stacking section from a stacking position for a last print process unit to a position for a new print process unit, wherein said offset mechanism comprises an unloading belt, which is located in said stacking section and on which said printed paper is stacked and a drive motor for moving said unloading belt.

3. The paper handling apparatus according to claim 1, wherein said offset mechanism also serves as an unload mechanism.

4. The paper handling apparatus according to claim 2, wherein said offset mechanism also serves as an unload mechanism.

5. The paper handling apparatus according to claim 1, wherein said printed paper is continuous paper, and said paper handling apparatus is provided with a cutting mechanism for cutting said continuous paper for each print process unit.

6. The paper handling apparatus according to claim 2, wherein said printed paper is continuous paper, and said paper handling apparatus is provided with a cutting mechanism for cutting said continuous paper for each print process unit.

7. A paper handling apparatus adapted to receive and handle paper from each print process unit of a plurality of print process units, wherein said paper has been printed on to form printed paper, wherein said printed paper is continuous paper such that a predetermined quantity of said continuous paper is handled as a loading unit, and wherein said loading unit is one of a plurality of loading units of said continuous paper which are mutually connected, said paper handling apparatus comprising:

a stacking section, located within said paper handling apparatus, for sequentially stacking said printed paper for each print process unit of said plurality of print process units;

connection detecting means for detecting a connection between each loading unit of said plurality of loading units of said continuous paper;

a cutting mechanism for cutting said printed paper at said connection between each loading unit of said plurality of loading units of said continuous paper, when said connection is detected by said connection detecting means; and an unloading mechanism for unloading a quantity of said printed paper equivalent to one loading unit to an outside of said paper handling apparatus, wherein said quantity of printed paper equivalent to said one loading unit is released by cutting with said cutting mechanism and stacked in said stacking section.

8. The paper handling apparatus according to claim 7, wherein said printed paper from is stacked in said stacking section such that stacks for each print process unit of said plurality of print process units can be distinguished from each other.

9. The paper handling apparatus according to claim 8, further comprising an offset mechanism for shifting a position of stacking said printed paper in said stacking section from a stacking position for a last print process unit to a position for a new print process unit.

10. The paper handling apparatus according to claim 9, wherein said offset mechanism comprises:

an unloading belt, which is located in said stacking section and on which said printed paper is stacked; and a drive motor for moving said unloading belt.

11. The paper handling apparatus according to claim 10, wherein said offset mechanism, which includes said unloading belt, also serves as another unloading mechanism.

12. A paper handling apparatus adapted to receive and handle paper from each print process unit of a plurality of print process units, wherein said paper has been printed on to form printed paper, said paper handling apparatus comprising:

a stacking section, located within said paper handling apparatus, for sequentially stacking said printed paper for each print process unit of said plurality of print process units to form a stacked quantity of said printed paper, wherein said stacking section includes a vertically movable table on which said printed paper is stacked and wherein said printed paper is stacked in said stacking section such that stacks for respective print process units can be distinguished from each other;

stacked quantity detecting means for detecting said stacked quantity of said printed paper on said table in said stacking section; and an end notice receiving section for receiving a notice indicating an end of each print process unit of said plurality of print process units;

a cutting mechanism for cutting said printed paper;

selecting means for selecting either of first and second operations, wherein in said first operation, a cutting operation is performed by said cutting mechanism when said stacked quantity detected by said stacked quantity detecting means reaches a first predetermined quantity, and in said second operation, a cutting operation is performed by said cutting mechanism when said stacked quantity detected by said stacked quantity detecting means reaches a second predetermined quantity and said end notice receiving section receives said notice indicating said end of said print process unit;

an unloading mechanism for unloading a stack of said printed paper from said stacking section to an outside after said printed paper has been separated by cutting with said cutting mechanism and stacked in said stacking section; and an offset mechanism for shifting a position of stacking said printed paper in said stacking section from a stacking position for a last print process unit to a position for a new print process unit, wherein said offset mechanism comprises an unloading belt, which is located in said stacking section and on which said printed paper is stacked and a drive motor for moving said unloading belt.

13. The paper handling apparatus according to claim 12, further comprising an unloading mechanism for unloading a stack of said printed paper from said stacking section to an outside of said paper handling apparatus, wherein said printed paper has been separated by cutting with said cutting mechanism and stacked in said stacking mechanism.

14. A printing apparatus with paper handling capabilities, wherein said printing apparatus has a printing section for performing a print operation on printing paper to form printed paper, and a paper handling section for handling said printed paper which has undergone said print operation for each print process unit of a plurality of print process units in said printing section, said paper handling section comprising:

a stacking section, located within said paper handling apparatus, for sequentially stacking said printed paper for each print process unit of said plurality of print process units, wherein said stacking section includes a vertically movable table on which said printed paper is stacked and wherein said printed paper is stacked in said stacking section such that stacks for respective print process units can be distinguished from each other;

an unloading mechanism for unloading a stack of said printed paper from said stacking section to a location outside of said paper handling apparatus, wherein said unloading mechanism includes a direction changer and a conveyor; and wherein said paper handling section comprises an offset mechanism for shifting a position of stacking said printed paper in said stacking section from a stacking position for a last print process unit to a position for a new print process unit, wherein said offset mechanism comprises an unloading belt, which is located in said stacking section and on which said printed paper is stacked and a drive motor for moving said unloading belt.

15. The paper handling apparatus with a paper handling function according to claim 14, wherein said paper handling section comprises:

near full detecting means for detecting a nearly full state of said stacking section when available space therein has decreased to a predetermined quantity before said stacking section has been filled with said printed paper; and control means which causes said printing section to continue printing if printing for any of said print process units has not been completed when said near full detecting means detects said nearly full state and which instructs said unloading mechanism of said paper handling section to perform an unloading operation if printing for a print process unit has been completed when said near full detecting means detects said nearly full state.

16. A printing apparatus with paper handling capabilities, wherein said printing apparatus has a printing section for performing a print operation on printing paper to form printed paper, and a paper handling section for handling said printed paper which has undergone said print operation for each print process unit of said plurality of print process units in said printing section, said paper handling section comprising:

a stacking section, located within said paper handling apparatus, for sequentially stacking said printed paper for each print process unit of said plurality of print process units to form a stacked quantity of said printed paper, wherein said stacking section includes a vertically movable table on which said printed paper is stacked and wherein said printed paper is stacked in said stacking section such that stacks for respective print process units can be distinguished from each other;

stacked quantity detecting means for detecting said stacked quantity of said printed paper on said table in said stacking section;

halting means for halting an operation of stacking of said printed paper in said stacking section when said stacked quantity, which is detected by said stacked quantity detecting means, reaches a predetermined quantity;

an unloading mechanism for unloading a stack of said printed paper from said stacking section to an outside of said paper handling section after said operation of stacking said printed paper in said stacking section has been halted by said halting means; and wherein said paper handling section comprises an offset mechanism for shifting a position of stacking said printed paper in said stacking section from a stacking position for a last print process unit to a position for a new print process unit, wherein said offset mechanism comprises an unloading belt, which is located in said stacking section and on which said printed paper is stacked and a drive motor for moving said unloading belt.

17. The print apparatus with a paper handling function according to claim 14, wherein said offset mechanism, which includes said unloading belt, also serves as another unloading mechanism.

18. The print apparatus with a paper handling function according to claim 15, wherein said offset mechanism, which includes said unloading belt, also serves as another unloading mechanism.

19. The printing apparatus with a paper handling function according to claim 14, wherein said printing paper is continuous paper, and said paper handling apparatus is provided with a cutting mechanism for cutting said continuous paper for each print process unit.

20. The printing apparatus with a paper handling function according to claim 15, wherein said printing paper is continuous paper, and said paper handling apparatus is provided with a cutting mechanism for cutting said continuous paper for each print process unit.

21. The printing apparatus with a paper handling function according to claim 16, wherein said printing paper is continuous paper, and said paper handling apparatus is provided with a cutting mechanism for cutting said continuous paper for each print process unit.

22. A printing apparatus with paper handling capabilities, wherein said printing apparatus has a printing section for performing a print operation on printing paper to form printed paper, and a paper handling section for handling said printed paper which has undergone said print operation for each print process unit of said plurality of print process units in said printing section, and wherein said printed paper is continuous paper such that a predetermined quantity of said continuous paper is handled as a loading unit, and said loading unit is one of a plurality of loading units of said continuous paper which are mutually connected, said paper handling section comprising:

a stacking section, located within said paper handling apparatus, for sequentially stacking said printed paper for each print process unit of said plurality of print process units, wherein said stacking section includes a vertically movable table on which said printed paper is stacked; and connection detecting means for detecting a connection between each loading unit of said plurality of loading units of said continuous paper;

a cutting mechanism for cutting said printed paper at said connection between each loading unit of said plurality of loading units of said continuous paper, when said connection is detected by said connection detecting means; and an unloading mechanism for unloading a quantity of said printed paper outside of said paper handling section, wherein said quantity of said printed paper is equivalent to one loading unit which has been released by cutting with said cutting mechanism and stacked in said stacking section.

23. The paper handling apparatus with a paper handling function according to claim 22, wherein said printed paper from is stacked in said stacking section of said paper handling section such that stacks for each print process unit of said plurality of print process units can be distinguished from each other.

24. The paper handling apparatus with a paper handling function according to claim 23, wherein said paper handling section comprises an offset mechanism for shifting a position of stacking said printed paper in said stacking section from a stacking position for a last print process unit to a position for a new print process unit.

25. The printing apparatus with a paper handling function according to claim 24, wherein said offset mechanism comprises:

an unloading belt, which is located in said stacking section and on which said printed paper is stacked; and a drive motor for moving said unloading belt.

26. The printing apparatus with a paper handling function according to claim 24, wherein said offset mechanism, which includes said unloading belt, also serves as another unloading mechanism.

27. The printing apparatus with a paper handling function according to claim 25, wherein said offset mechanism, which includes said unloading belt, also serves as another unloading mechanism.

28. A printing apparatus with paper handling capabilities, wherein said printing apparatus has a printing section for performing a print operation on printing paper to form printed paper, and a paper handling section for handling said printed paper which is continuous paper that has undergone said print operation for each print process unit of a plurality of print process units in said printing section, said paper handling section comprising:

a stacking section, located within said paper handling apparatus, for sequentially stacking said printed paper for each print process unit of said plurality of print process units to form a stacked quantity of said printed paper, wherein said stacking section includes a vertically movable table on which said printed paper is stacked and wherein said printed paper is stacked in said stacking section such that stacks for respective print process units can be distinguished from each other;

stacked quantity detecting means for detecting said stacked quantity of said printed paper on said table in said stacking section;

a cutting mechanism for cutting said printed paper;

an end notice receiving section for receiving a notice indicating an end of each print process unit of said plurality of print process units;

selecting means for selecting either of first and second operations, wherein in said first operation, a cutting operation is performed by said cutting mechanism when said stacked quantity detected by said stacked quantity detecting means reaches a first predetermined quantity, and in said second operation, a cutting operation is performed by said cutting mechanism when said stacked quantity detected by said stacked quantity detecting means reaches a second predetermined quantity and said end notice receiving section receives said notice indicating said end of said print process unit;

an unloading mechanism for unloading a quantity of said printed paper outside of said paper handling section, wherein said quantity of said printed paper is equivalent to one loading unit which has been released by cutting with said cutting mechanism and stacked in said stacking section; and wherein said paper handling section comprises an offset mechanism for shifting a position of stacking said printed paper in said stacking section from a stacking position for a last print process unit to a position for a new print process unit, wherein said offset mechanism comprises an unloading belt, which is located in said stacking section and on which said printed paper is stacked and a drive motor for moving said unloading belt.

29. A printing apparatus with paper handling capabilities, said printing apparatus comprising:

a printing section for performing a print operation on continuous paper to form printed paper;

a print control section for controlling said print operation of said printing section to form printed paper; and a paper handling section having a cutting mechanism for cutting said continuous paper which has undergone said print operation at said printing section, wherein said printing apparatus further comprises a storage section for storing job name information which is transmitted together with print data from a print requester so as to display a job name of current print data which are currently printed, and when continuous paper is cut by said cutting mechanism while said print operation for one print process unit is not completed, said print control section controls said printing section so as to print said job name of said current print data on a page before and after a cutting position as an intermediate separator based upon said job name information stored in said storage section;

said paper handling section further includes a stacking section, located within said paper handling apparatus, for sequentially stacking said printed paper for each print processing unit of a plurality of print process units, wherein said stacking section includes a vertically movable table on which said printed paper is stacked, and an unloading mechanism for unloading a stack of said printed paper from said stacking section to a location outside of said paper handling apparatus, wherein said unloading mechanism includes a direction changer and a conveyor; and said storage section is an existing overlay memory, and said pattern data is stored in said overlay memory as an overlay pattern.

30. A printing apparatus with paper handling capabilities, said printing apparatus comprising:

a printing section for performing a print operation on continuous paper to form printed paper;

a print control section for controlling said print operation of said printing section; and a paper handling section having a cutting mechanism for cutting said continuous paper which has undergone said print operation at said printing section, wherein said printing apparatus further comprises a counting section which performs a counting operation at a time of a cutting operation of said cutting mechanism and which outputs a counted value, and when continuous paper is cut by said cutting mechanism while said print operation for one print process unit of said plurality of print process units is not completed, said print control section controls said printing section so as to print said counted value received from said counting section on a page before and after cutting position as said intermediate separator;

said paper handling section further includes a stacking section, located within said paper handling section, for sequentially stacking said printed paper for each print processing unit of a plurality of print process units, and an unloading mechanism for unloading a stack of said printed paper from said stacking section to a location outside of said paper handling section; and said storage section is an existing overlay memory, and said pattern data is stored in said overlay memory as an overlay pattern.

31. A printing apparatus with paper handling capabilities, said printing apparatus comprising:

a printing section for performing a print operation on continuous paper to form printed paper;

a print control section for controlling said print operation of said printing section; and a paper handling section having a cutting mechanism for cutting said continuous paper which has undergone said print operation at said printing section, wherein said printing apparatus further comprises a storage section for storing registered pattern data for use as an intermediate separator, and when said continuous paper is cut by said cutting mechanism while said print operation for one print process unit is not completed, said print control section controls said printing section so as to print said pattern data stored in said storage section on a page before and after a cutting position as said intermediate separator;

said paper handling section further includes a stacking section, located within said paper handling section, for sequentially stacking said printed paper for each print processing unit of a plurality of print process units, and an unloading mechanism for unloading a stack of said printed paper from said stacking section to a location outside of said paper handling section; and said storage section is an existing overlay memory, and said pattern data is stored in said overlay memory as an overlay pattern.

32. A printing apparatus with paper handling capabilities, said printing apparatus comprising:

a printing section for performing a print operation on continuous paper to form printed paper;

a print control section for controlling said print operation of said printing section;

a paper handling section for handling said continuous paper which has undergone said print operation for each print process unit of a plurality of print process units at said printing section, wherein said paper handling section comprises a cutting mechanism for cutting said continuous paper which has undergone said print operation at said printing section, a stacking section for stacking said continuous paper which has undergone said print operation at said printing section, a full-of-paper detector for detecting a state wherein said stacking section has become full of said continuous paper, and a cutting control section for controlling a cutting operation of said cutting mechanism, and when said full-of-paper detector detects said state wherein said stacking section is full of said continuous paper while said print operation for one print process unit is not completed, said print control section outputs an instruction to said cutting control section for cutting said continuous paper and controls said printing section so as to print a pattern indicating continuation of a print process unit on a cut-off portion of continuous paper;

an alarm section for generating an alarm simultaneously with the printing of said pattern by said printing section; and wherein said print control section comprises a storage section for storing said pattern in advance.

33. The printing apparatus with a paper handling function according to claim 32, wherein an instruction to begin cutting is entered to cut said continuous paper with said cutting mechanism and said full-of-paper detector detects a state in which said stacking section is full of paper, said print control section outputs an instruction for cutting said continuous paper to said cutting control section and controls said printing section so as to print said pattern on a cut-off portion of said continuous paper.

34. The printing apparatus with a paper handling function according to claim 32, further comprising a selecting section for selecting whether to print said pattern.

35. The printing apparatus with a paper handling function according to claim 32, wherein said print control section controls said printing section so that said pattern is printed on a portion which will become a top surface when said cut-off portion of said continuous paper is stacked in said stacking section.

36. The printing apparatus with a paper handling function according to claim 32, wherein when an instruction for paper ejection is entered to said continuous paper into said stacking section and said full-of-paper detector detects a state in which said stacking section is full of paper, said print control section outputs an instruction for cutting continuous paper to said cutting said control section and controls said printing section so as to print said pattern on a cut-off portion of said continuous paper, and then causes an operation of ejecting paper to be performed.

37. The printing apparatus with a paper handling function according to claim 32, wherein when an automatic paper eject mode is selected in which a remainder of said continuous paper is automatically ejected unprinted if a runout of said continuous paper occurs during printing and when continuous paper runs out, said printer control section outputs an instruction for cutting said continuous paper to said cutting control section and controls said printing section so as to print said pattern on a cut-off portion of said continuous paper, and then causes an operation of automatically ejecting paper to be performed.

38. The printing apparatus with a paper handling function according to claim 32, wherein said print control section causes said printing section to print said pattern only when said paper handling section is in use.

39. A printing apparatus with paper handling capabilities, said printing apparatus comprising:

a printing section for performing a print operation on continuous paper to form printed paper; and a paper handling section having a cutting mechanism for cutting said continuous paper which has undergone said print operation at said printing section, wherein said printing apparatus further comprises:

trouble detecting means for detecting an occurrence of a trouble which requires recovery printing by said printing section;

a cutting control section for controlling said cutting mechanism so as to cut said continuous paper before and after a printed portion, which is to be subjected to recovery printing, for separation thereof when said trouble detecting means detects said occurrence of said trouble;

a stacking section, located within said paper handling section, for sequentially stacking said printed paper for each print processing unit of a plurality of print process units, wherein said printed paper is stacked in said stacking section such that stacks for respective print process units can be distinguished from each other; and an unloading mechanism for unloading a stack of said printed paper from said stacking section to a location outside of said paper handling apparatus, wherein said stack of said printed paper is equivalent to one loading unit which has been released by cutting with said cutting mechanism and stacked in said stacking section; and wherein said paper handling section comprises an offset mechanism for shifting a position of stacking said printed paper in said stacking section from a stacking position for a last print process unit to a position for a new print process unit, wherein said offset mechanism comprises an unloading belt, which is located in said stacking section and on which said printed paper is stacked and a drive motor for moving said unloading belt.

40. The printing apparatus with a paper handling function according to claim 39, further comprising a display section for displaying a presence of a redundantly printed portion when recovery printing is performed by said printing section.

41. The paper handling apparatus according to claim 1, wherein said stacking section includes a vertically movable table on which said printed paper is stacked.

42. The paper handling apparatus according to claim 1, wherein said unloading mechanism includes a direction changer and a conveyor.

43. The paper handling apparatus according to claim 41, wherein said unloading mechanism includes a direction changer and a conveyor.

44. The paper handling apparatus according to claim 2, wherein said stacking section includes a vertically movable table on which said printed paper is stacked.

45. The paper handling apparatus according to claim 7, wherein said stacking section includes a vertically movable table on which said printed paper is stacked.

46. The paper handling apparatus according to claim 12, wherein said stacking section includes a vertically movable table on which said printed paper is stacked.

47. The paper handling apparatus according to claim 14, wherein said stacking section includes a vertically movable table on which said printed paper is stacked.

48. The paper handling apparatus according to claim 14, wherein said unloading mechanism includes a direction changer and a conveyor.

49. The paper handling apparatus according to claim 47, wherein said unloading mechanism includes a direction changer and a conveyor.

50. The paper handling apparatus according to claim 16, wherein said stacking section includes a vertically movable table on which said printed paper is stacked.

51. The paper handling apparatus according to claim 28, wherein said stacking section includes a vertically movable table on which said printed paper is stacked.

52. The paper handling apparatus according to claim 29, wherein said stacking section includes a vertically movable table on which said printed paper is stacked.

53. The paper handling apparatus according to claim 29, wherein said unloading mechanism includes a direction changer and a conveyor.

54. The paper handling apparatus according to claim 52, wherein said unloading mechanism includes a direction changer and a conveyor.

55. The paper handling apparatus according to claim 30, wherein said stacking section includes a vertically movable table on which said printed paper is stacked.

56. The paper handling apparatus according to claim 30, wherein said unloading mechanism includes a direction changer and a conveyor.

57. The paper handling apparatus according to claim 55, wherein said unloading mechanism includes a direction changer and a conveyor.

58. The paper handling apparatus according to claim 31, wherein said stacking section includes a vertically movable table on which said printed paper is stacked.

59. The paper handling apparatus according to claim 31, wherein said unloading mechanism includes a direction changer and a conveyor.

60. The paper handling apparatus according to claim 58, wherein said unloading mechanism includes a direction changer and a conveyor.

61. The paper handling apparatus according to claim 39, wherein said stacking section includes a vertically movable table on which said printed paper is stacked.

62. The paper handling apparatus according to claim 39, wherein said unloading mechanism includes a direction changer and a conveyor.

63. The paper handling apparatus according to claim 61, wherein said unloading mechanism includes a direction changer and a conveyor.

64. A printing apparatus with paper handling capabilities, said printing apparatus comprising:

a printing section for performing a print operation on continuous paper to form printed paper;

a print control section for controlling said print operation of said printing section;

a paper handling section for handling said continuous paper which has undergone said print operation for each print process unit of a plurality of print process units at said printing section, wherein said paper handling section comprises a cutting mechanism for cutting said continuous paper which has undergone said print operation at said printing section, a stacking section for stacking said continuous paper which has undergone said print operation at said printing section, a full-of-paper detector for detecting a state wherein said stacking section has become full of said continuous paper, and a cutting control section for controlling a cutting operation of said cutting mechanism, and when said full-of-paper detector detects said state wherein said stacking section is full of said continuous paper while said print operation for one print process unit is not completed, said print control section outputs an instruction to said cutting control section for cutting said continuous paper and controls said printing section so as to print a pattern indicating continuation of a print process unit on a cut-off portion of continuous paper;

wherein when an automatic paper eject mode is selected in which a remainder of said continuous paper is ejected in an unprinted state when a runout of said continuous paper occurs during printing, said print control section outputs an instruction for cutting said continuous paper by said cutting control section and controls said printing section so as to print said pattern on a cut-off portion of said continuous paper, and then causes an operation of automatically ejecting paper to be performed; and wherein said print control section comprises a storage section for storing said pattern in advance.

65. A printing apparatus with paper handling capabilities, said printing apparatus comprising:

a printing section for performing a print operation on continuous paper to form printed paper;

a print control section for controlling said print operation of said printing section;

a paper handling section for handling said continuous paper which has undergone said print operation for each print process unit of a plurality of print process units at said printing section, wherein said paper handling section comprises a cutting mechanism for cutting said continuous paper which has undergone said print operation at said printing section, a stacking section for stacking said continuous paper which has undergone said print operation at said printing section, a full-of-paper detector for detecting a state wherein said stacking section has become full of said continuous paper, and a cutting control section for controlling a cutting operation of said cutting mechanism, and when said full-of-paper detector detects said state wherein said stacking section is full of said continuous paper while said print operation for one print process unit is not completed, said print control section outputs an instruction to said cutting control section for cutting said continuous paper and controls said printing section so as to print a pattern indicating continuation of a print process unit on a cut-off portion of continuous paper; and wherein said print control section causes said printing section to print said pattern only when said paper handling section is in use and wherein said print control section comprises a storage section for storing said pattern in advance.

* * * * *